US010816302B2

(12) United States Patent
Saunders

(10) Patent No.: US 10,816,302 B2
(45) **Date of Patent: *Oct. 27, 2020**

(54) SLINGSHOT

(71) Applicant: Saunders Archery Company, Columbus, NE (US)

(72) Inventor: Charles A. Saunders, Columbus, NE (US)

(73) Assignee: Saunders Archery Company, Columbus, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/443,845

(22) Filed: Feb. 27, 2017

(65) Prior Publication Data

US 2017/0299319 A1 Oct. 19, 2017

Related U.S. Application Data

(63) Continuation-in-part of application No. 14/216,108, filed on Mar. 17, 2014, now Pat. No. 9,581,405, and a continuation-in-part of application No. 15/187,390, filed on Jun. 20, 2016, now abandoned, which is a continuation of application No. 14/566,238, filed on Dec. 10, 2014, now Pat. No. 9,372,044, which is a (Continued)

(51) Int. Cl.
*F41B 3/02* (2006.01)

(52) U.S. Cl.
CPC ..... *F41B 3/02* (2013.01)

(58) Field of Classification Search
CPC ..... F41B 5/0031; F41B 3/02; F41B 3/005; F41B 3/03; F41B 3/00
USPC ..... 124/29, 489, 20.1, 20.2, 20.3, 17; 446/266, 421; 473/203, 538, 549
See application file for complete search history.

(56) References Cited

U.S. PATENT DOCUMENTS

| | | | |
|---|---|---|---|
| 1,487,973 | A | 3/1924 | Preston |
| 2,645,217 | A | 7/1953 | Jesse |
| 2,661,731 | A | 12/1953 | Casey |

(Continued)

OTHER PUBLICATIONS

Henrie, Roger, "A Pair of Recurve Hunters Walnut and Hickory", on http://slingshotforum.com, post dated Feb. 13, 2013, p. 1-5.

(Continued)

*Primary Examiner* — John E Simms, Jr.
*Assistant Examiner* — Rayshun K Peng
(74) *Attorney, Agent, or Firm* — Levenfeld Pearlstein, LLC

(57) ABSTRACT

A slingshot includes a handle having a plurality of positioning grooves, the grooves spaced along a length of the handle, a pair of arms extending upwardly and forwardly from the handle, each arm having a band attachment device, a pair of wings extending laterally outward and forward from handle, each wing configured to be supported by a portion of a user's hand, an arm brace secured to the handle and a palm plate removably secured to the handle. The palm plate is configured to be removed from one positioning groove of the plurality of positioning grooves and secured to another groove of the plurality of positioning grooves. A handleless slingshot is also provided having a wire or wire-like body including, in one embodiment, a lower portion, a pair of wings connected to one another by the lower portion, a pair of arms, and an upper portion.

18 Claims, 122 Drawing Sheets

Related U.S. Application Data continuation of application No. 14/216,243, filed on Mar. 17, 2014, now Pat. No. 8,936,014.

(60) Provisional application No. 61/787,885, filed on Mar. 15, 2013, provisional application No. 61/787,911, filed on Mar. 15, 2013.

(56) References Cited

U.S. PATENT DOCUMENTS

| | | | | | |
|---|---|---|---|---|---|
| 2,667,863 | A | * | 2/1954 | Styles | F41B 3/02 124/20.1 |
| 2,672,857 | A | | 3/1954 | Gauthier | |
| 2,735,417 | A | | 2/1956 | Denekar | |
| 2,995,129 | A | | 8/1961 | Malott | |
| 3,407,798 | A | | 10/1968 | Rock | |
| 3,511,221 | A | | 5/1970 | Saunders | |
| 3,517,657 | A | | 6/1970 | Alban | |
| 3,618,585 | A | | 11/1971 | Allison | |
| 3,749,075 | A | | 7/1973 | Saunders | |
| 3,812,834 | A | * | 5/1974 | Saunders | F41B 3/02 124/20.1 |
| 3,901,209 | A | | 8/1975 | Woolsey | |
| 3,974,820 | A | * | 8/1976 | Ott | F41B 3/02 124/20.1 |
| 4,250,861 | A | | 2/1981 | Ellenburg | |
| 4,265,212 | A | | 5/1981 | Wolf | |
| 4,274,387 | A | | 6/1981 | McBride | |
| 4,307,699 | A | | 12/1981 | Cuesta | |
| 4,373,503 | A | | 2/1983 | Saunders | |
| 4,437,449 | A | | 3/1984 | Attanasio | |
| 4,569,324 | A | * | 2/1986 | Garcia | B21F 1/002 124/20.1 |
| 4,583,513 | A | | 4/1986 | Ellenburg et al. | |
| 4,771,756 | A | | 9/1988 | Miles | |
| 4,877,007 | A | | 10/1989 | Olson | |
| 5,230,323 | A | | 7/1993 | Saunders et al. | |
| 5,279,276 | A | | 1/1994 | Nagel et al. | |
| 5,345,922 | A | | 9/1994 | Ott | |
| 5,501,207 | A | | 3/1996 | Black | |
| 5,657,738 | A | * | 8/1997 | Klundt | F41B 7/02 124/17 |
| 5,752,495 | A | | 5/1998 | Tuller et al. | |
| 5,853,000 | A | | 12/1998 | Torgerson et al. | |
| 6,152,831 | A | * | 11/2000 | Arcenas | A63B 53/14 473/206 |
| 6,786,213 | B1 | | 9/2004 | Lee | |
| 6,968,835 | B2 | | 11/2005 | Lee | |
| 7,389,774 | B1 | | 6/2008 | Fonda | |
| 7,484,505 | B1 | | 2/2009 | Saunders | |
| 7,509,952 | B2 | | 3/2009 | Aiken et al. | |
| 7,543,579 | B2 | | 6/2009 | Chang | |
| 7,748,369 | B2 | | 7/2010 | Chee | |
| 7,823,571 | B2 | | 11/2010 | Williamson et al. | |
| 7,827,977 | B2 | | 11/2010 | Saunders | |
| 8,025,047 | B2 | | 9/2011 | Saunders | |
| 8,347,868 | B2 | | 1/2013 | Saunders | |
| 8,640,682 | B2 | | 2/2014 | Shirk, II | |
| 8,925,535 | B2 | | 1/2015 | Phillips | |
| 2003/0034019 | A1 | | 2/2003 | Lewis | |
| 2006/0191521 | A1 | | 8/2006 | Gee | |
| 2008/0053421 | A1 | | 3/2008 | Chang | |
| 2008/0156308 | A1 | | 7/2008 | Zadra | |
| 2009/0173329 | A1 | | 7/2009 | Saunders | |
| 2010/0154583 | A1 | * | 6/2010 | Chuang | B62J 9/21 74/551.7 |
| 2010/0294255 | A1 | | 11/2010 | Saunders | |
| 2010/0300419 | A1 | | 12/2010 | Saunders | |
| 2012/0125266 | A1 | | 5/2012 | Ying | |
| 2013/0247894 | A1 | | 9/2013 | Saunders | |

OTHER PUBLICATIONS

EHS Slingshots, "GS-12 by Gopher Slingshots", on http://slingshoforum.com/gallery/image/4274-gs-12-by-gopher-slingshots/, uploaded Nov. 14, 2011, p. 1-2.

* cited by examiner

SLINGSHOT

CROSS REFERENCE TO RELATED APPLICATIONS

This application is a continuation-in-part of U.S. patent application Ser. No. 14/216,108, filed Mar. 17, 2014, which claims the benefit of U.S. Provisional Patent Application Ser. No. 61/787,885, filed Mar. 15, 2013, and is also a continuation-in-part of U.S. patent application Ser. No. 15/187,390, filed Jun. 20, 2016, which is a continuation of U.S. patent application Ser. No. 14/566,238, filed Dec. 10, 2014, now U.S. Pat. No. 9,372,044, issued Jun. 21, 2016, which is a continuation of U.S. patent application Ser. No. 14/216,243, filed Mar. 17, 2014, now U.S. Pat. No. 8,936,014, issued Jan. 20, 2015, which claims the benefit of U.S. Provisional Patent Application Ser. No. 61/787,911, filed Mar. 15, 2013, the disclosures of each of which are incorporated herein by reference in their entireties.

BACKGROUND OF THE INVENTION

The present invention relates generally to slingshots.

Slingshots commonly are used for recreation and for hunting. Although slingshots have existed for centuries, the basic design and mechanics have remained constant over time. Quite simply, a traditional slingshot comprises a handle and a pair of arms extending divergently upward from the handle. An elastic band is attached between the arms. Typically, centered on the elastic band is a pouch designed to hold a projectile.

After a projectile is placed in the pouch, the pouch is pulled backwards, away from the arms, thereby extending and stretching the elastic band to create potential energy. When the pouch is released, the potential energy of the elastic band is transformed to kinetic energy which is transferred to the projectile through the pouch. The projectile then is thrust forward, out of the pouch, and away from slingshot shooter and toward a desired target.

Various design enhancements have been made over the years in an attempt to improve the functionality and performance of slingshots. For example, such improved slingshot devices include arm and wrist braces to help stabilize shots, foldable designs to make devices more portable, aiming mechanisms to improve accuracy, multi-band designs to improve band life and increase shot speed and pulley assemblies to produce maximum projectile velocity with minimum force exertion by the user.

One such improved slingshot design is disclosed in U.S. Pat. No. 5,230,323 to Saunders et al., the disclosure of which is fully incorporated herein by reference. Saunders discloses an arm-braced slingshot having a handle, a hook assembly, a pair of elastic bands, a pouch, an arm brace and a retaining clip. The arm brace comprises a generally U-shaped collar having an intermediate yoke portion which is dimensioned to be received in a peripheral recess of the handle. The distal ends of the collar are provided with an arm strap extending therebetween which extends over the user's forearm when the handle is gripped in the normal manner during use of the slingshot.

The slingshot disclosed in Saunders has been updated and improved over time with respect to the types of bands, pouches and connection mechanisms used with the slingshot. Modern variations of the Saunders slingshot design utilize flat bands, quick-snap band connection/replacement mechanisms and unique pouch designs, among other features. For example, U.S. Pat. No. 8,347,868 to Saunders, the disclosure of which is fully incorporated herein by reference, discloses a collapsible locking slingshot having a quick-release interchangeable band system that uses clips that matingly engage grooves formed at the ends of the slingshot arms.

Another known slingshot design combines features disclosed in U.S. Pat. Nos. 5,230,323 and 8,347,868. This prior art slingshot 100, depicted in FIG. 1, includes a handle 101, a pair of forward facing arms 102, a band 103, a pouch 104, an arm brace 105 and a retaining clip 106 for securing arm brace 105 and arms 102 to handle 101.

However, instead of using tubular bands and a hook assembly, the prior art device depicted in FIG. 1 uses a quick-release interchangeable band system having adapters 107 mounted to the ends of arms 102, the adapters 107 having grooves with which clips 108 are matingly engaged in order to secure the ends of band 103 to arms 102. Such a device is sold by Saunders Archery Company, in Columbus, Nebr. under the brand name "Falcon-2™."

Despite all of the innovations in slingshot technology, room still exists for improvement. In particular, slingshot handle designs can be improved to provide for additional functionality, improved usability, the addition of protective equipment and the addition of accessories. Such improvements would permit slingshots to become more usable, accurate and enjoyable.

What is needed, therefore, is a slingshot having an improved handle design. Preferably, such a slingshot comprises a handle adapted to receive a palm plate, the palm plate configured to engage a user's palm when the slingshot is shot and the palm plate being adjustably mountable to the handle to accommodate different sized hands. More preferably, such a slingshot comprises a handle adapted to receive a handle guard, the handle guard configured to prevent the band from contacting the handle (and the user's hand holding the handle) during recoil. More preferably yet, such a slingshot comprises a handle adapted to receive accessories, such as stabilizers, dampeners, storage containers and the like. The present invention satisfies this need.

In addition, despite all of the innovations in slingshot technology, slingshot portability and size remains an unsolved issue. Since most slingshots still include a handle, a pair of arms extending from the handle, an elastic band attached between the arms, and a pouch centered on the band and designed to hold a projectile, even collapsible and foldable slingshot designs can be bigger and less portable than desired. Because of the forces involved shooting a traditional slingshot, handles, braces and other mechanical features have become a necessity in order to counterbalance the forces generated during the process of shooting a slingshot and to thereby help achieve an accurate shot. However, these mechanical features add size and bulk, and thus decrease portability of the slingshot.

What is needed, therefore, is a slingshot that does not require a handle in order to shoot it. Preferably, but not necessarily, such a handleless slingshot includes a storage compartment that can store projectiles (such as steel shot) and/or other supplies. More preferably, the storage compartment is foldable such that it can be folded into the base of the slingshot to create a compact, portable unit. More preferably yet, such a slingshot includes a quick-release interchangeable band system that uses clips that matingly engage grooves formed at the ends of the slingshot arms. More preferably still, such a slingshot includes guard area which protects the web area of the hand when shooting the slingshot. Most preferably, such a slingshot moves the thumb and index finger pressure (contact) points forward of the band to increase stability and eliminate the need to grip a handle when shooting the slingshot. The present invention satisfies this need.

Further, releasing of the band to propel a projectile causes the band to travel forward relative to the slingshot and then recoil back toward the slingshot. In some instances, the recoiling band may come into contact with a handle or a user's hand gripping the handle. To address this, some slingshots include handle guard disposed forwardly of the handle. The handle guard is positioned to block a travel path of a recoiling band, thereby preventing the recoiling band from contacting the handle or the user's hand. However, some handle guards may require additional manufacture or assembly steps, may add weight to the slingshot, and may affect the balance of a slingshot in a user's hand.

Accordingly, it is also desirable to provide a slingshot that may be gripped by user in a way that the user's hand is not positioned within a travel path of a recoiling band.

Further still, in regular use, only certain areas of slingshots experience stresses and forces associated with loading (drawing back) of the band, unloading (releasing) the band, and bracing the slingshot against the user. Thus, in some traditional slingshots, more material is used than is necessary for sufficient strength and rigidity of the slingshot. As such, some typical slingshots are formed having unnecessarily large weights and/or volumes, which may result in a bulky appearance or feel and increase material costs.

Accordingly, it is desirable to provide a slingshot having reduced weight and volume and reduced material usage while retaining sufficient rigidity for regular use of the slingshot.

BRIEF SUMMARY OF THE INVENTION

According to one aspect, there is provided a slingshot, the slingshot having a handle including a plurality of positioning grooves, the positioning grooves spaced along a length of the handle, a pair of forward facing arms extending upwardly and forwardly from the handle, each arm having a band attachment device, a pair of wings extending laterally outward and forward from handle, each wing configured to be supported by a portion of a user's hand, an arm brace secured to the handle, and a palm plate removably secured to the handle at one positioning groove of the plurality of positioning grooves. The palm plate is configured to be removed from the positioning groove of the plurality of positioning grooves and secured to another positioning groove of the plurality of positioning grooves to adjust a position of the palm plate along a length of the handle.

According to another aspect, a handleless slingshot includes a body having a lower portion, a pair of wings connected to one another by the lower portion, a pair of integrated arms, each arm formed integrally with a respective wing, and respective upper portions connected to each arm, each upper portion configured for attachment of a slingshot band thereto. The body is formed as a single, continuous piece of wire or wire-like material.

According to yet another aspect, a handleless slingshot includes a body formed as a single, continuous piece of wire or wire-like material that is formed in a compound bent "U" shape having a pair of arms each configured for attachment of a slingshot band thereto. In one embodiment, a support structure comprising web and finger platforms may be fastened to the body of the slingshot to provide rest areas for a user's index finger and thumb, and the web area between the user's index finger and thumb.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein:

FIG. 124 is a perspective view of the slingshot of FIG. 121 further comprising a support structure;

FIG. 125 is a side view of the slingshot of FIG. 124; and,

FIG. 126 is a partial rear view of the slingshot of FIG. 124.

DETAILED DESCRIPTION OF THE INVENTION

Figure 1:
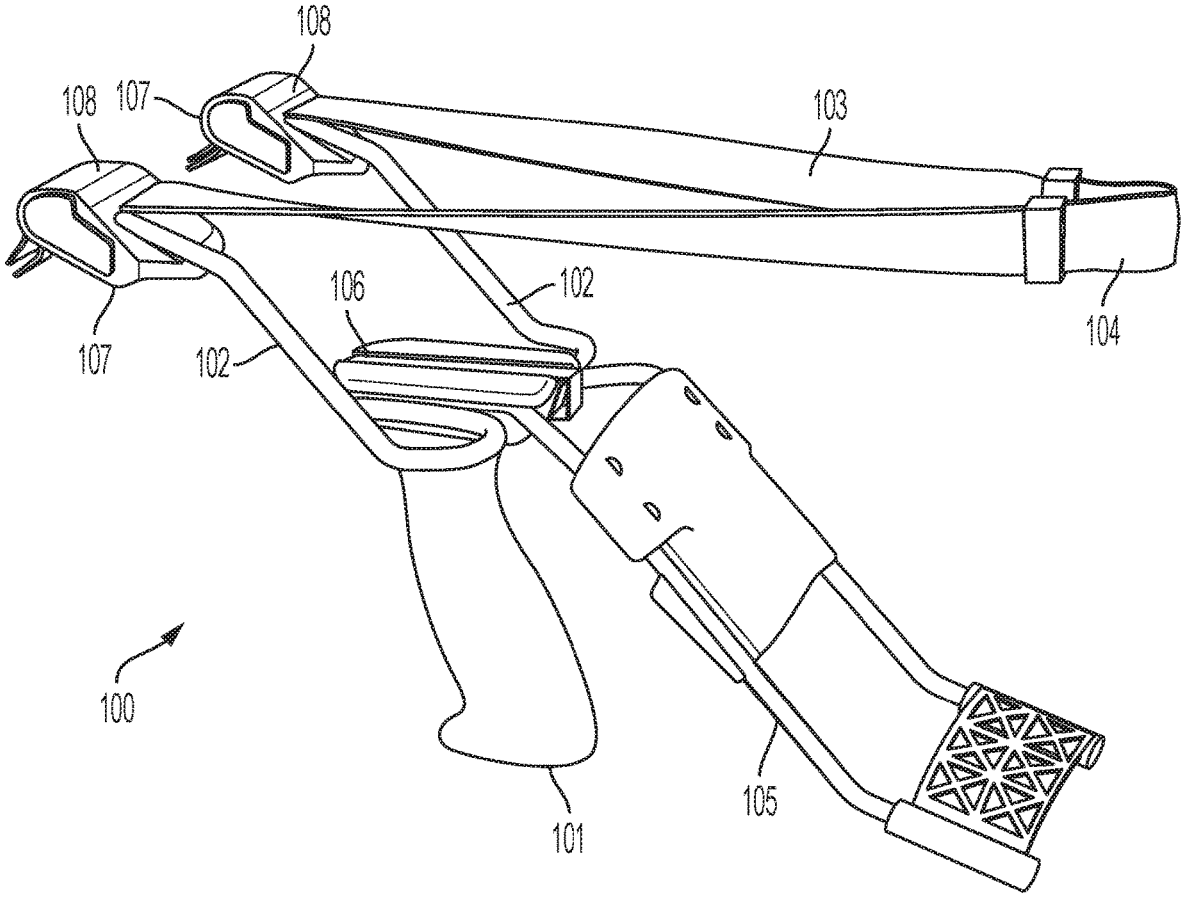
FIG. 1 PRIOR ART
FIG. 1 is a perspective view of a prior art slingshot.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply, nor should be inferred to limit the subject matter disclosed herein.

FIGS. 2-35 illustrate a slingshot with handle guard and palm plate, a handle, a palm plate and a handle guard embodying the principles of the present invention.

As shown in FIGS. 2-35, slingshot 1 comprises a handle 2, a pair of arms 4 extending upwardly and forwardly from handle 2 with band attachment devices 5 attached to the ends of arms 4, an arm brace 6, and a retaining clip 3 for securing arm brace 6 and arms 4 to handle 2. An optional bail guard 13 is shown attached to arm brace 6 in the disclosed embodiment of slingshot 1. This basic configuration (excluding the design of handle 2) is known in the art.

Handle 2 of slingshot 1 is formed as a pistol grip handle member having a generally flat top 7. Top 7 of handle 2 is provided with an elongated recess 8 which is dimensioned at one end 9 to receive a portion of retaining clip 3 and dimensioned at the other end 10 to receive a portion of a handle guard 11. In this manner, retaining clip 3 secures one end of handle guard 11 to the top 7 of handle 2, as further discussed below. The top 7 may be formed on a mounting base 27. The handle 2 further includes a gripping portion 28 extending from the mounting base 27. The mounting base 27 includes a peripheral groove 29, extending at least partially about the periphery of the mounting base 27, in which the arms 4 and the arm brace 6 may be secured by the retaining clip.

Figure 2:
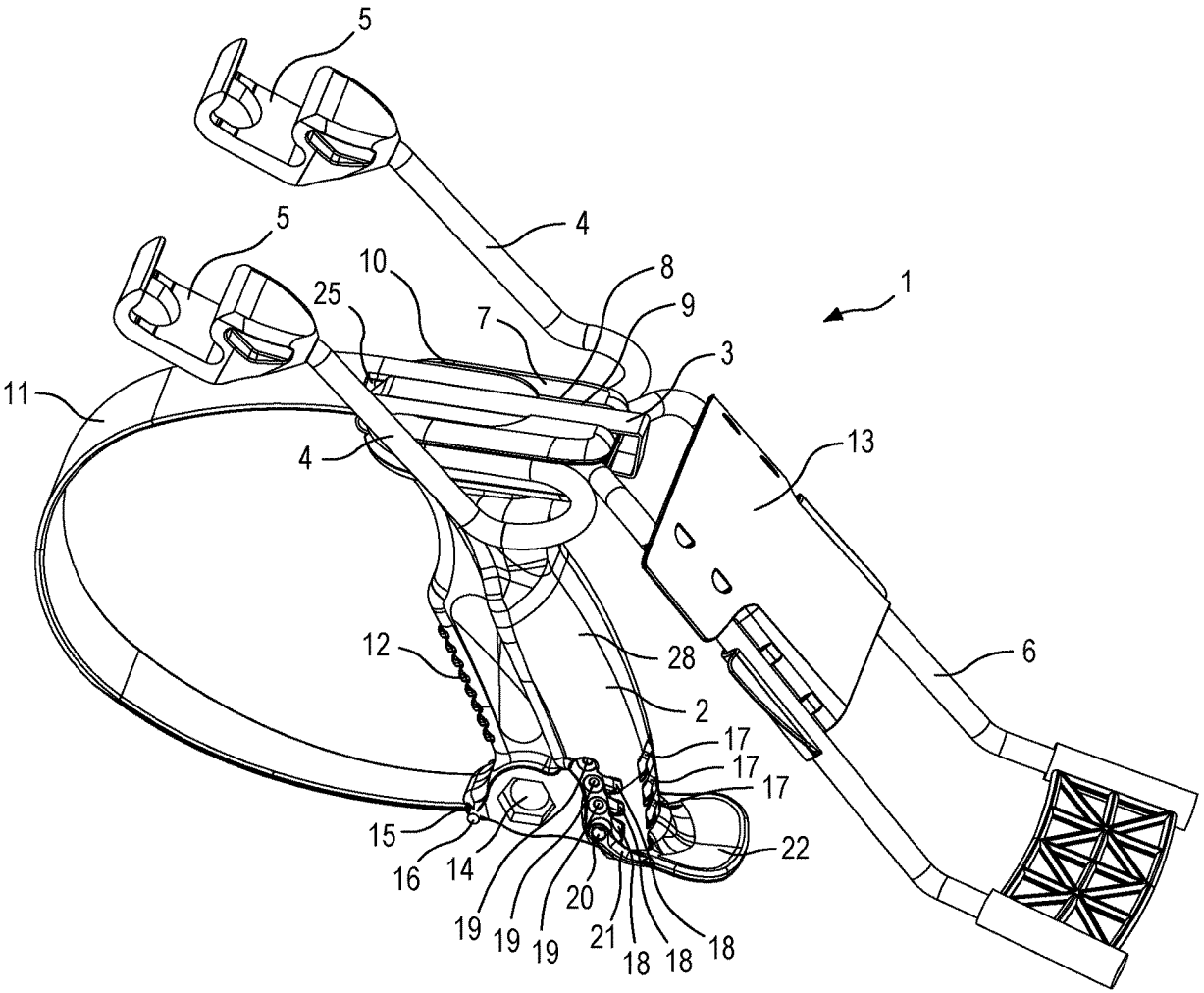
FIG. 2 is a perspective view of a slingshot with handle guard and palm plate according to one embodiment.
Figure 3:
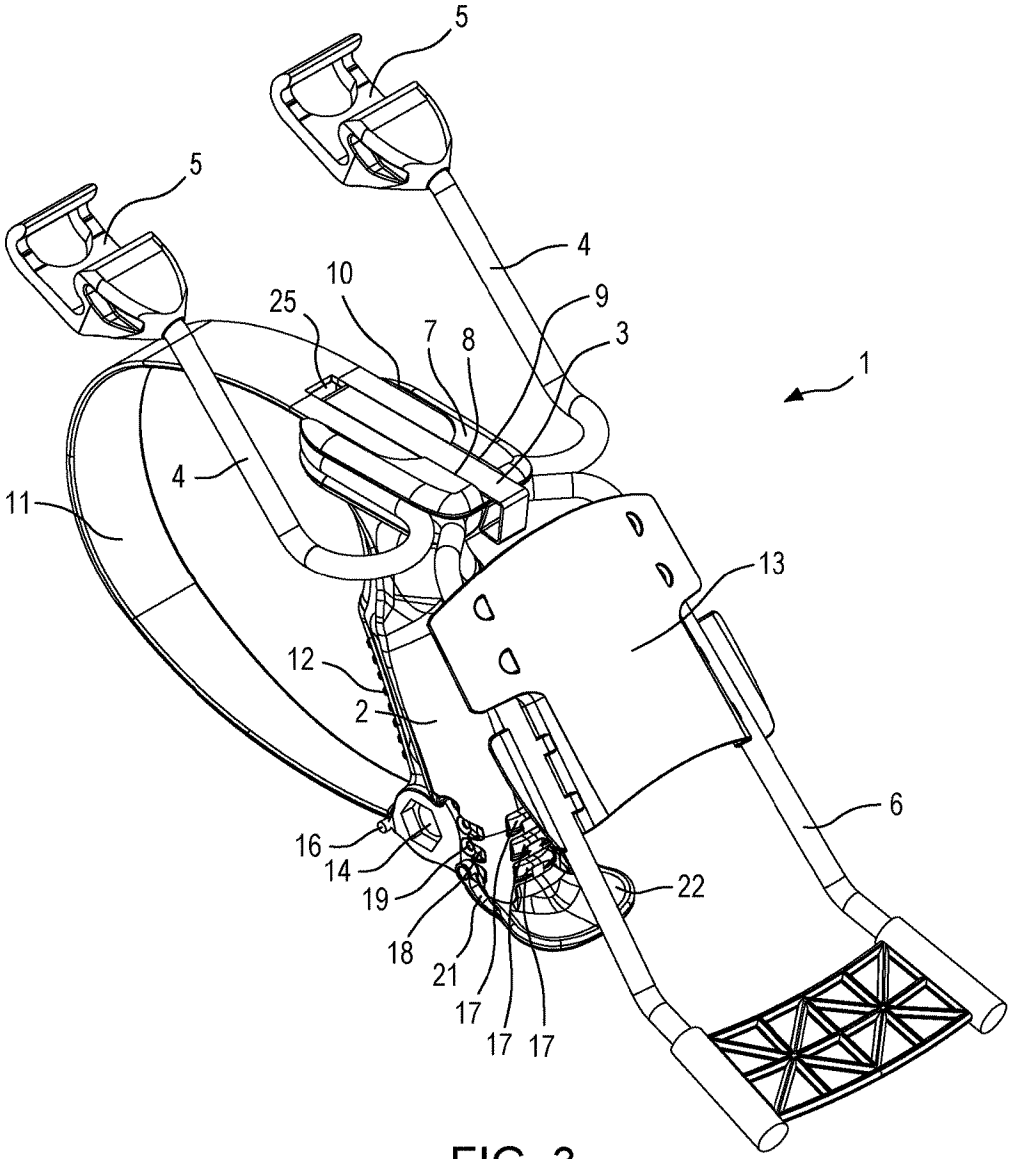
FIG. 3 is a perspective view of the slingshot of FIG. 2.
Figure 4:
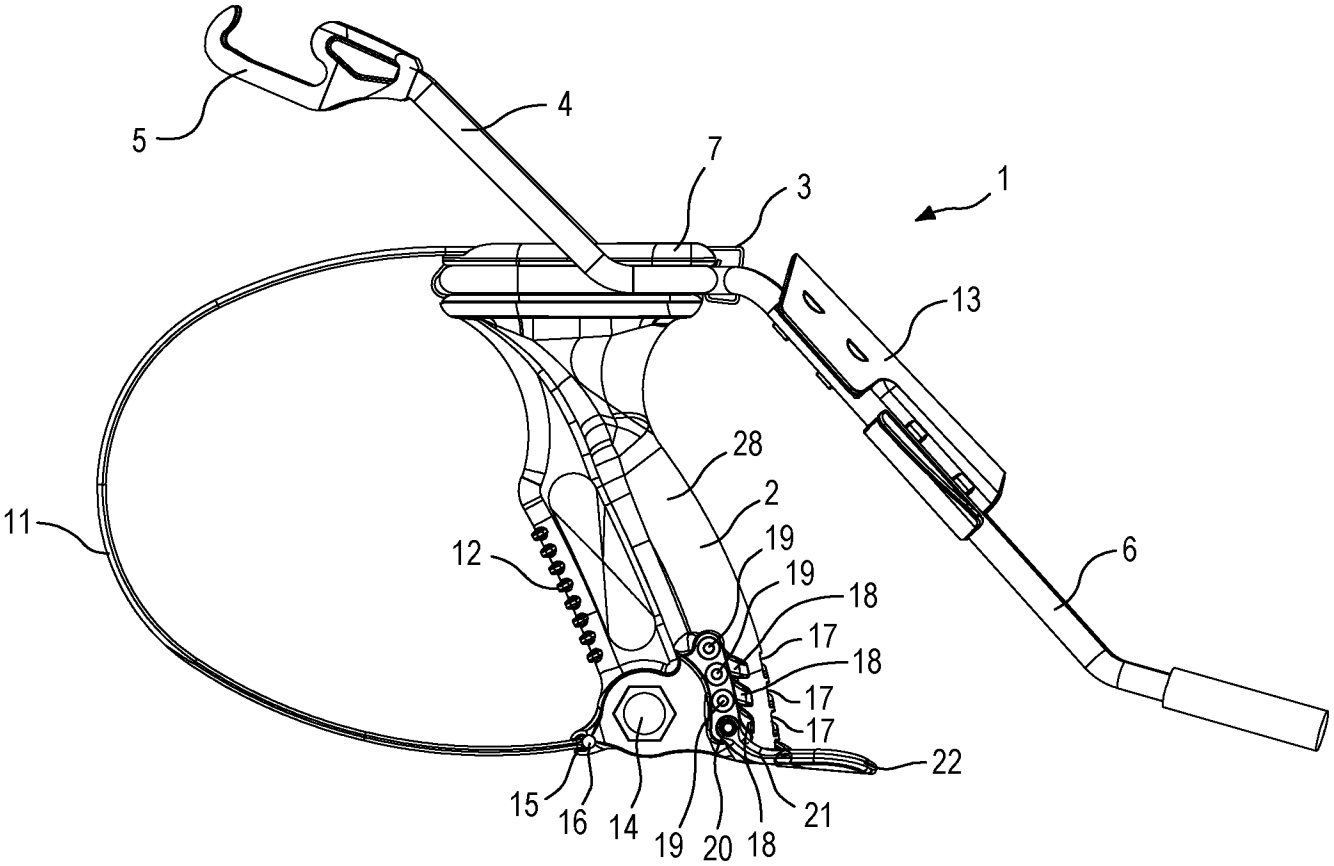
FIG. 4 is a right side view of the slingshot of FIG. 2.
Figure 5:
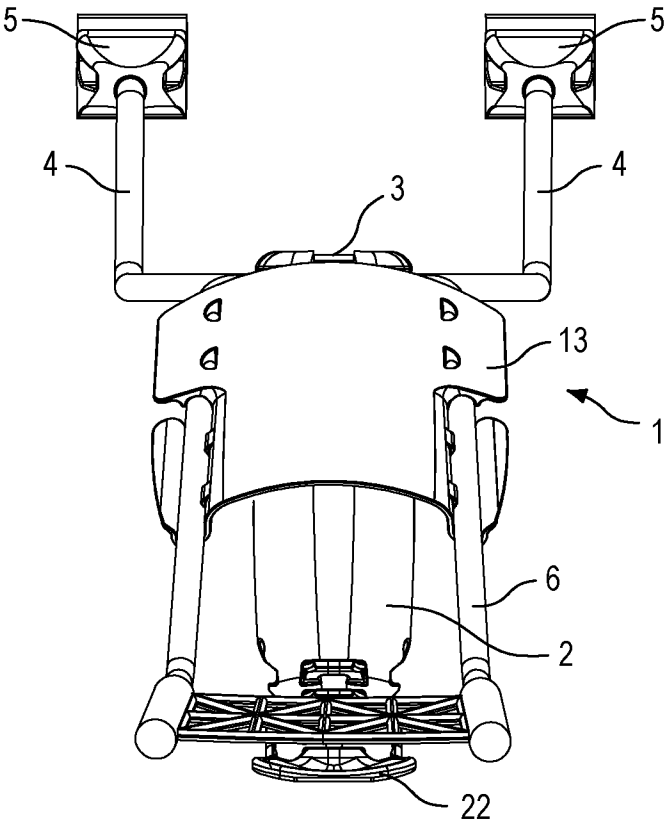
FIG. 5 is a rear view of the slingshot of FIG. 2.
Figure 6:
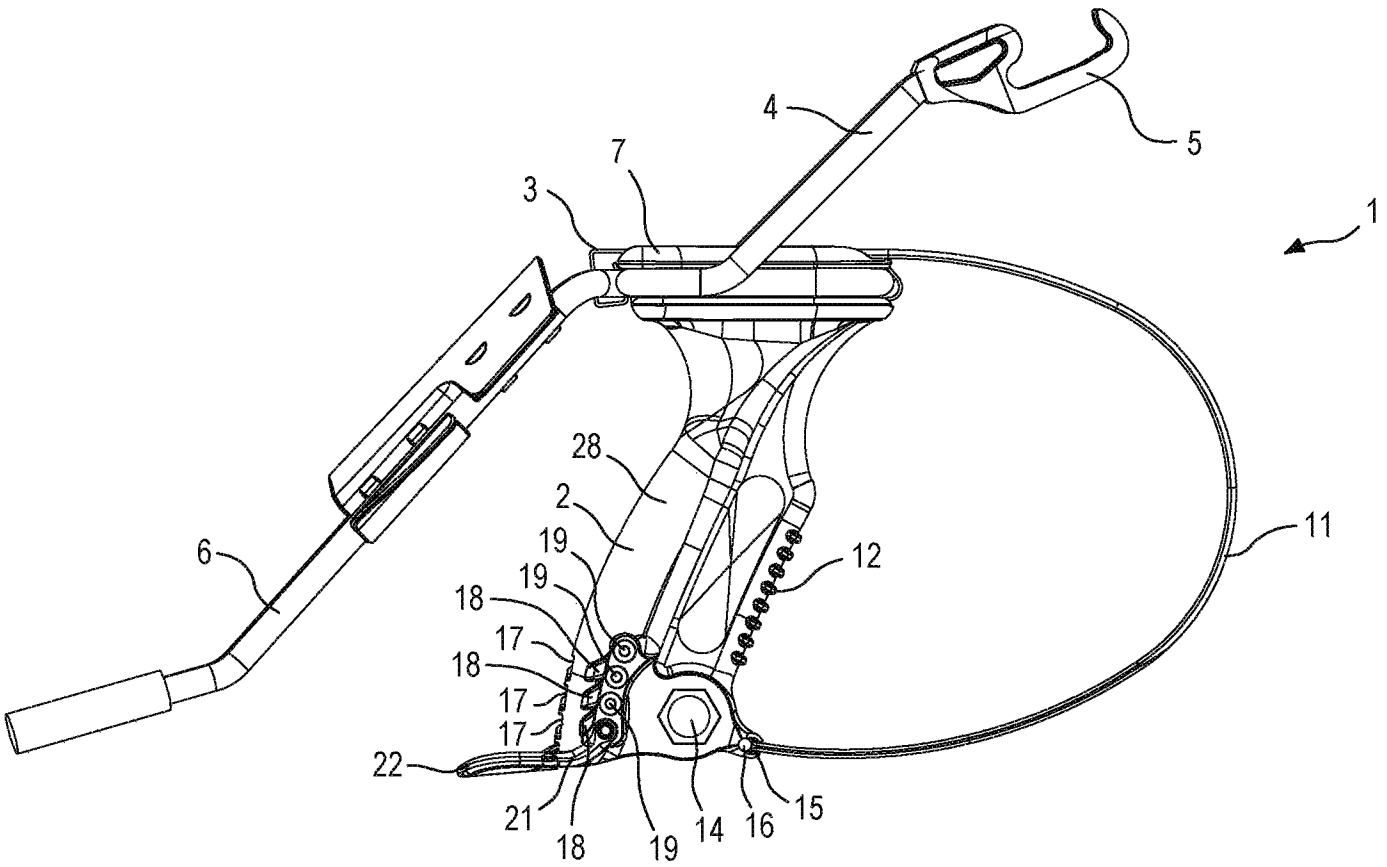
FIG. 6 is a left side view of the slingshot of FIG. 2.
Figure 7:
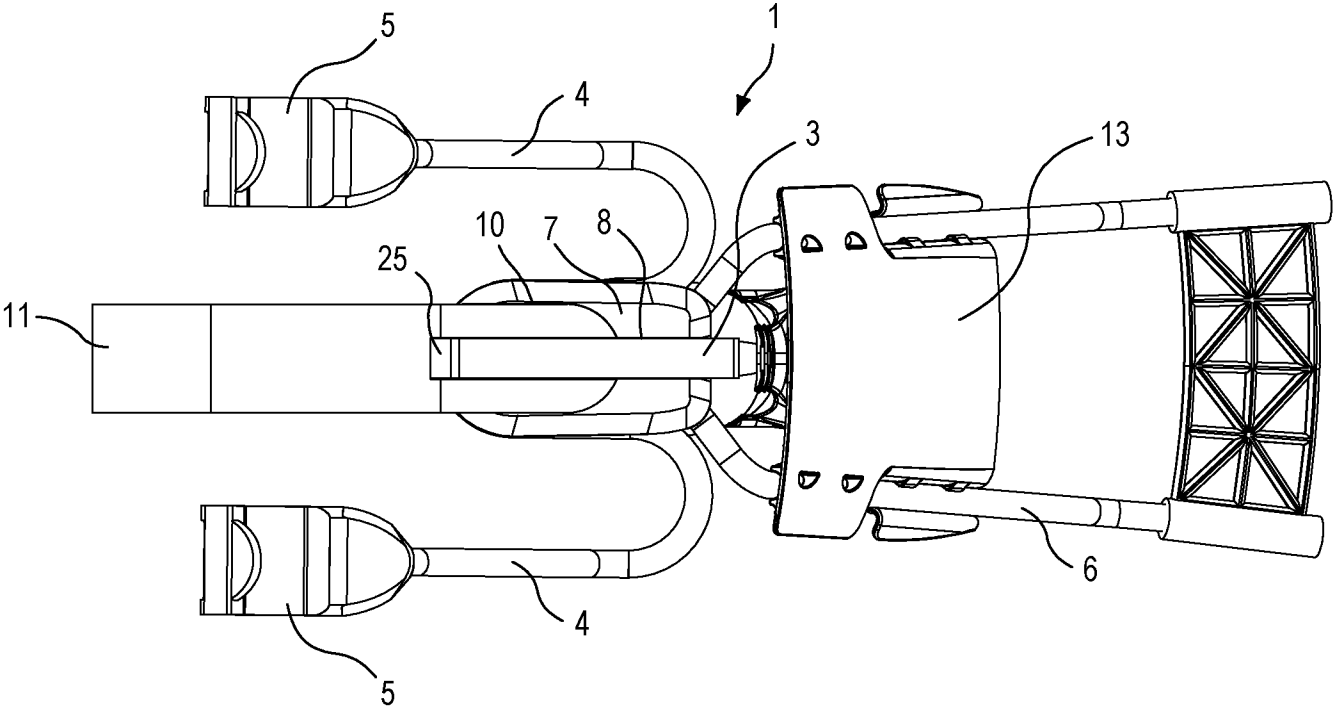
FIG. 7 is a top view of the slingshot of FIG. 2.
Figure 8:
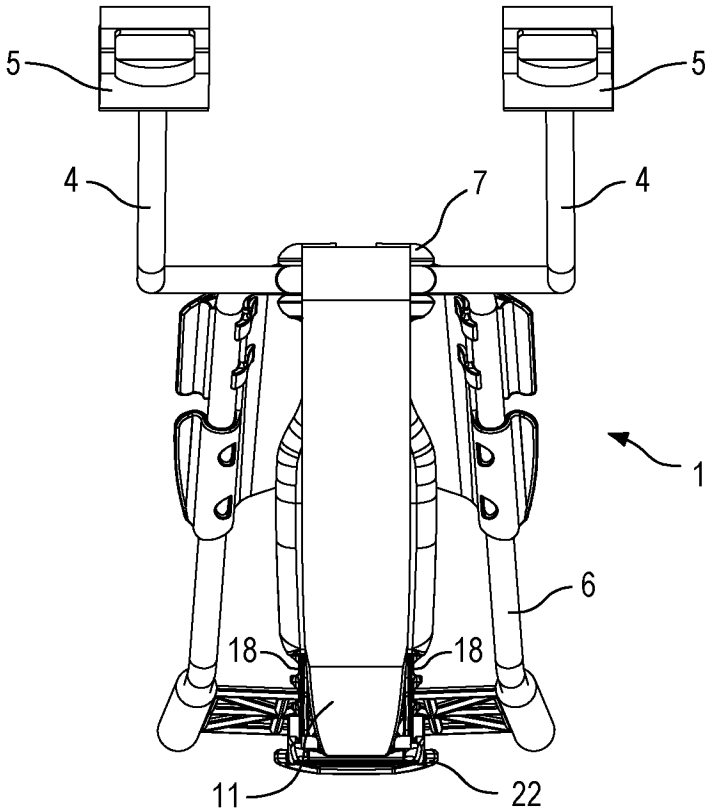
FIG. 8 is a front view of the slingshot of FIG. 2.
Figure 9:
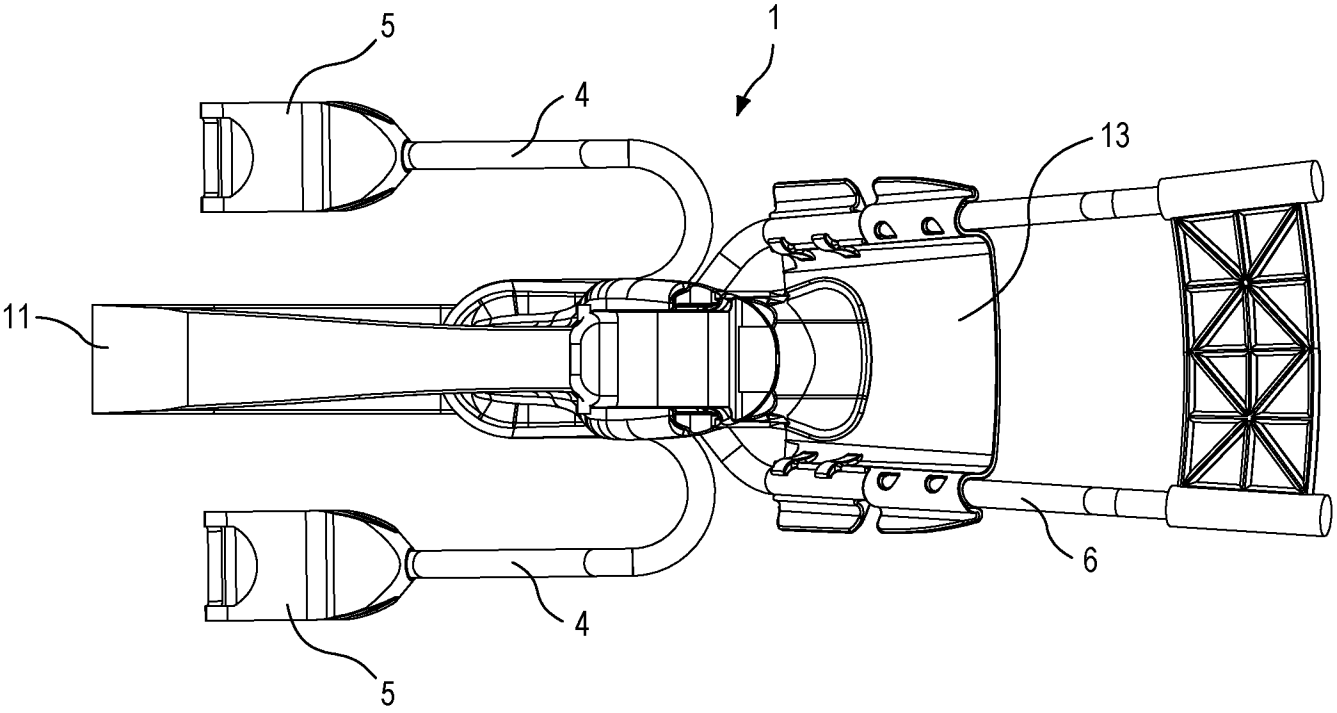
FIG. 9 is a bottom view of the slingshot of FIG. 2.
Figure 10:
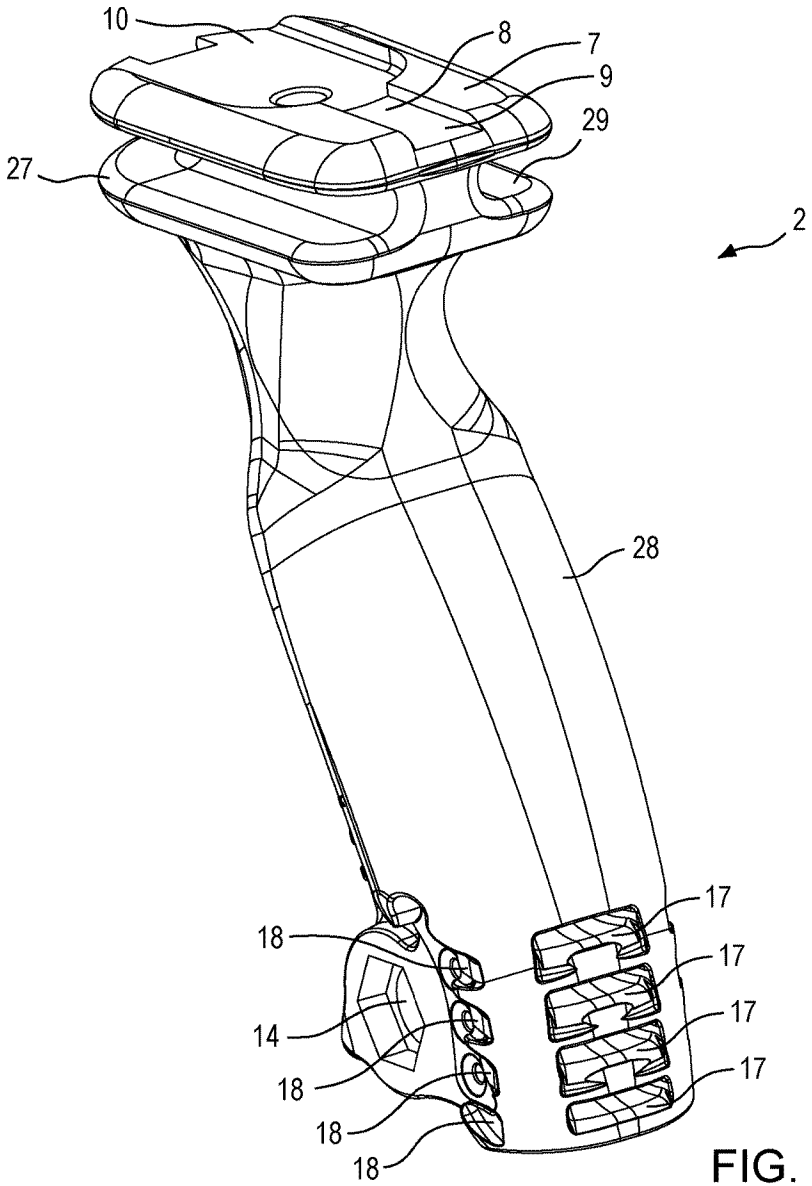
FIG. 10 is an enlarged perspective view of a handle of the slingshot according to one embodiment.
Figure 11:
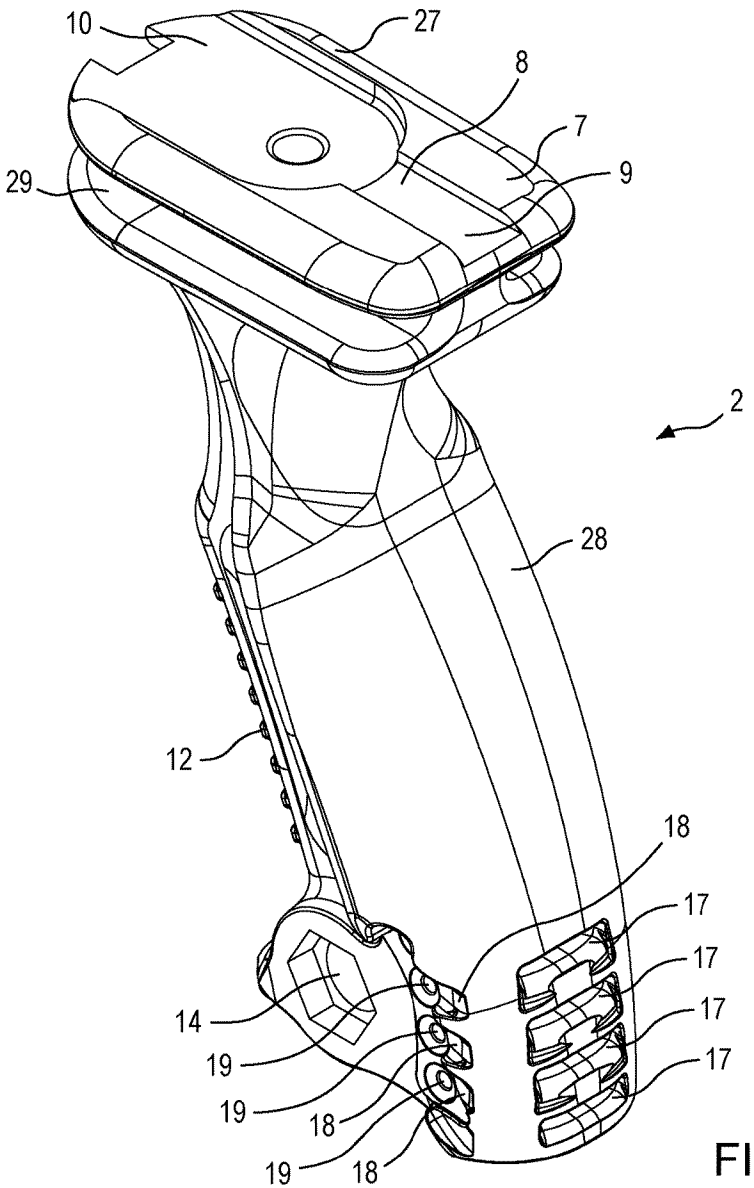
FIG. 11 is a perspective view of the handle of FIG. 10.
Figure 12:
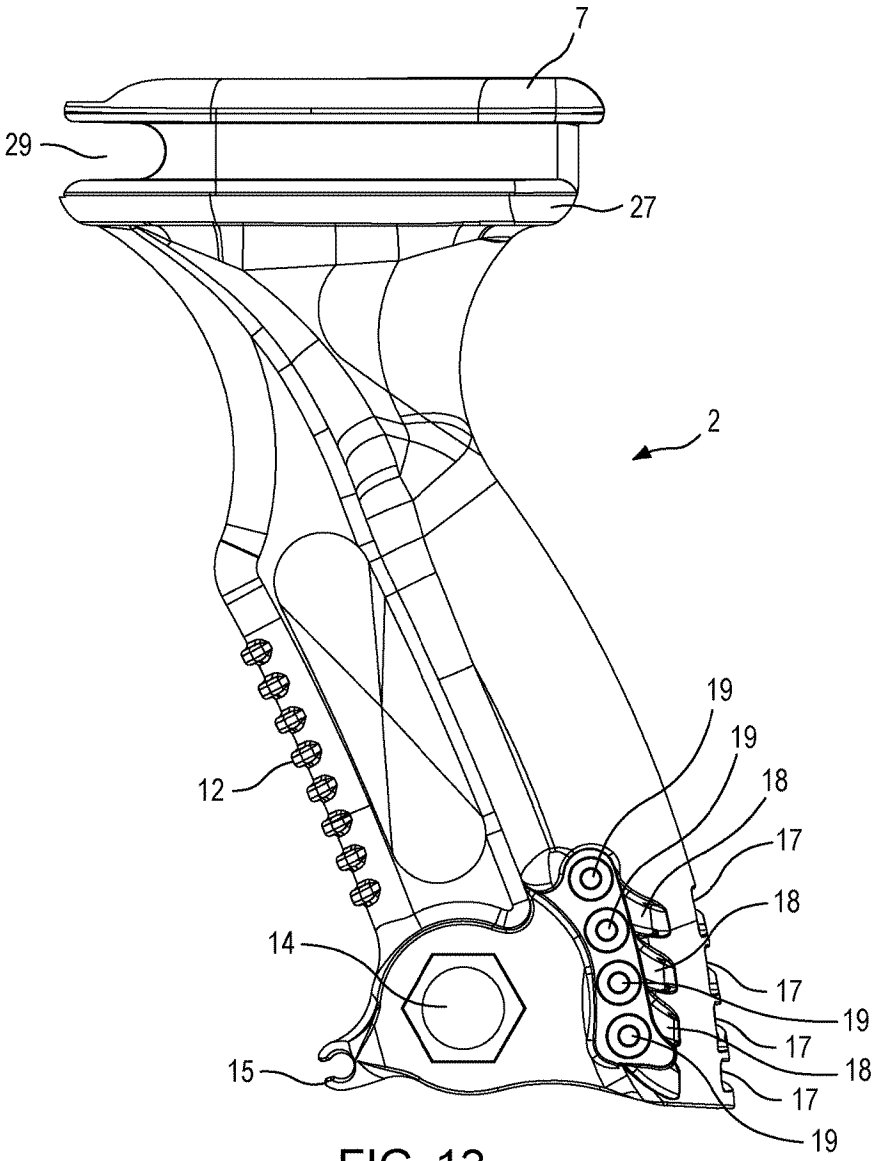
FIG. 12 is a right side view of the handle of FIG. 10.
Figure 13:
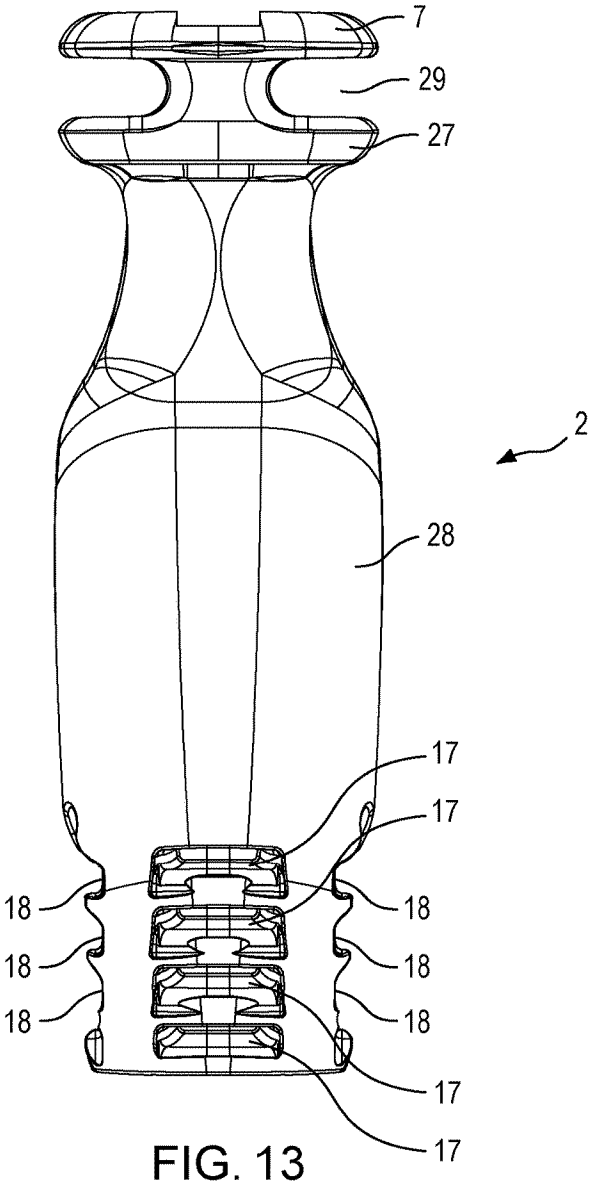
FIG. 13 is a rear view of the handle of FIG. 10.
Figure 14:
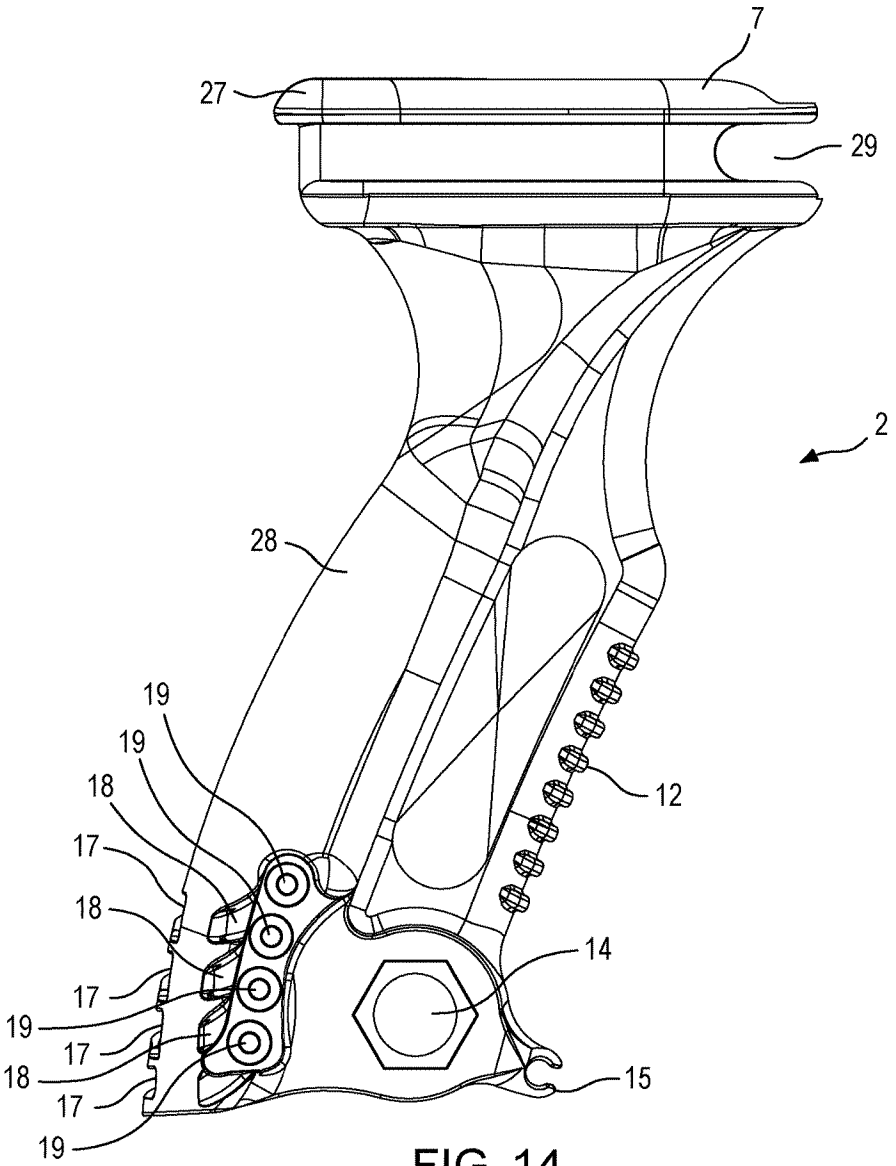
FIG. 14 is a left side view of the handle of FIG. 10.
Figure 15:
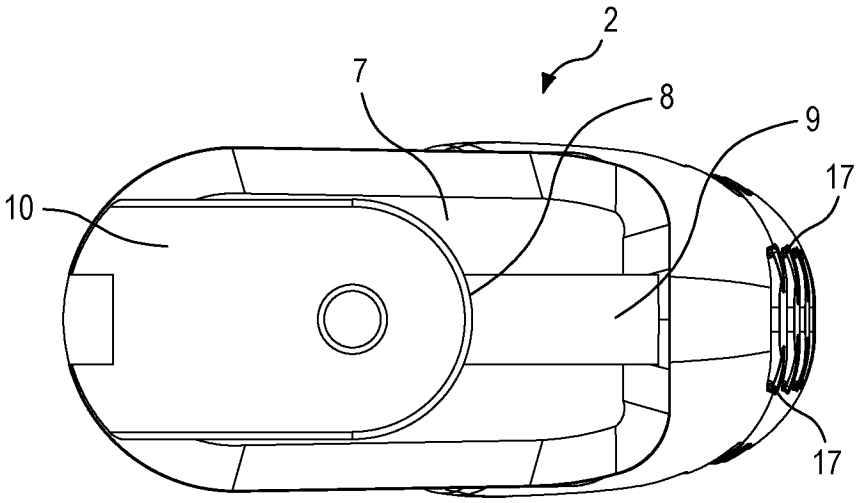
FIG. 15 is a top view of the handle of FIG. 10.
Figure 16:
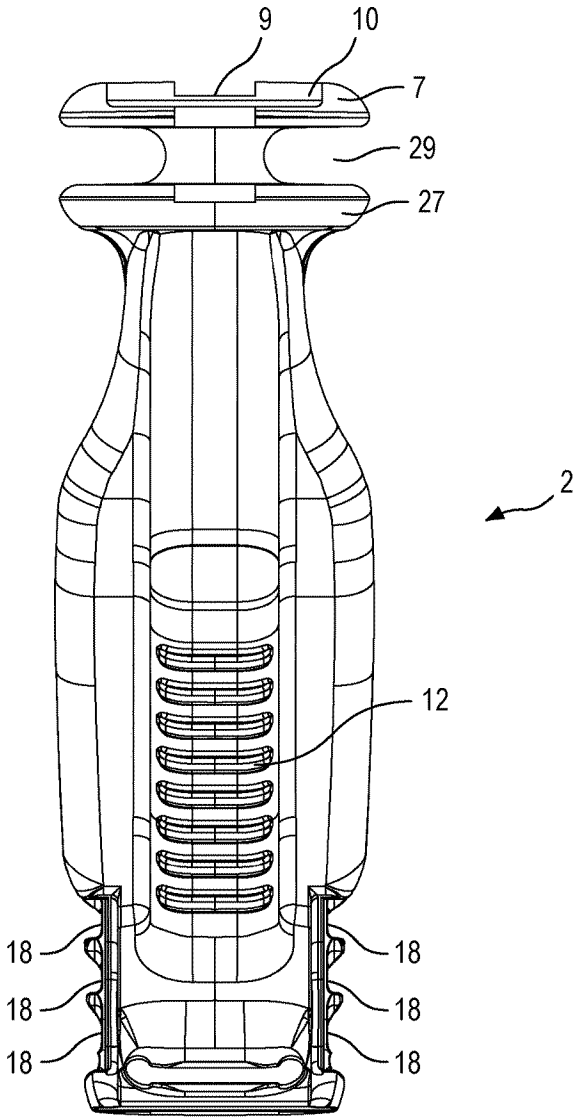
FIG. 16 is a front view of the handle of FIG. 10.
Figure 17:
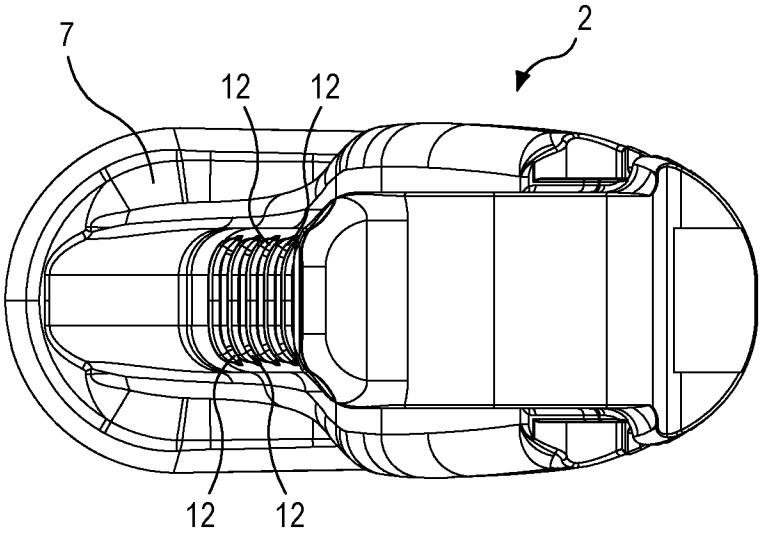
FIG. 17 is a bottom view of the handle of FIG. 10.
Figure 18:
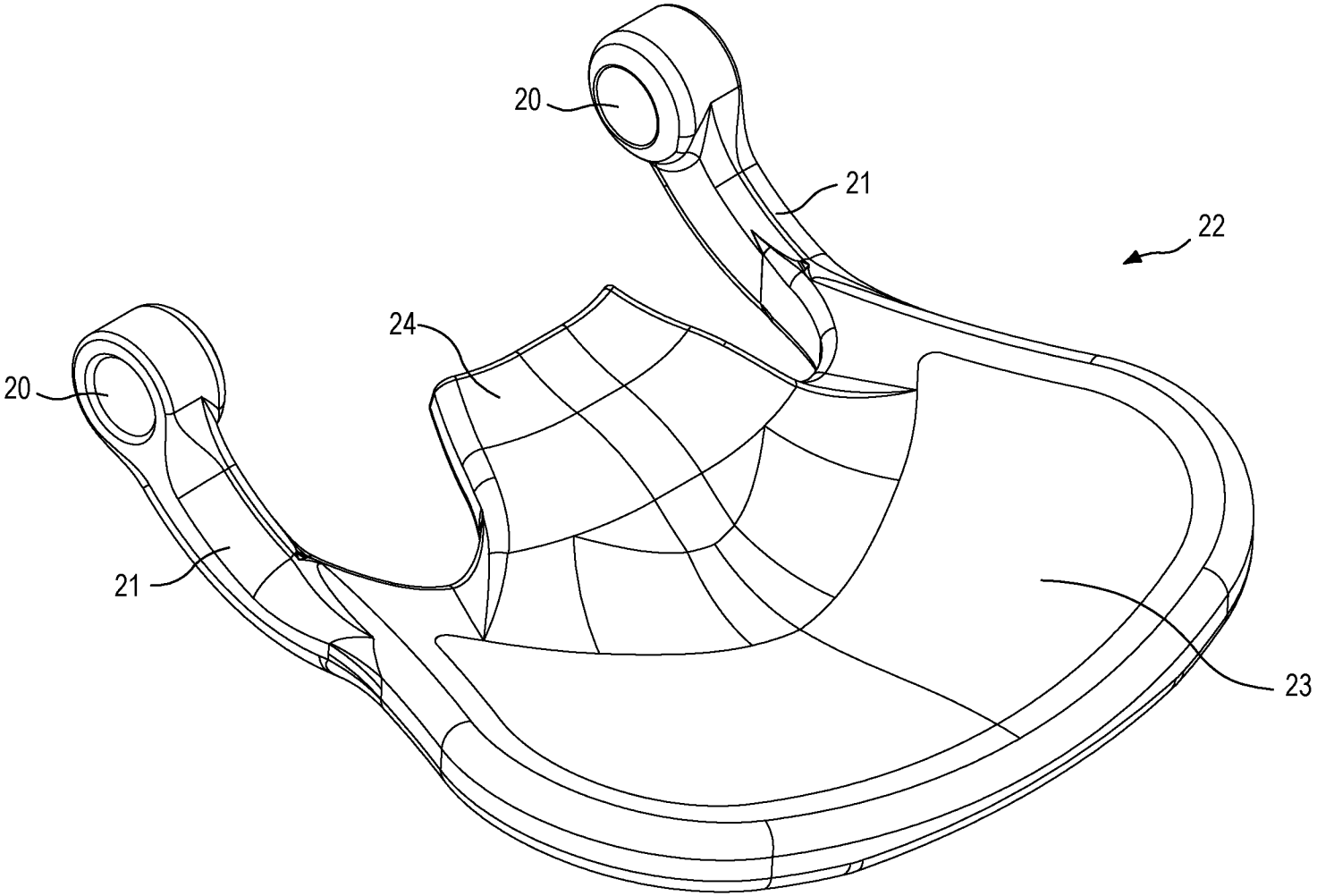
FIG. 18 is an enlarged perspective view of a palm plate of the slingshot according to one embodiment.
Figure 19:
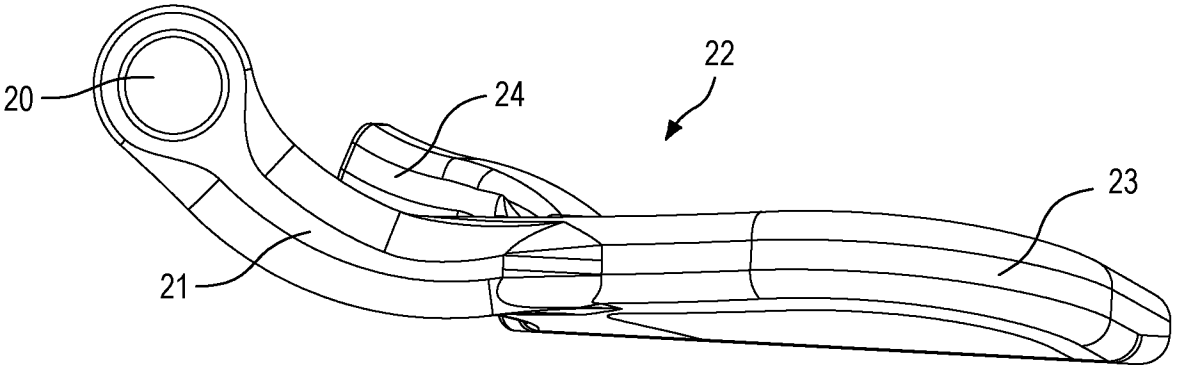
FIG. 19 is a left side view of the palm plate of FIG. 18.
Figure 20:
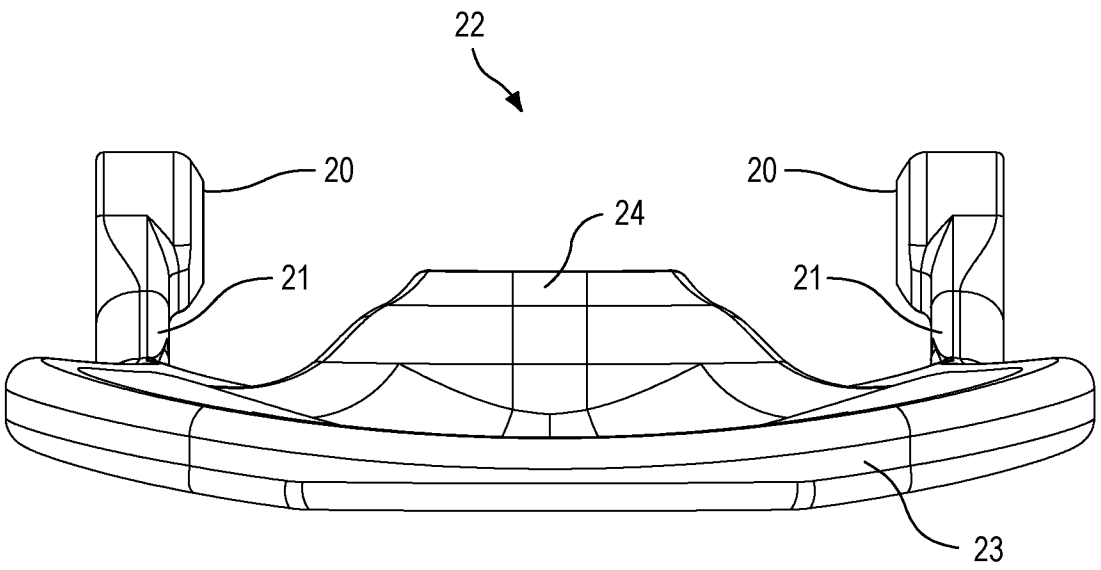
FIG. 20 is a front view of the palm plate of FIG. 18.
Figure 21:
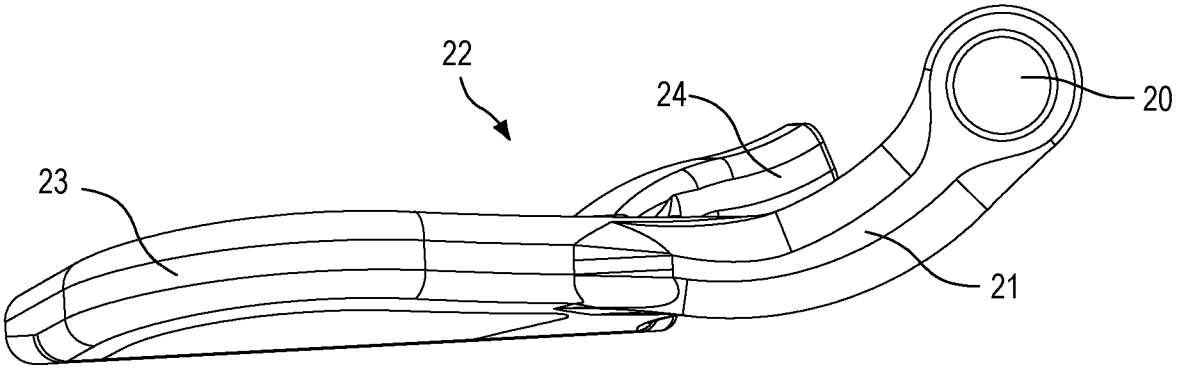
FIG. 21 is a right side view of the palm plate of FIG. 18.
Figure 22:
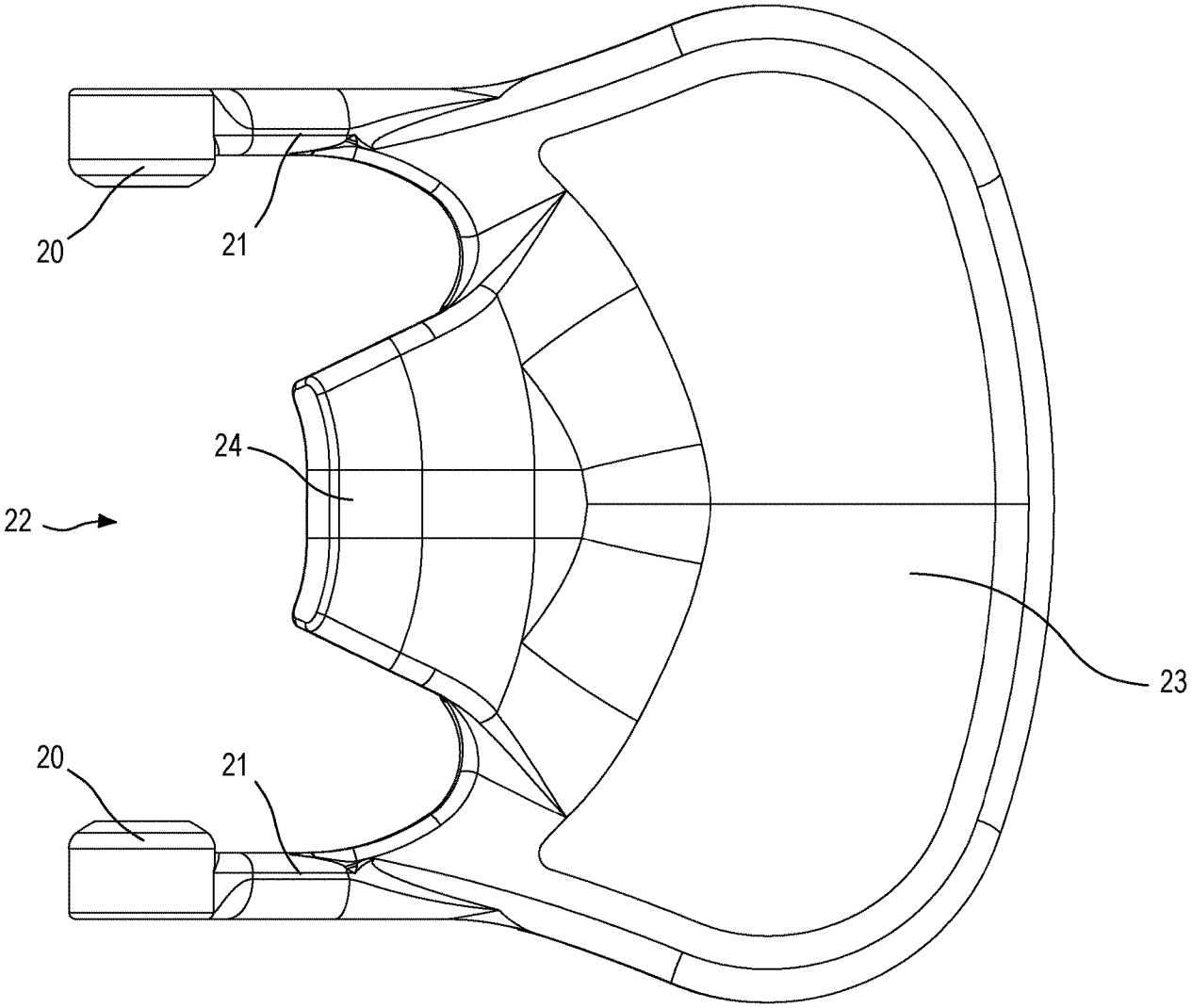
FIG. 22 is a top view of the palm plate of FIG. 18.
Figure 23:
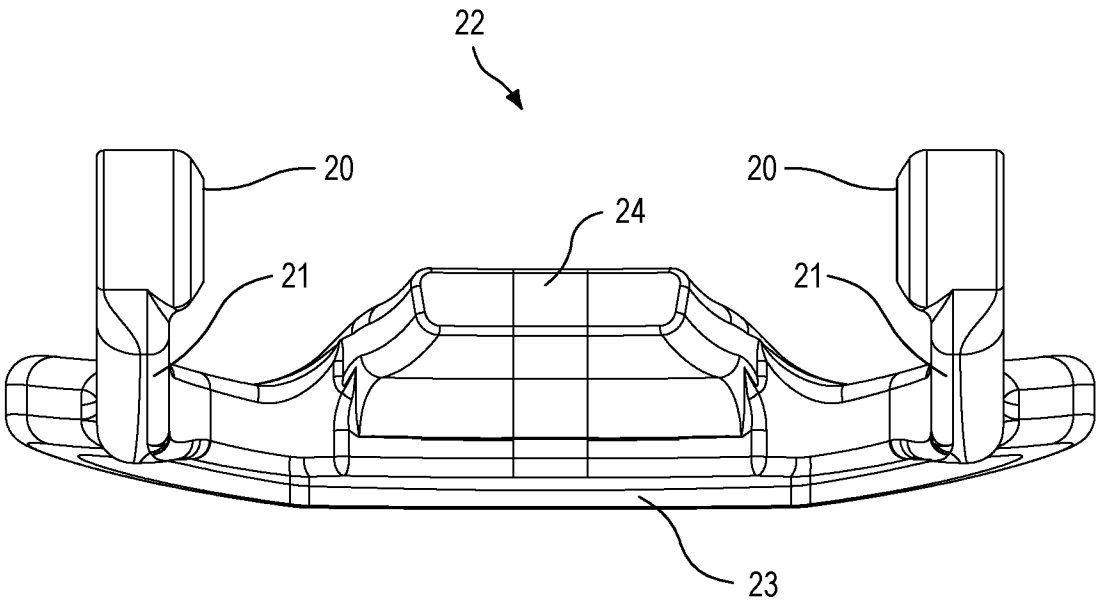
FIG. 23 is a rear view of the palm plate of FIG. 18.
Figure 24:
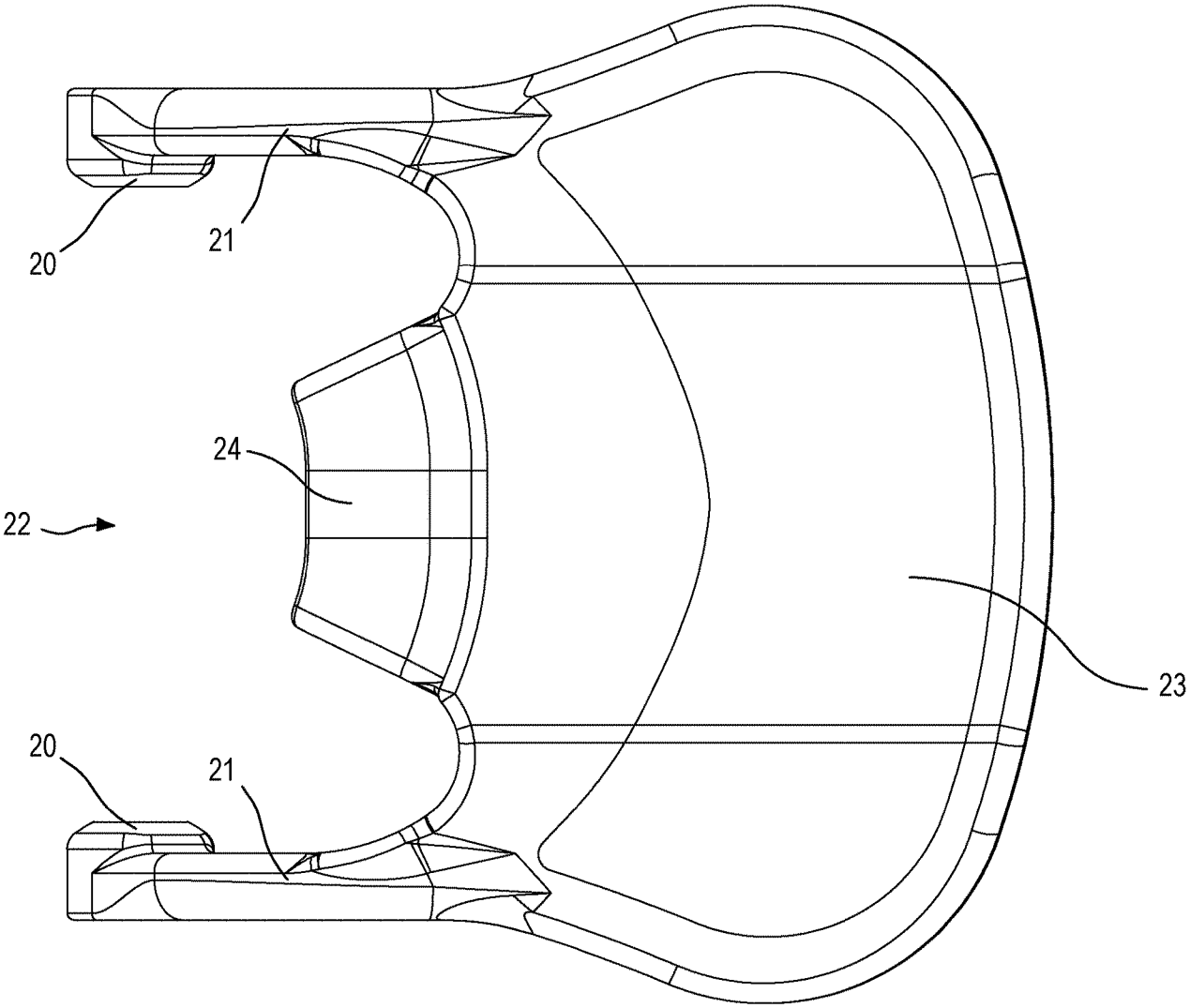
FIG. 24 is a bottom view of the palm plate of FIG. 18.
Figure 25:
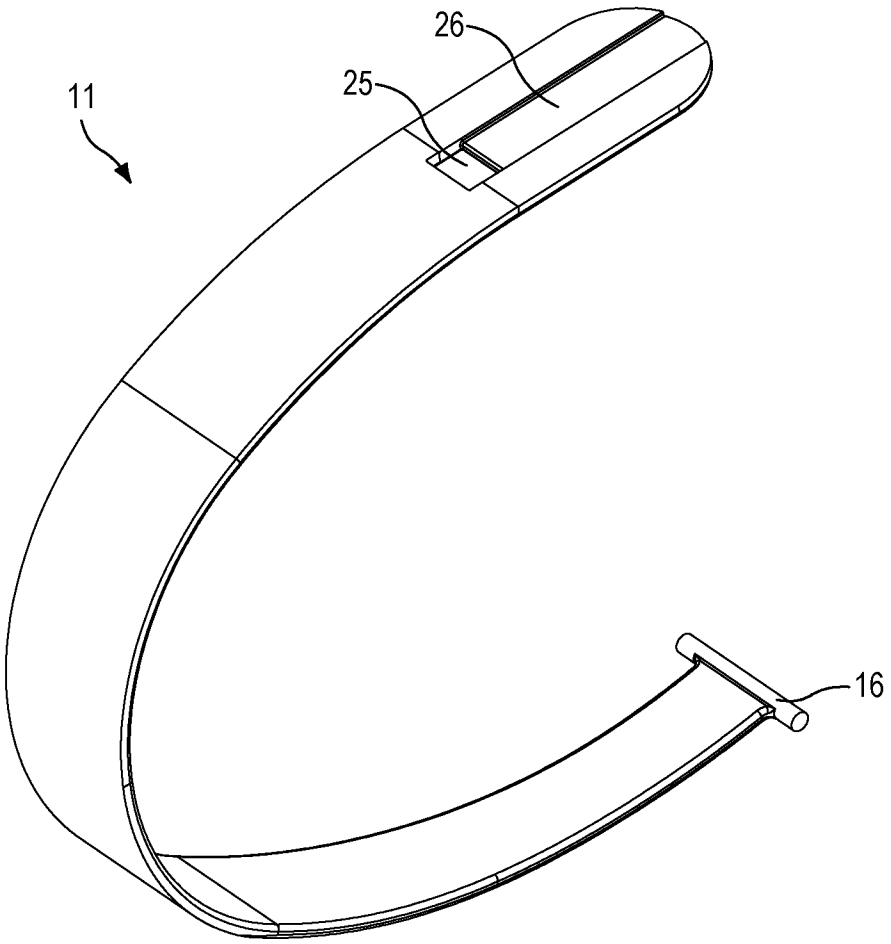
FIG. 25 is an enlarged perspective view of a handle guard according to one embodiment.
Figure 26:
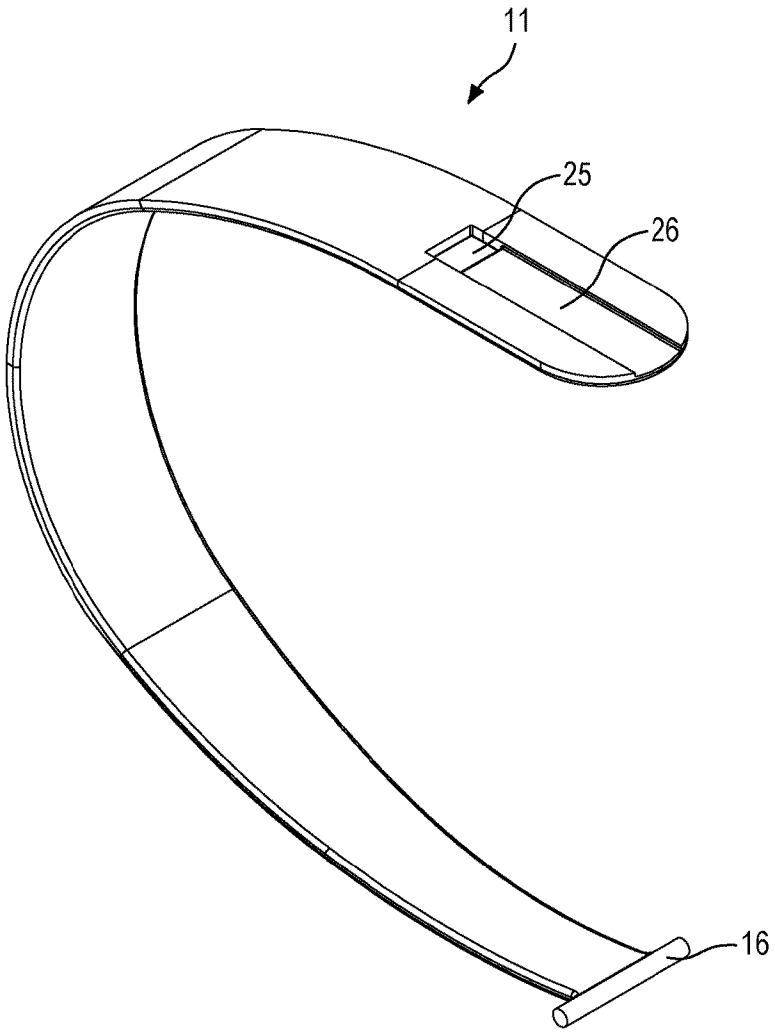
FIG. 26 is a perspective view of the handle guard of FIG. 25.
Figure 27:
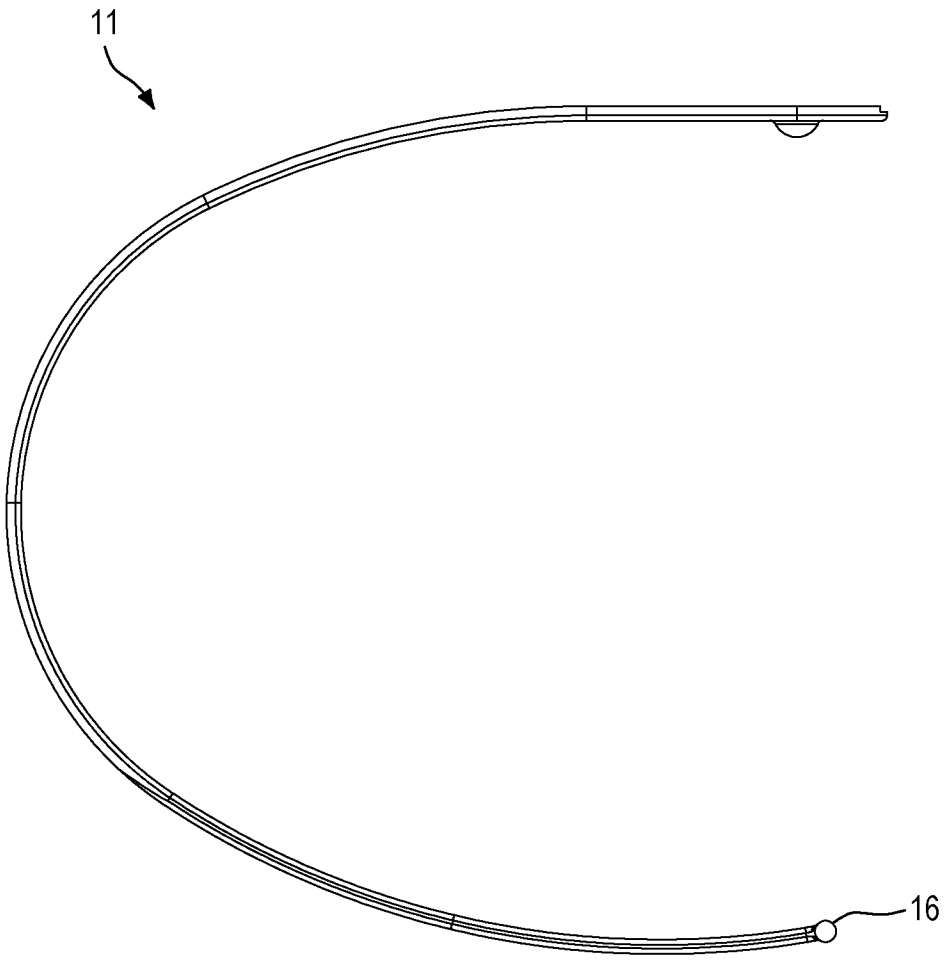
FIG. 27 is a right side view of the handle guard of FIG. 25.
Figure 28:
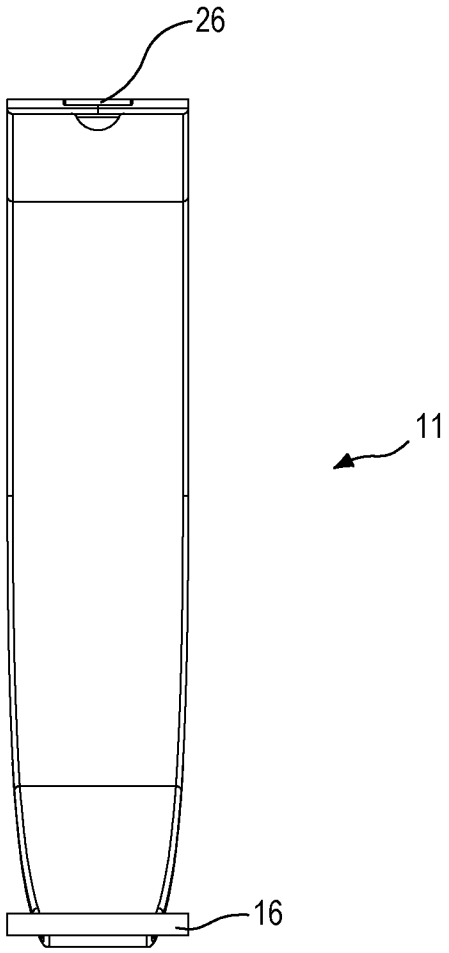
FIG. 28 is a rear view of the handle guard of FIG. 25.
Figure 29:
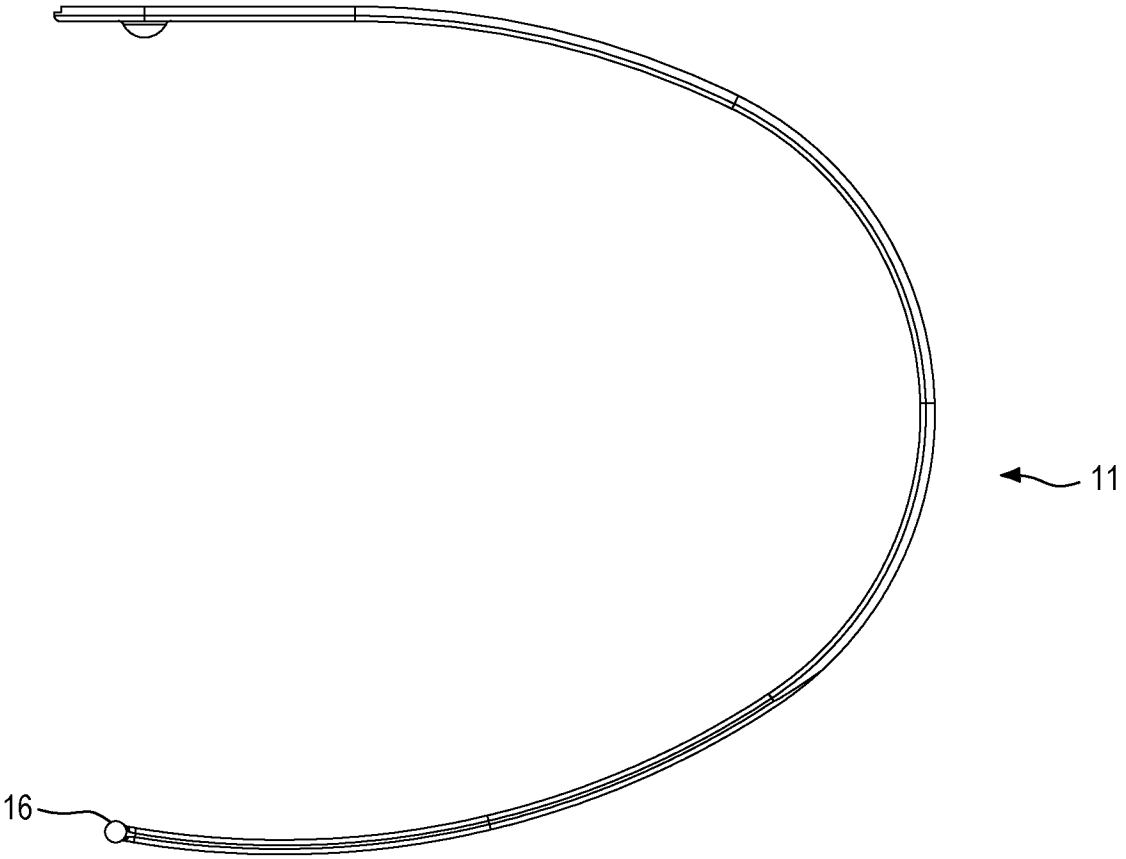
FIG. 29 is a left side view of the handle guard of FIG. 25.
Figure 30:
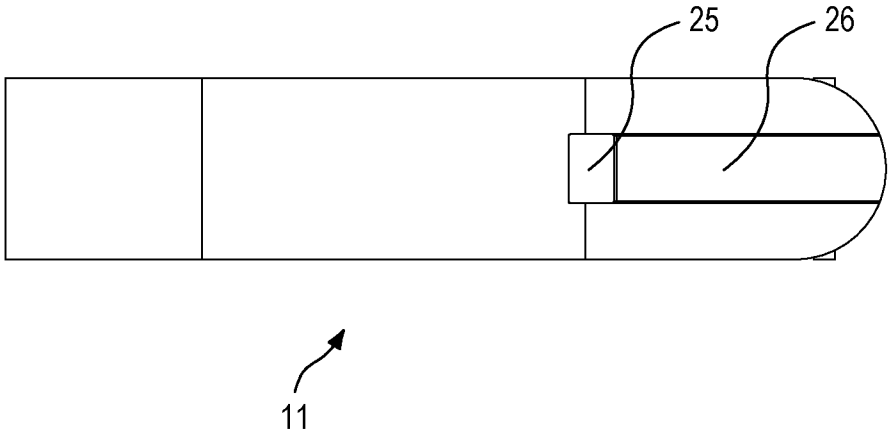
FIG. 30 is a top view of the handle guard of FIG. 25.
Figure 31:
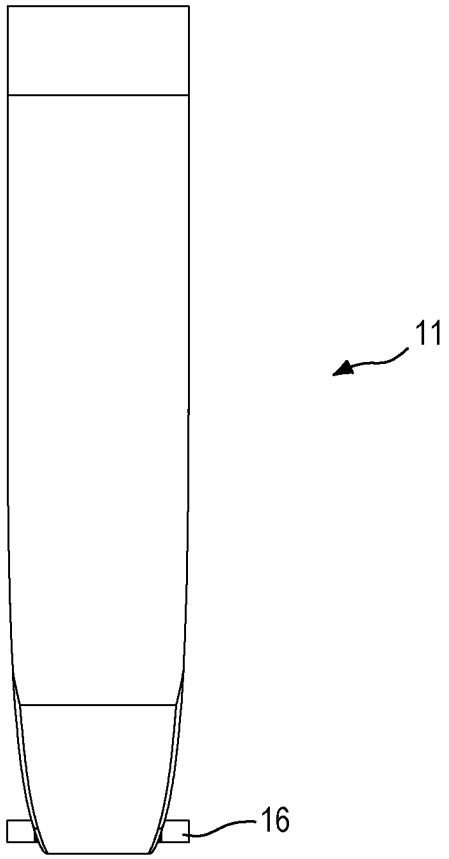
FIG. 31 is a view of the handle guard of FIG. 25.
Figure 32:
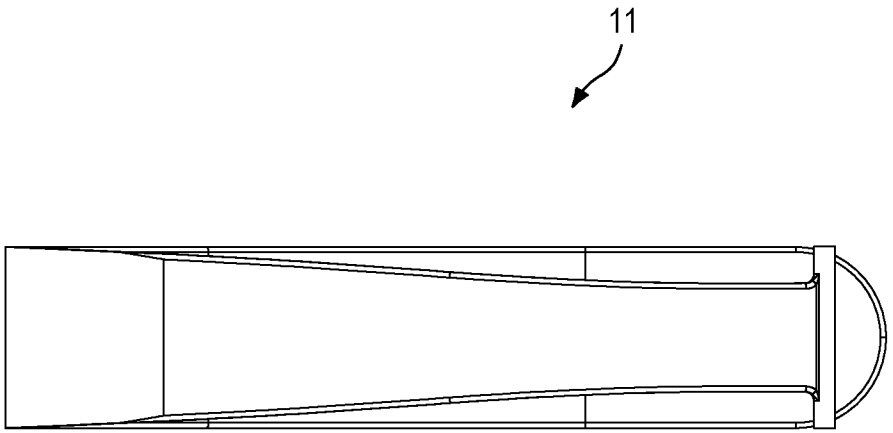
FIG. 32 is a view of the handle guard of FIG. 25.
Figure 33:
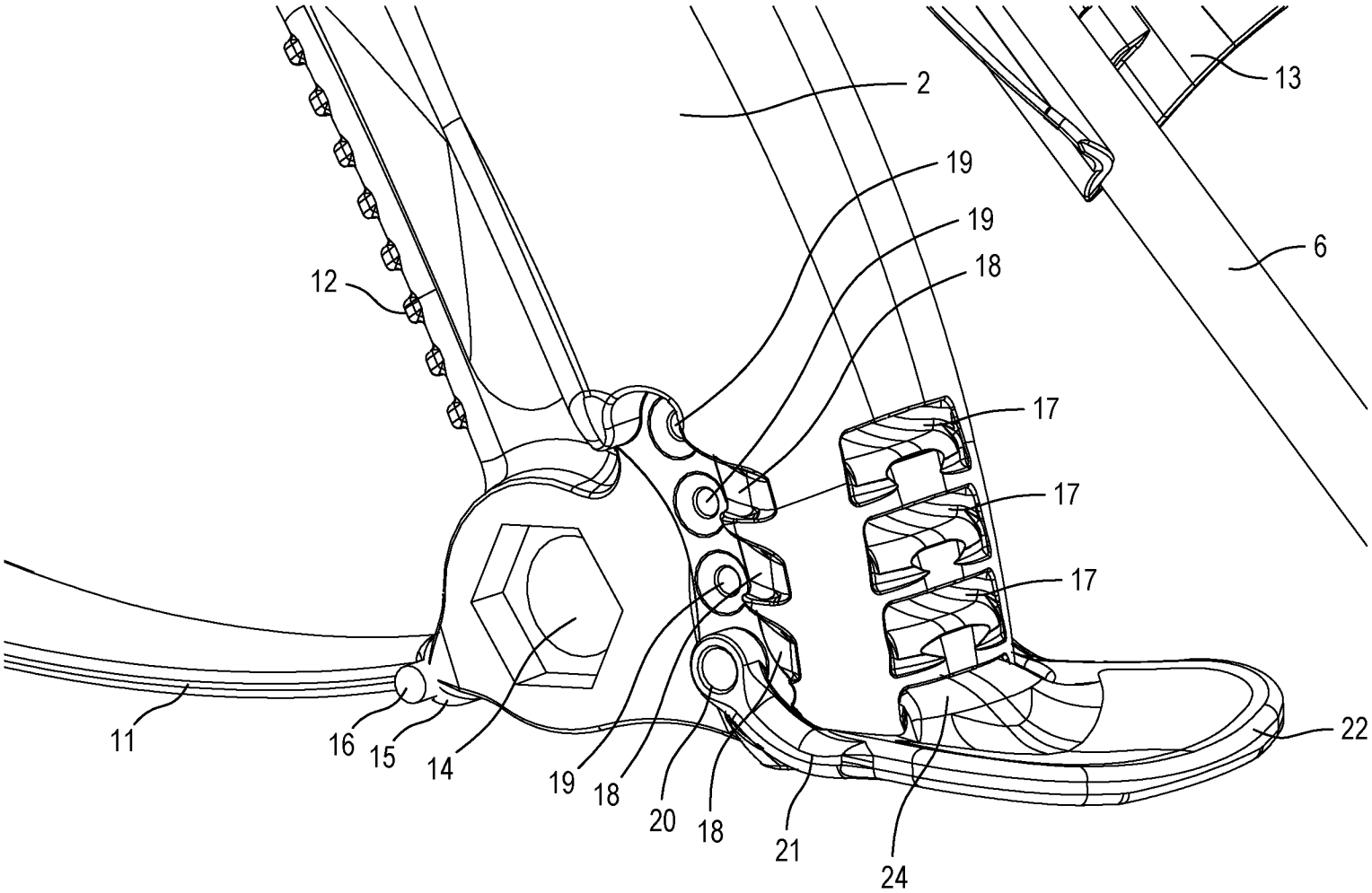
FIG. 33 is an enlarged fragmentary view of the slingshot of FIG. 2.
Figure 34:
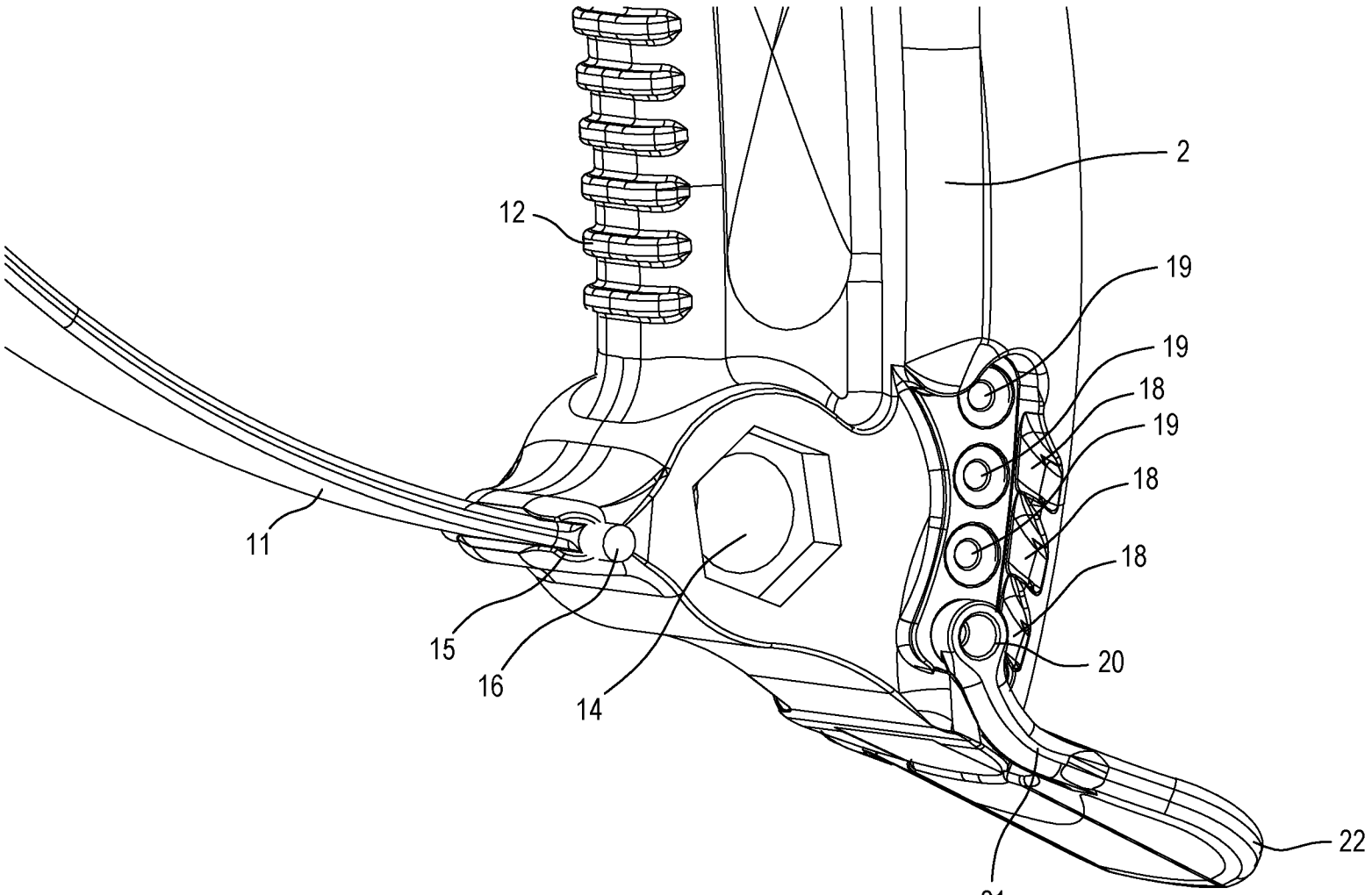
FIG. 34 is an enlarged fragmentary view of the slingshot of FIG. 2.
Figure 35:
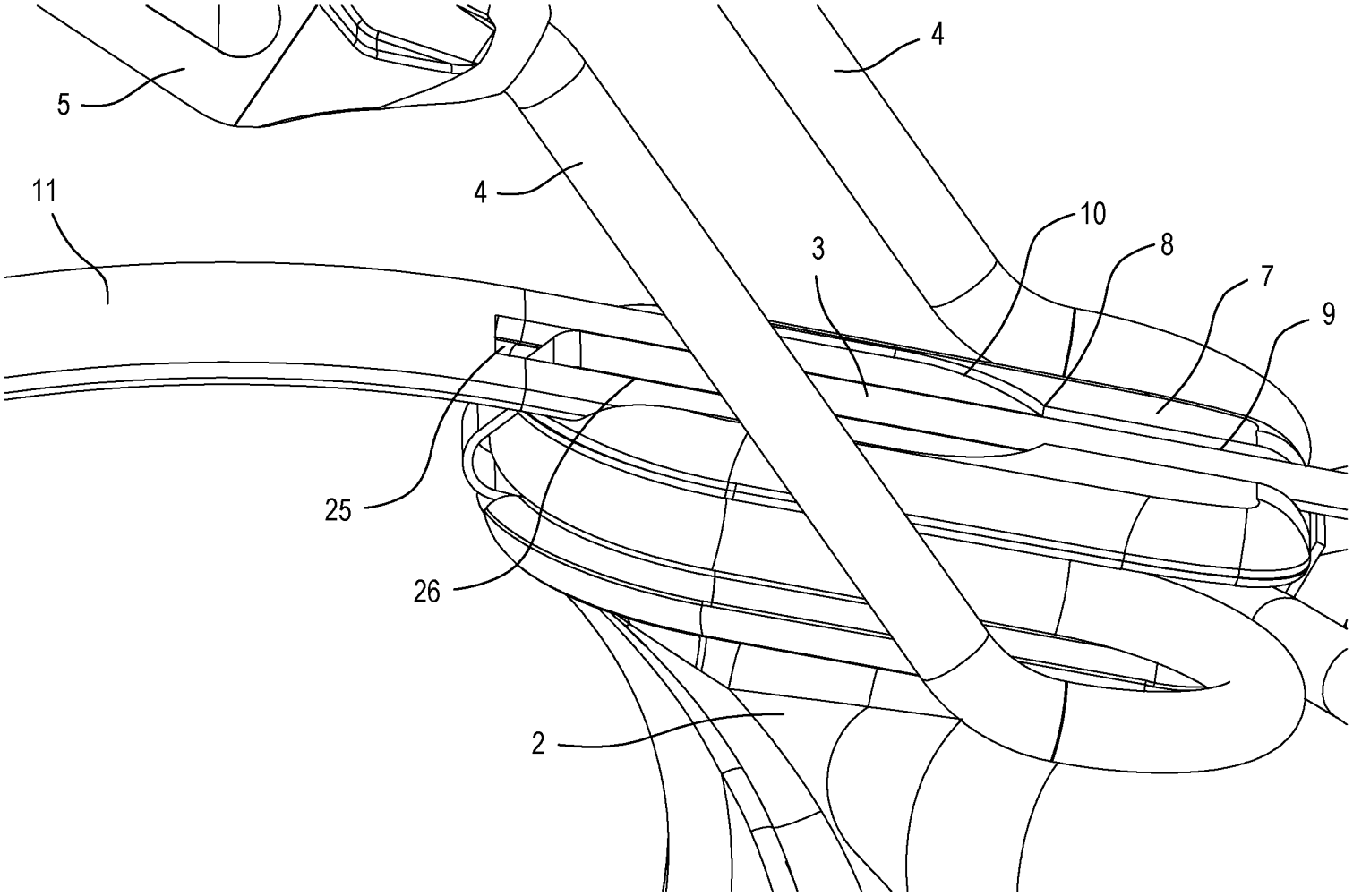
FIG. 35 is an enlarged fragmentary view of the slingshot of FIG. 2.

The forward face of handle 2, at the gripping portion 28, is formed with grips 12 to aid a user's gripping of handle 2. Beneath grips 12 is a bore 14 extending through handle 2 and configured to permit attachment of various accessories to handle 2, such as stabilizers, dampeners, storage containers and the like (not shown). It will be appreciated that such accessories may be permanently or, preferably, removably attached to handle 2 using various attachment methods, such as bolts and nuts (in which case bore 14 may be formed with a hexagonal recess (as shown in FIG. 2) in order to retain a nut), threaded members and other methods and components as are known to those skilled in the art.

A groove 15 is formed at the bottom of the forward face of handle 2. Groove 15 is dimensioned to slidably receive a tongue 16 formed at one end of handle guard 11 in order to secure handle guard 11 to the bottom the forward face of handle 2.

In the bottom portion of the rearward face of the gripping portion 28 of handle 2, a plurality of positioning elements are formed extending from the bottom of the rearward face of handle 2 and spaced apart upwardly for a distance along the rearward face of handle 2. The positioning elements may be, for example, a plurality of grooves 17. In addition, the positioning elements may include a plurality of recesses 18 formed on the left and right sides of handle 2 to accompany grooves 17. For example, each groove 17 may be associated with a pair of recesses 18, with respective recesses 18 of the pair positioned at opposite sides of the groove 17. Each recess 18 comprises a post 19 configured to matingly engage a collar 20 formed on opposing arms 21 of a palm plate 22, as further discussed below. In this matter, palm plate 22 may be positioned at multiple positions along the length of handle 2 to accommodate hands of various sizes, as further discussed below.

In the disclosed embodiment of the present invention, handle 2 of slingshot 1 is formed as a single piece of rigid molded plastic. However, those skilled in the art will recognize that other suitable materials, preferably rigid, lightweight, and strong, may be used to form handle 2 of slingshot 1 without departing from the scope of the present disclosure. Similarly, those skilled in the art will recognize that handle 2 need not be molded as a single piece and may instead comprise individual pieces affixed to one another.

Palm plate 22 is a small, plate-like member comprising a body 23, a pair of arms 21 extending rearwardly and upwardly from body 23, and a lip 24 extending rearwardly from body 23 and disposed between arms 21. Arms 21 are formed with collars 20 at the distal ends thereof. Collars 20 are dimensioned to straddle at least a portion of the handle and matingly engage posts 19 of recesses 18 of handle 2, while lip 24 is dimensioned to matingly engage grooves 17 of handle 2.

In this manner, palm plate 22 is detachable from handle 2 and moveable between fixed positions along the length of handle 2. For example, for a user with a relatively small hand, palm plate 22 may be moved to the uppermost groove 17 of handle 2 and the corresponding uppermost recesses 18 of handle 2. Lip 24 of palm plate 22 is inserted into uppermost groove 17 of handle 2 while collars 20 of arms 21 of palm plate 22 are engaged with posts 19 of the corresponding uppermost recesses 18 of handle 2. For a user with a relatively large hand, palm plate 22 may be moved to the lowermost groove 17, recesses 18 and posts 19 in the same manner. It will be appreciated that arms 21 of palm plate 22 have a slight degree of flexibility in order to allow palm plate 22 to be attached and detached as described above.

Palm plate 22 provides support for a user's hand when holding slingshot 1 during shooting and provides additional stability. Palm plate 22 also may advantageously create a slight counter-torque during draw of the band, complementing arm brace 6. Other benefits of palm plate 22 will be evident to those skilled in the art.

In the disclosed embodiment of the present invention, palm plate 22 of slingshot 1 is formed as a single piece of generally rigid molded plastic (although arms 21 may have slight degree of flexibility as noted above). However, those skilled in the art will recognize that other suitable materials, preferably rigid, lightweight, and strong, may be used to form palm plate 22 without departing from the scope of the present disclosure. Similarly, those skilled in the art will recognize that palm plate 22 need not be molded as a single piece and may instead comprise individual pieces affixed to one another.

Handle guard 11 is a generally thin, flexible, strap-like member that extends forwardly from handle 2 of slingshot 1 in a generally arcuate manner, from the bottom of the forward face of handle 2 to the top 7 of handle 2. A tongue 16 is formed at one end of handle guard 11, tongue 16 being dimensioned to matingly engage groove 15 formed at the bottom of the forward face of handle 2, as discussed above. In the disclosed embodiment of handle guard 11, tongue 16 slides into groove 15 from either the left or right side of handle 2 in order to secure one end of handle guard 11 to the bottom forward face of handle 2.

At the other end of handle guard 11 are formed an aperture 25 and an elongated recess 26 adjacent to the aperture. Aperture 25 is dimensioned to receive retaining clip 3 therethrough while elongated recess 26 is dimensioned to receive a portion of retaining clip 3. To attach this end of handle guard 11 to handle 2, retaining clip 3 is detached from handle 2. Handle guard 11 is positioned within end 10 of recess 8 of top 7 of handle 2 and retaining clip 3 is passed through aperture 25 and reattached to handle 2 while positioned within elongated recess 26 of handle guard 11 and elongated recess 8 of top 7 of handle 2.

When handle guard 11 is attached to top 7 of handle 2 and bottom forward face of handle 2, handle guard 11 extends forwardly from handle 2 in a curved or bowed manner. In this position, handle guard 11 prevents the band from contacting the handle (and the user's hand holding the handle) during recoil.

In the disclosed embodiment of the present invention, handle guard 11 is formed as a single piece of flexible plastic. However, those skilled in the art will recognize that other suitable materials, preferably flexible, lightweight, and strong, may be used to form handle guard 11 without departing from the scope of the present disclosure.

FIGS. 36-42 illustrate various views of another embodiment of a handle 202 of a slingshot 1. FIGS. 43-49 illustrate various views of another embodiment of a palm plate 222 used together with the handle 202 of the slingshot 1. It is understood that various features of the embodiment shown in FIGS. 36-49 may be similar or identical to the features described above with reference to FIGS. 1-35, and that further description of these features may be omitted below. In addition, certain features described below that are similar or identical to features described above may be referenced below and shown in FIGS. 36-49 using the same reference numbers as above.

Referring to FIGS. 36-42, the handle 202 includes a plurality of positioning elements in a bottom portion of a rearward face of the handle 202, and in particular, the gripping portion 228. The positioning elements are spaced apart upwardly for a distance along the rearward face of the handle 202. In this embodiment, the positioning elements may include, for example, a plurality of grooves 217. In addition, the positioning elements include a plurality of enlarged channels 218, each enlarged channel 218 formed integrally and continuously with a corresponding groove 217. That is, each groove 217 is associated a respective enlarged channel 218.

Figure 36:
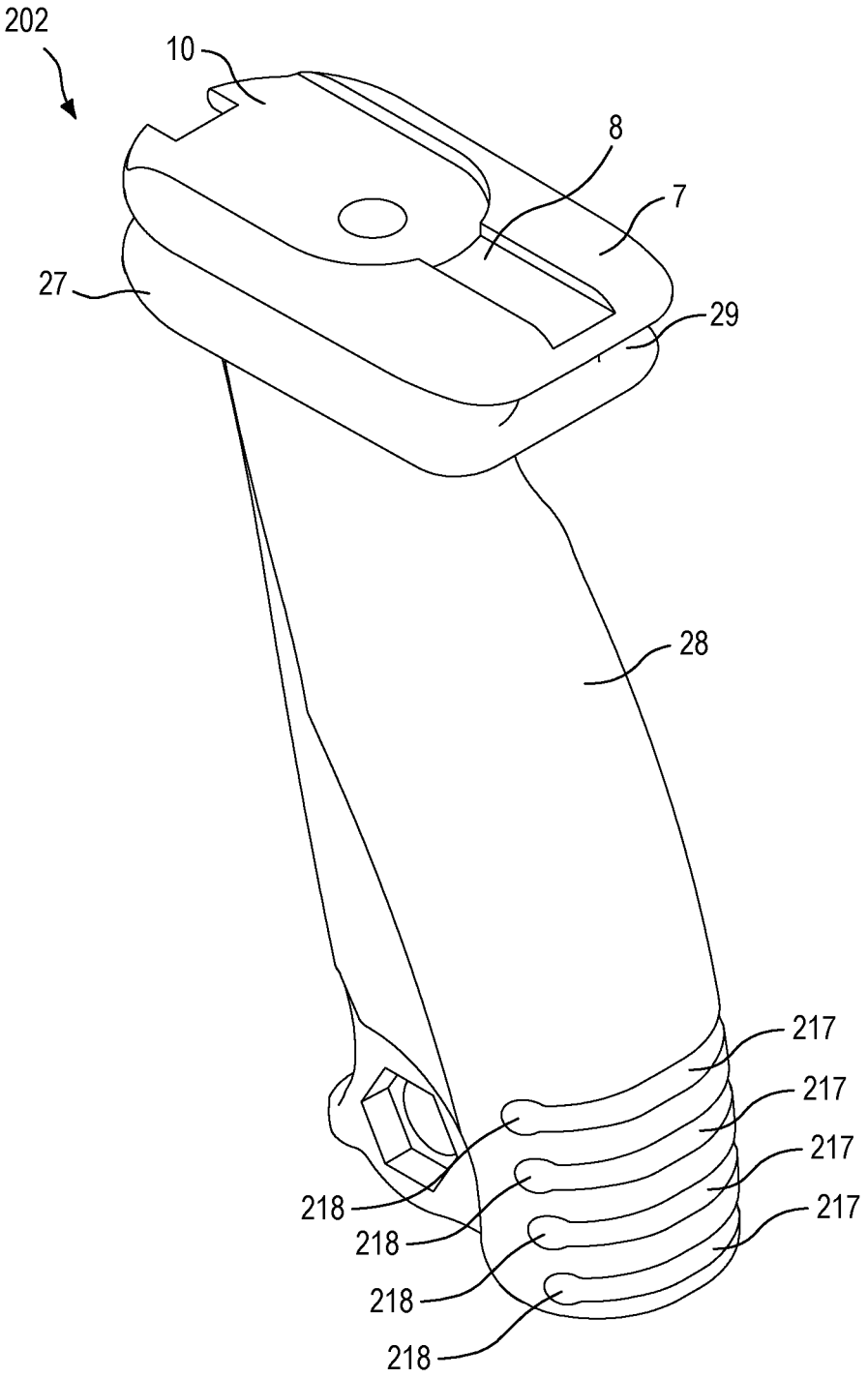
FIG. 36 is an enlarged perspective view of a handle of the slingshot according to another embodiment.
Figure 37:
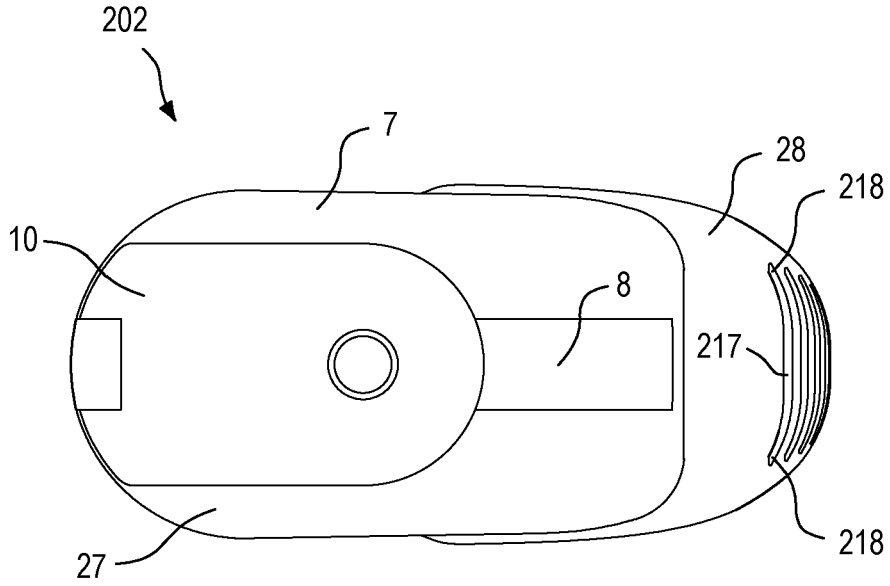
FIG. 37 is a top view of the handle of FIG. 36.

The enlarged channel 218 extends from a left side to right side of the handle 202 across an interior of the handle 202. As shown in FIG. 36, for example, the enlarged channels 218 have an increased thickness relative to the grooves 217, and may be formed in generally circular shape. It is understood, however, that the shape of the enlarged channels 218 is not limited to this configuration, and other suitable shapes are envisioned as well.

Referring to FIGS. 43-49, the palm plate 222 is a plate-like member comprising body 223, intermediate lip 224, and an enlarged tongue 221. The palm plate 222 is configured to be removably received in a positioning element, for example, within the one of the grooves 217 and an associated enlarged channel 218. The palm plate 222 may be received in, and removed from, the groove 217 and associated large channel 218 through a side of the groove 217 and associated large channel 218, for example, substantially at a right or left side of the handle 202.

The enlarged tongue 221 is configured to be received in enlarged channel 218 and the intermediate lip 224 may be received in the groove 217. As noted above, the palm plate 222 may be moved across the groove 217. The engagement between the enlarged tongue 221 and the enlarged channel 218 retains the palm plate 222 in the handle 202. That is, the engagement between the enlarged tongue 221 and the enlarged channel 218 substantially restrains the palm plate 222 from rearward movement relative to the handle 202, and against unintended removal of the palm plate 222 from the handle 202. In the manner described above, palm plate 222 is detachable from handle 202 and moveable between fixed positions along the length of handle 202. For example, as described above, for a user with a relatively small hand, palm plate 222 may be moved to the uppermost groove 217 and corresponding enlarged channel 218 of handle 202. For a user with a relatively large hand, palm plate 222 may be moved to the lowermost groove 217 and corresponding enlarged channel 218.

It will be appreciated by those skilled in the art that the features described herein may be found in various combinations. That is, handle 2, handle guard 11, palm plate 22 and accessory attachment bore 14 may be used together in slingshot 1 or may be used individually and/or in any combination with other slingshot devices without departing from the scope of the present disclosure.

FIGS. 50-74 illustrate a handleless slingshot with folding storage compartment embodying the principles of the present invention.

As shown in FIGS. 50-74, slingshot 301 comprises a body 302 formed as a generally arcuate member having a pair of integrated arms 303 extending therefrom. An upper portion 304 of each arm 303 is formed as a groove 305 configured to receive a clip (not shown) in order to secure a band (not shown) to each arm 303 as is known in the art. A lower portion 306 of each arm 303 is formed as a wing 307 extending outwardly from arm 303.

In the disclosed embodiment, wings 307 are angled downwardly so as to create a gap or channel 308 between the top surface of each wing 307 and the underside of each groove 305. Gap or channel 308 is formed to provide a location where a user may contact slingshot 301 with the upper ends of the user's thumb and index finger when shooting slingshot 301, as further described below. Recesses 309 formed on either side of body 302 between the top surface of each wing 307 and the underside of each groove 305 provide guides, or a gripping portion, to engage and position the user's thumb and index finger when shooting slingshot 301.

Body 302 of slingshot 301 further comprises in the disclosed embodiment a guard area 310 formed and extending between each arm 303. Guard area 310 protects the web area of user's hand (the area between the user's index finger and thumb) when slingshot 301 is held by the user during shooting (guard area 310 is cradled within the web area of the user's hand) and provides counter-torque when the band is drawn in preparation for shooting.

A base of body 302 of slingshot 301 is formed with a body hinge mechanism 311 configured to receive a mating storage compartment hinge mechanism 312, storage compartment lid hinge mechanism 313, and pin 314, as further discussed below.

In the disclosed embodiment of the present invention, body 302 of slingshot 301 is formed as a single piece of rigid molded plastic. However, those skilled in the art will recognize that other suitable materials, preferably rigid, lightweight, and strong, may be used to form body 302 of slingshot 301 without departing from the scope of the present disclosure. Similarly, those skilled in the art will recognize that body 302 need not be molded as a single piece and may instead comprise individual pieces affixed to one another.

Slingshot 301 includes storage compartment 318, as noted above, and further includes a storage compartment lid 319. Storage compartment 318 is a generally elongated bowl-like member having a window 320 formed therein and a mounting base 321 at an end proximate to the body 302. Window 320 allows the user to see the contents of storage compartment 318 (such as the amount of lead shot or other projectile stored therein) without opening storage compartment lid 319. Mounting base 321 is formed at the upper end of storage compartment 318 and includes storage compartment hinge mechanism 312 formed integral therewith.

Also formed integral with mounting base 321 at the end opposite storage compartment hinge mechanism 312 is a latching mechanism. In one embodiment, the latching mechanism may be a clip 316. The clip 316 is configured to engage a cooperating latching mechanism 315 of body 302 of slingshot 301 in order to lock storage compartment 318 in an open position. In one embodiment, the cooperating latching mechanism may be a groove 315 formed in the body 302 of the slingshot. The latching mechanism and cooperating latching mechanism, for example, the clip 316 and the groove 315, are releasably engageable to secure the storage compartment 318 in the unfolded, open position, such that the storage compartment 318 extends substantially perpendicular to the body 302. The clip 316 may engage the groove 315, for example, by friction fit or interlocking fit. The clip 316 may be released from the groove 315 to move the storage compartment 318 to the folded position.

Storage compartment lid 319 is a generally flat, elongated member configured to engage and cover an open side of storage compartment 318. Storage compartment lid hinge mechanism 313 is formed at the upper end of storage compartment lid 319 and integral therewith. Storage compartment lid 319 and storage compartment 318 each may include a locking mechanism 322 formed thereon to provide a friction-fit engagement between storage compartment lid 319 and storage compartment 318 in order to keep storage compartment 318 closed. Locking mechanism 322 may also comprise a clip and groove, tab and slot, magnetic connectors, or any other locking mechanism as may be known to those skilled in the art. The locking mechanism 322 formed on one of the storage compartment 318 and storage compartment lid 319 corresponds to, i.e., matingly and releasably engages, the locking mechanism 322 formed on the other of the storage compartment 318 and storage compartment lid 319.

Storage compartment 318 and storage compartment lid 319 are pivotally (or hingedly) mounted to body 302 of slingshot 301 through body hinge mechanism 311, storage compartment hinge mechanism 312, storage compartment lid hinge mechanism 313, and pin 314. That is, in the disclosed embodiment, body hinge mechanism 311, storage compartment hinge mechanism 312, storage compartment lid hinge mechanism 313 are aligned coaxially and pin 314 is disposed therein. For example, each of the body hinge mechanism 311, storage compartment hinge mechanism 312, and storage compartment lid hinge mechanism 313 may include one or more openings aligned along a common axis, and the pin 314 may be inserted through the respective one or more openings of the body hinge mechanism 311, storage compartment hinge mechanism 312, and storage compartment lid hinge mechanism 313 to extend along the common axis. In this manner, storage compartment 318 and storage compartment lid 319 are able to pivotally rotate relative to each other to open storage compartment 318 in order to load supplies. In addition the storage compartment 318 and storage compartment lid 319 are able to pivot relative to body 302 of slingshot 301.

In the disclosed embodiment of the present invention, storage compartment 318 and storage compartment lid 319 each are formed as a single piece of rigid molded plastic. However, those skilled in the art will recognize that other suitable materials, preferably rigid, lightweight, and strong, may be used to form storage compartment 318 and storage compartment lid 319 without departing from the scope of the present disclosure. Similarly, those skilled in the art will recognize that storage compartment 318 and storage compartment lid 319 need not be molded as single pieces and may instead comprise individual pieces affixed to one another.

Figure 56:
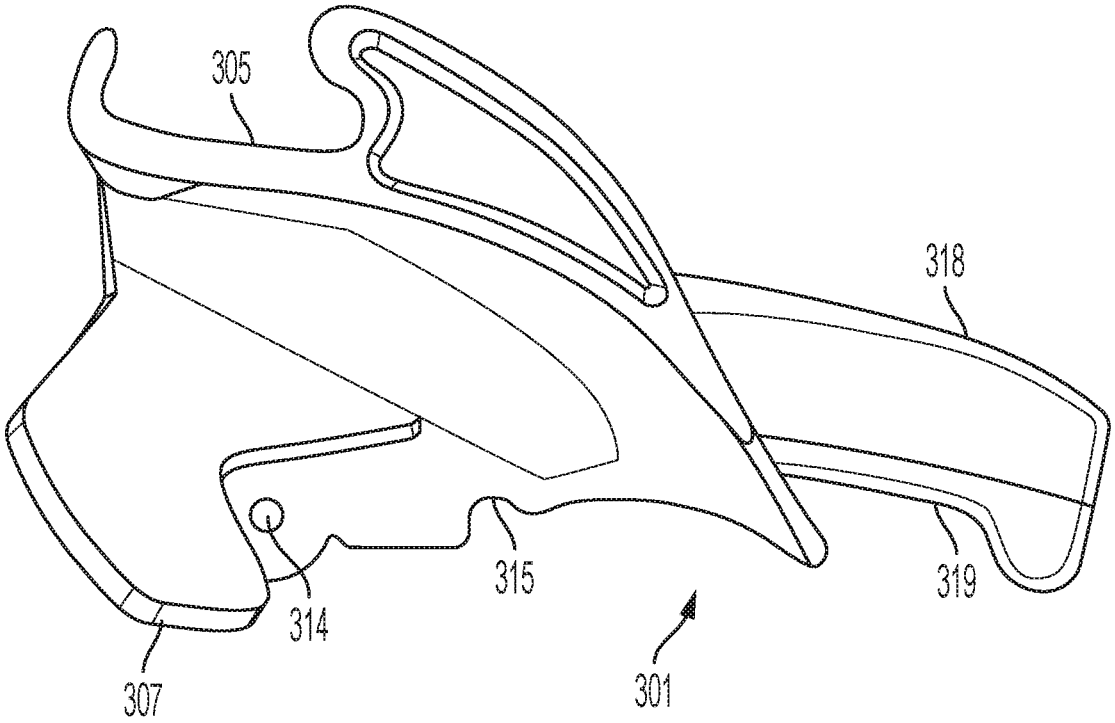
FIGS. 56 and 65 are right side views of the handleless slingshot of FIGS. 50 and 64, showing the folding storage compartment in a fully folded position.
Figure 57:
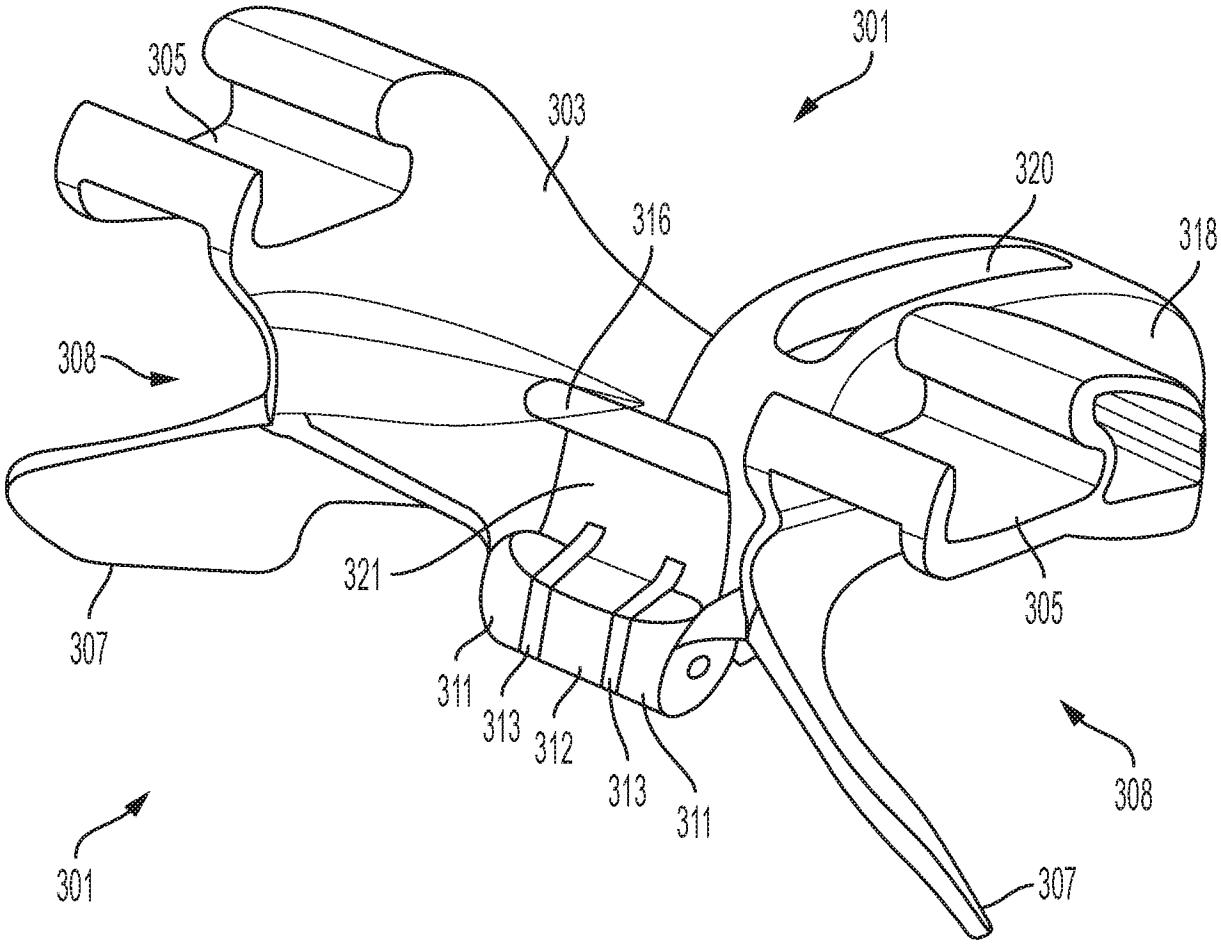
FIGS. 57 and 66 are front perspective views of the handleless slingshot of FIGS. 56 and 65.
Figure 58:
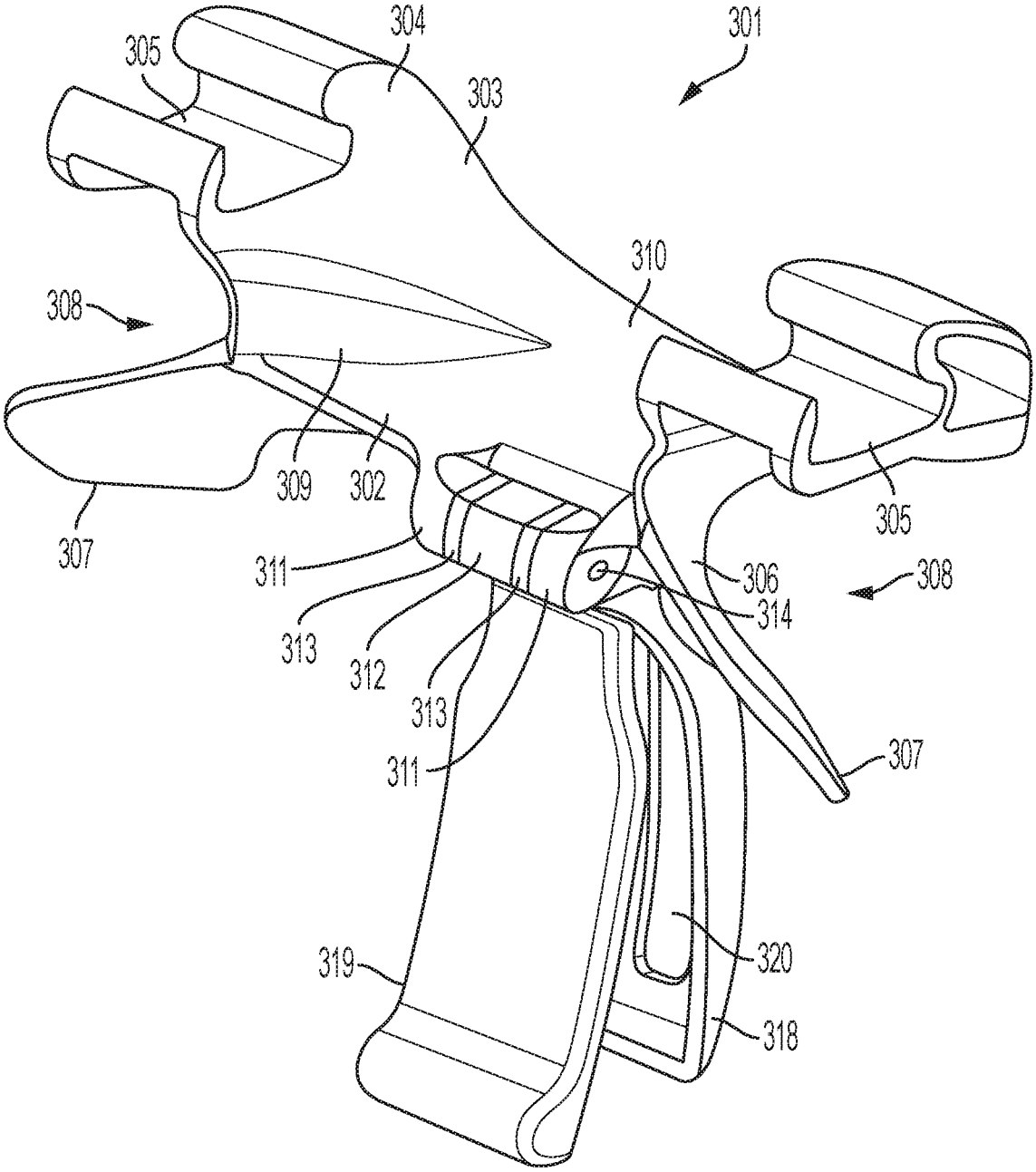
FIG. 58 is a front perspective view of the handleless slingshot of FIGS. 50 and 64, with the folding storage compartment open.
Figure 59:
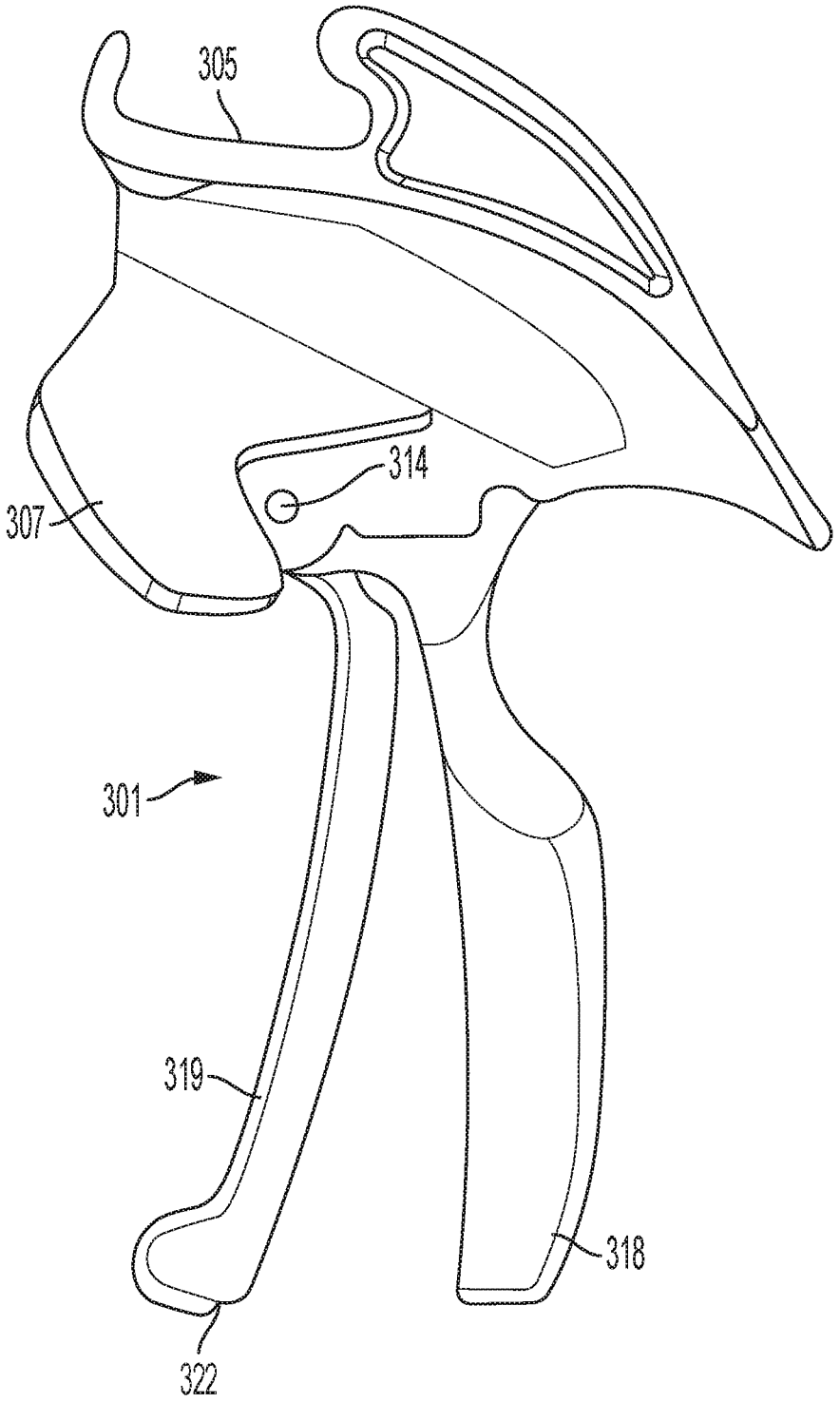
FIG. 59 is a right side view of the handleless slingshot of FIG. 58.
Figure 60:
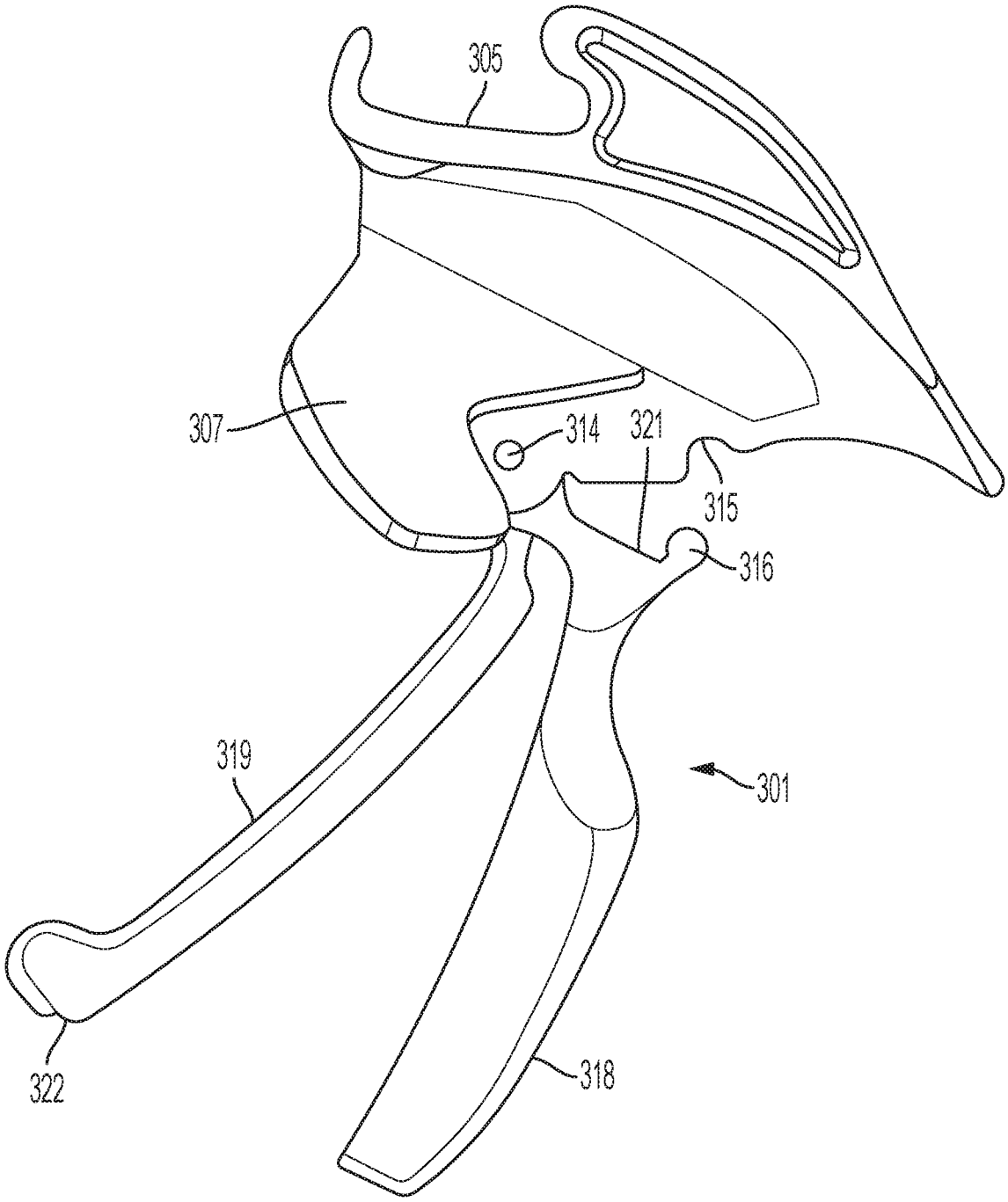
FIG. 60 is a right side view of the handleless slingshot of FIG. 58, showing the folding storage compartment in a partially folded position.
Figure 61:
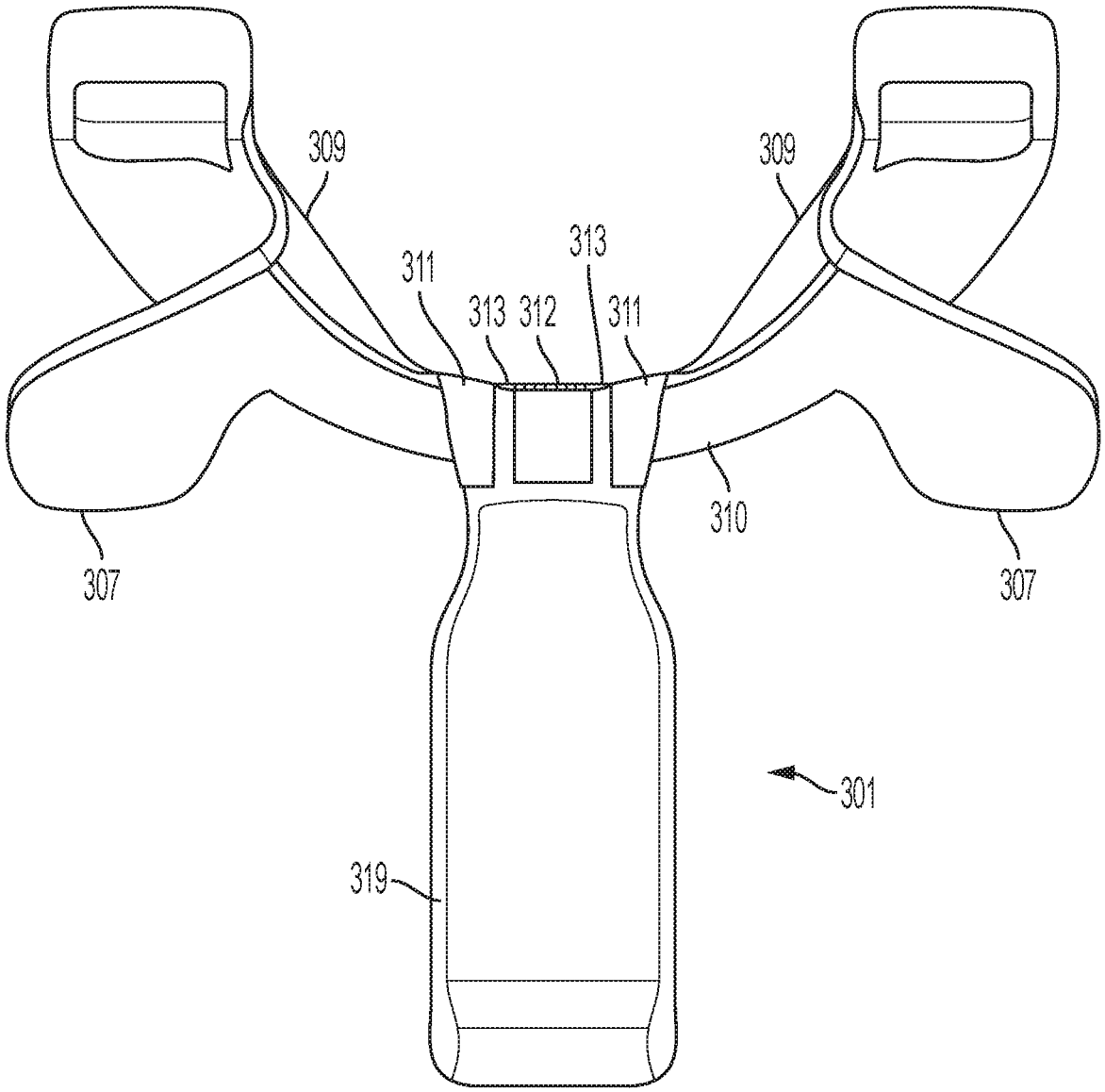
FIG. 61 is a front perspective view of the handleless slingshot of FIGS. 50 and 64.
Figure 62:
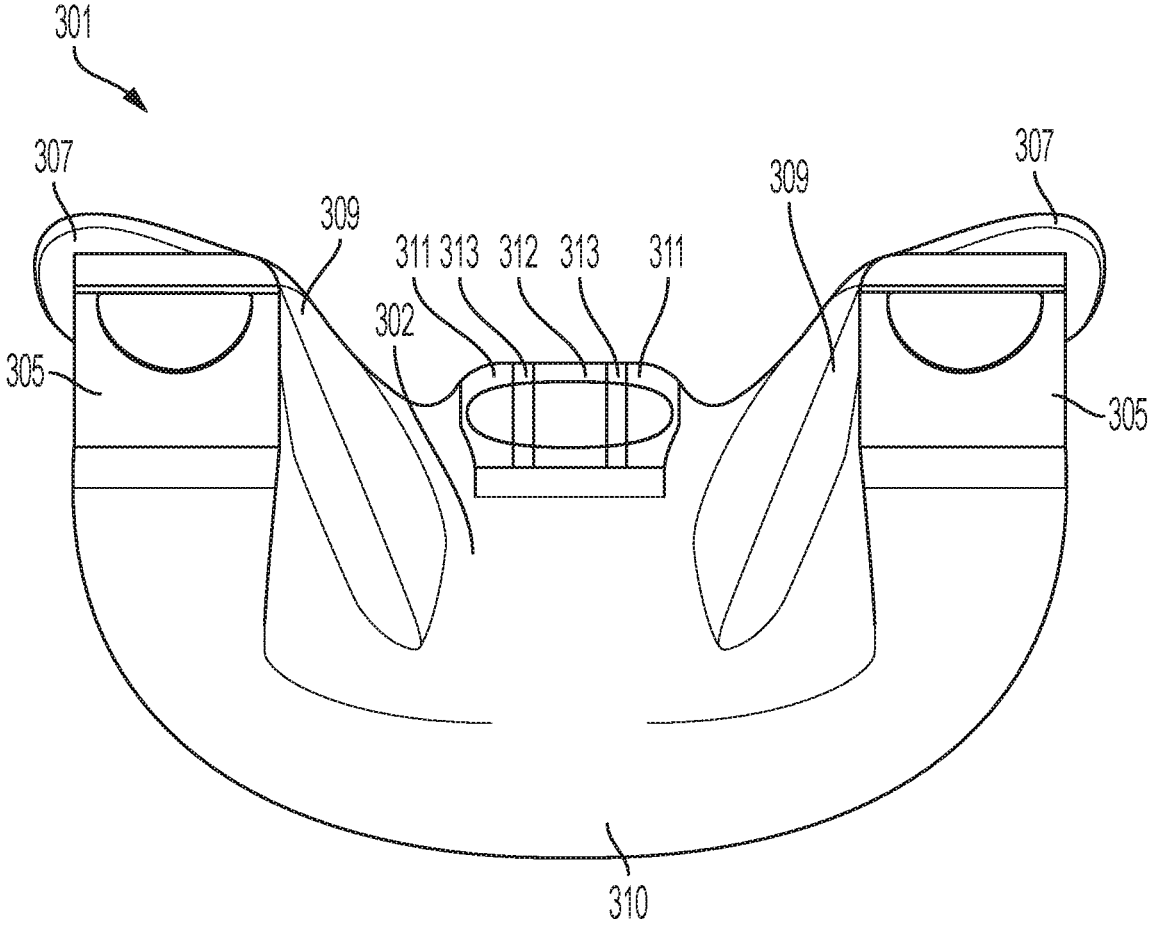
FIGS. 62 and 67 are top views of the handleless slingshot of FIGS. 50 and 64.
Figure 63:
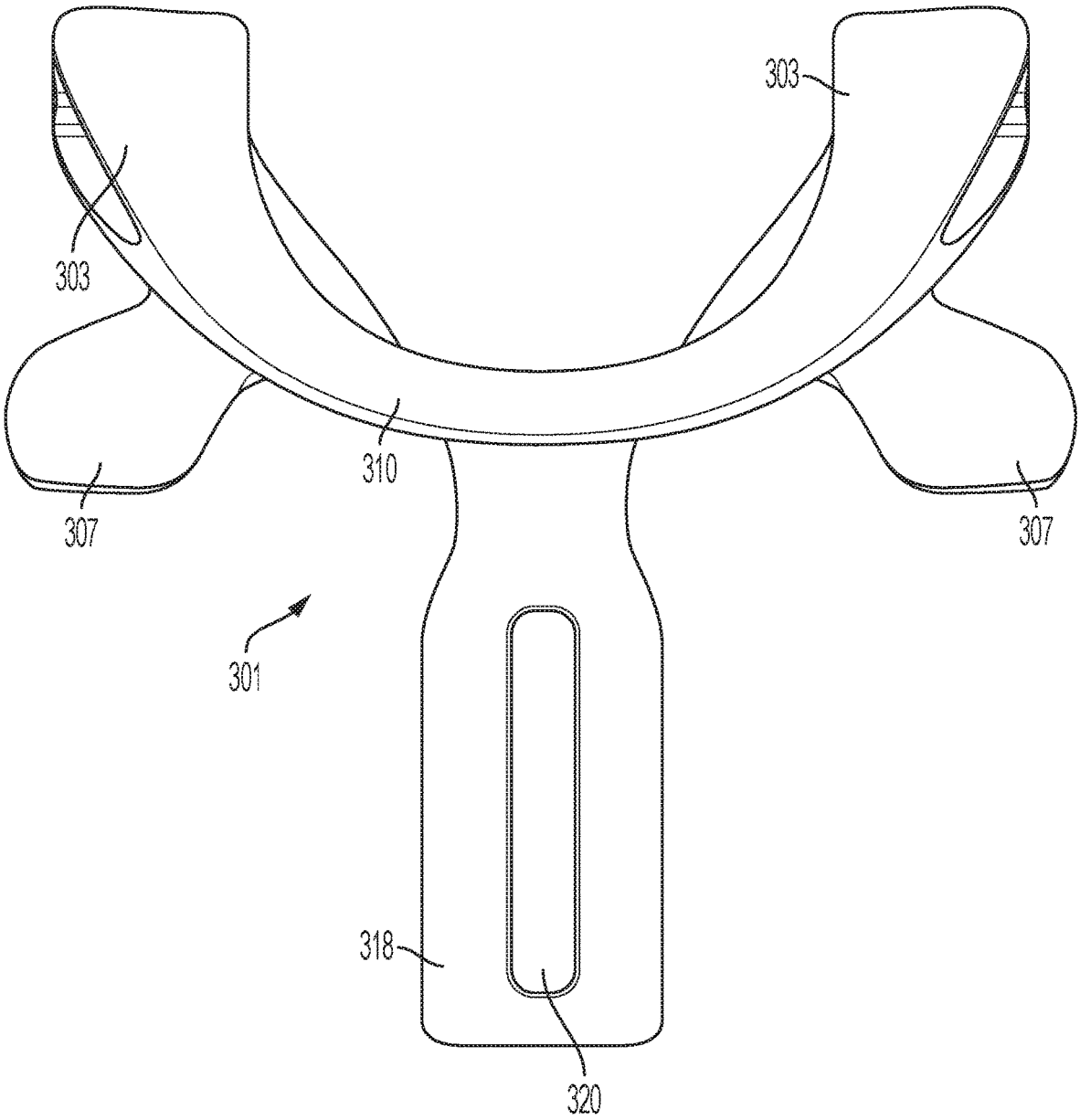
FIGS. 63 and 68 a rear views of the handleless slingshot of FIGS. 50 and 64.
Figure 64:
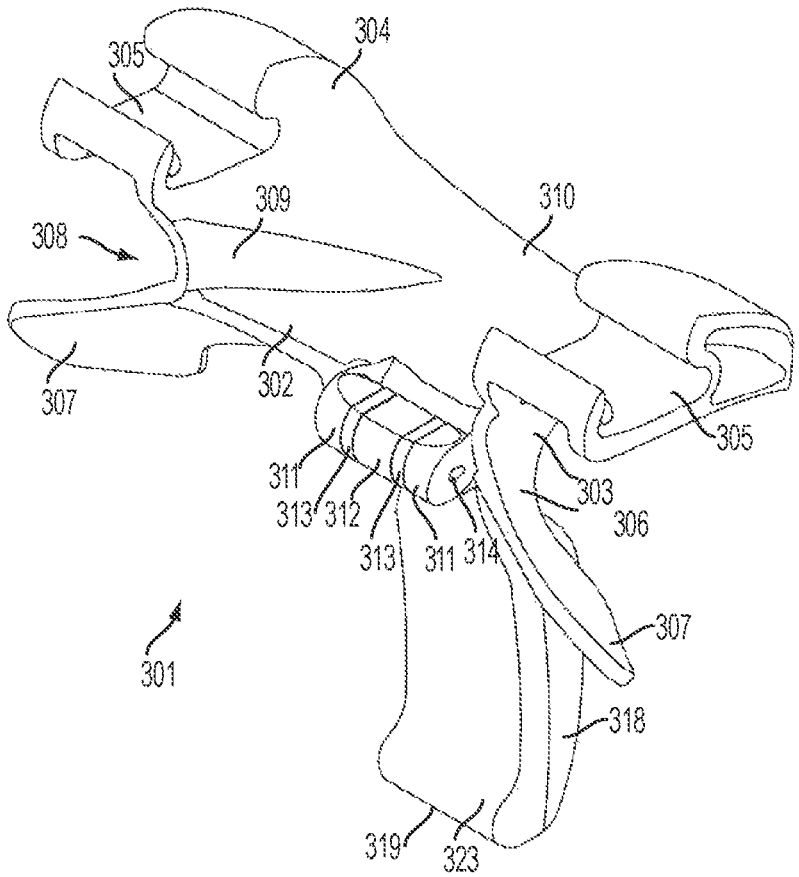
Figure 65:
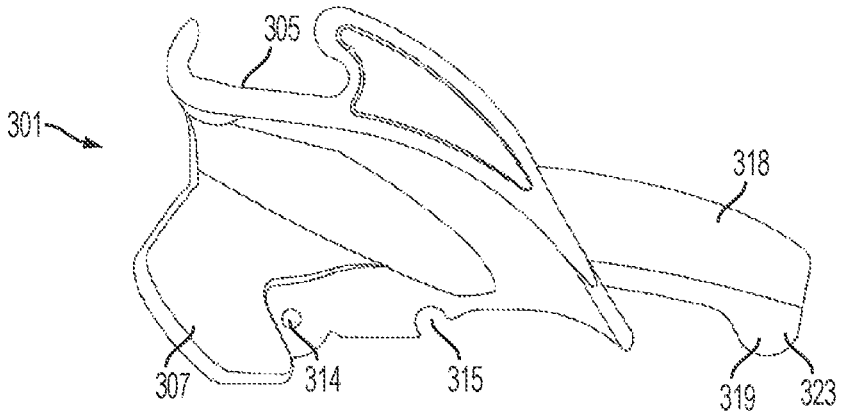
Figure 66:
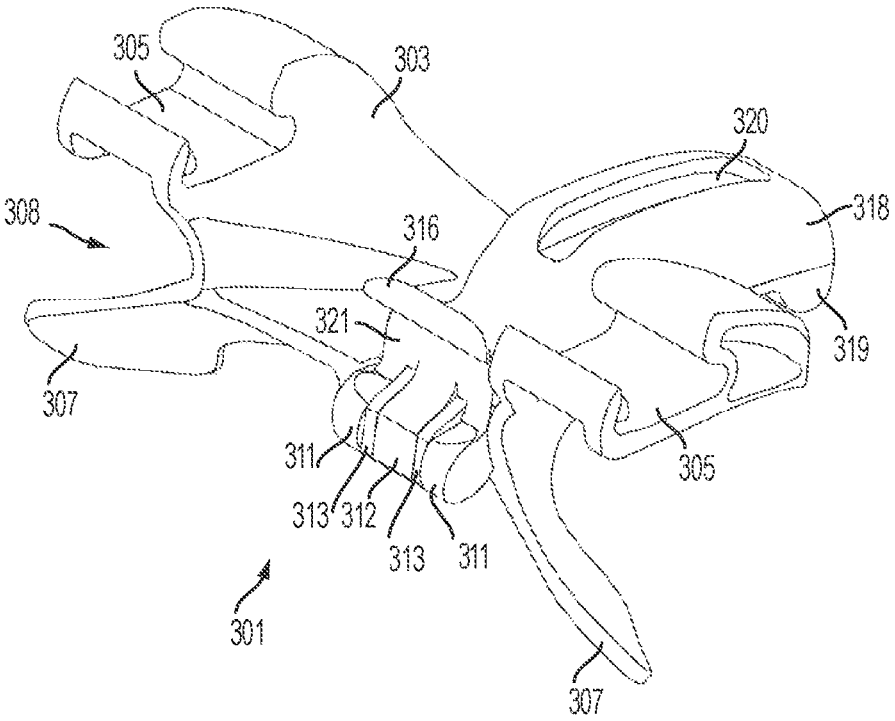
Figure 67:
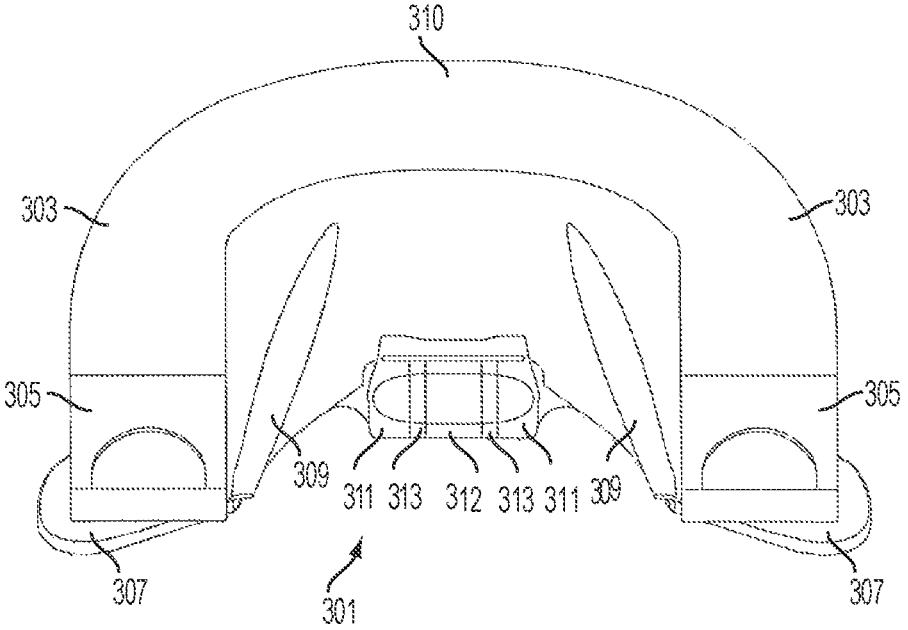
Figure 68:
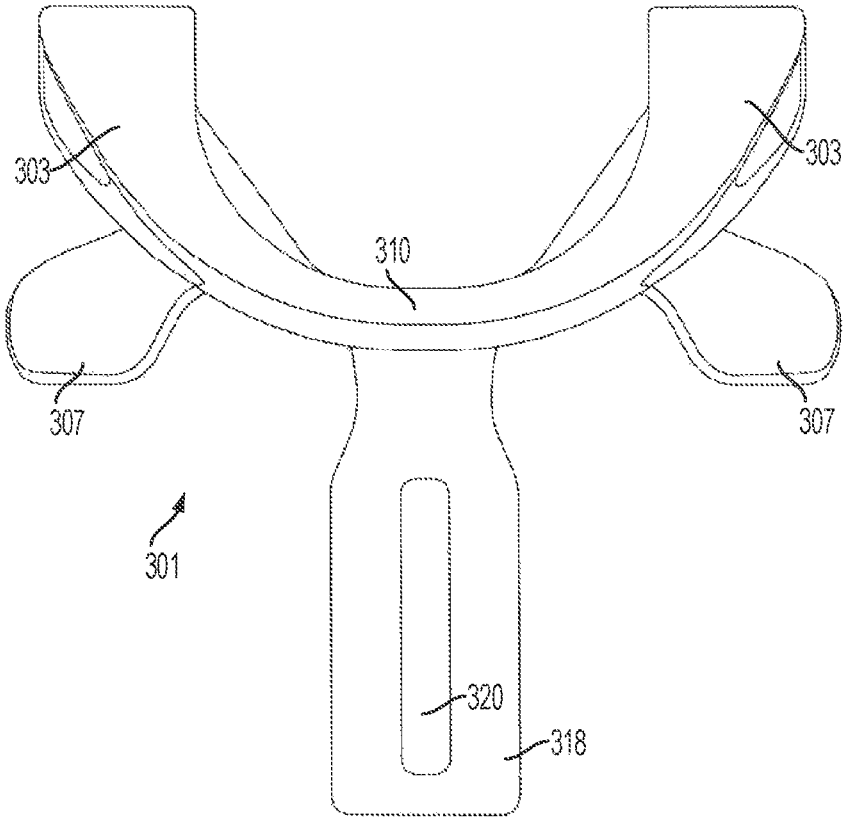
Figure 69:
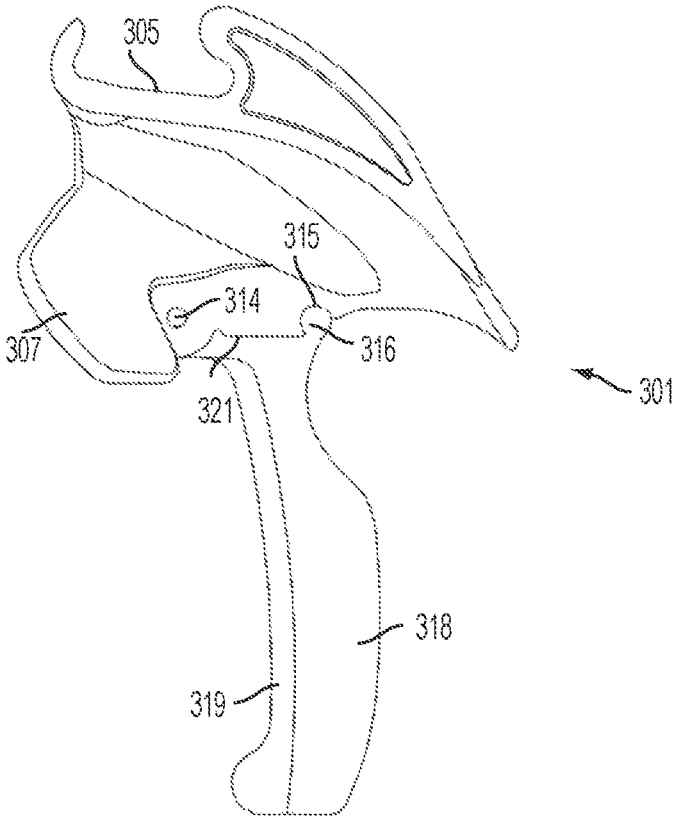
FIG. 69 is a right side view of the handleless slingshot of FIGS. 50 and 64.
Figure 70:
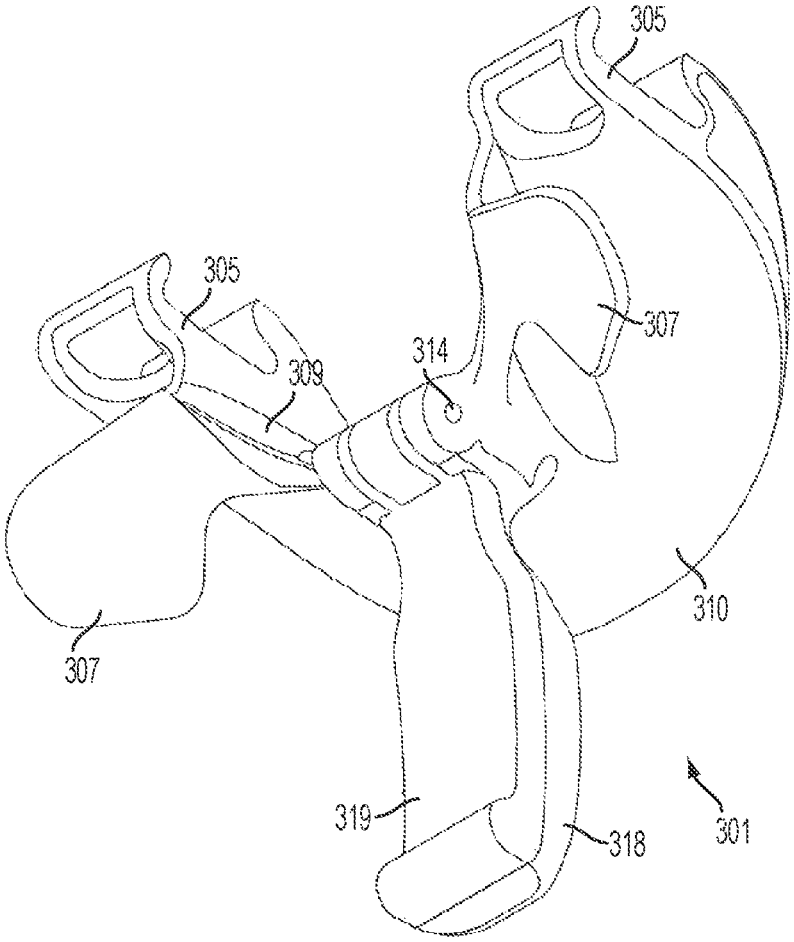
FIG. 70 is a bottom perspective view of the handleless slingshot of FIGS. 50 and 64.
Figure 71:
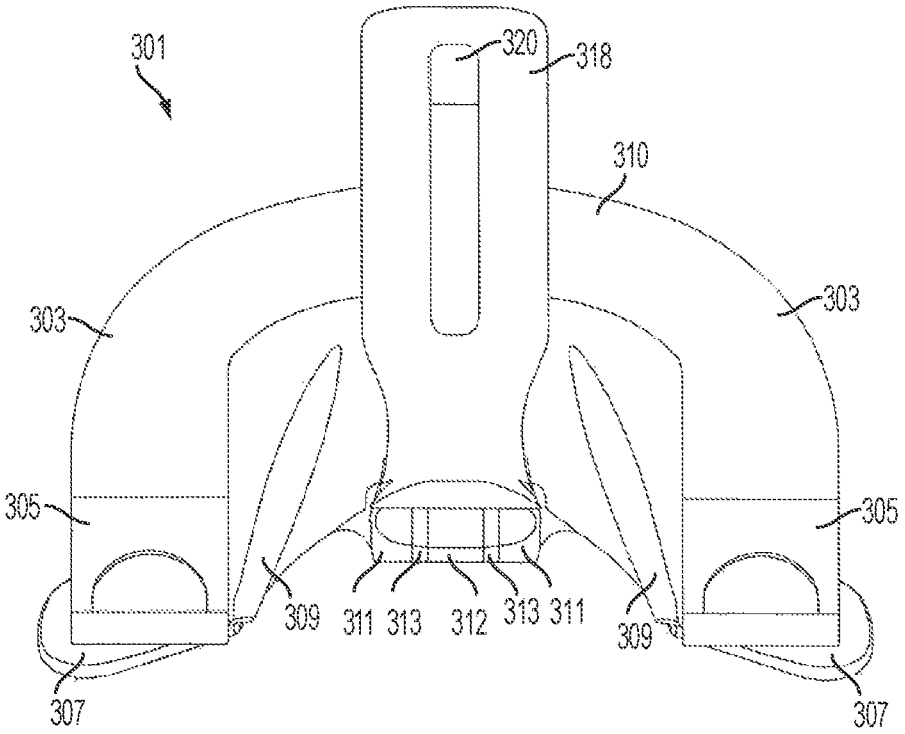
FIG. 71 is a top view of the handleless slingshot of FIGS. 56 and 65.
Figure 72:
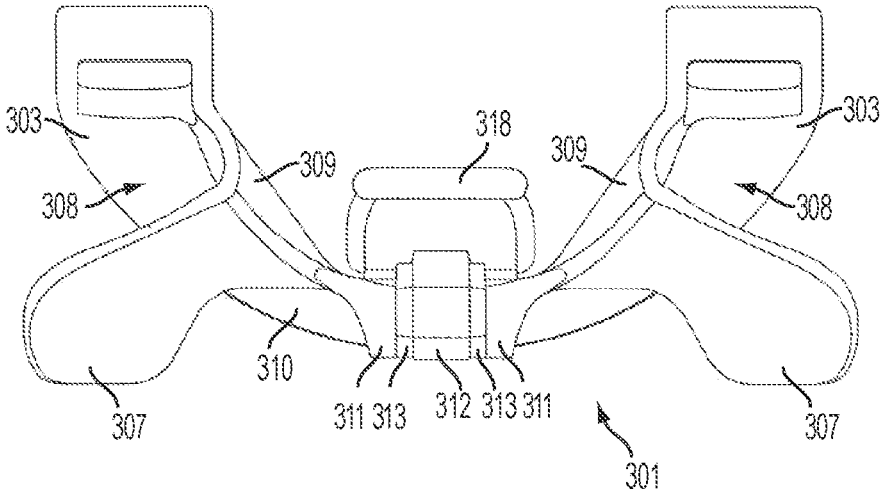
FIG. 72 is a front view of the handleless slingshot of FIGS. 56 and 65.
Figure 73:
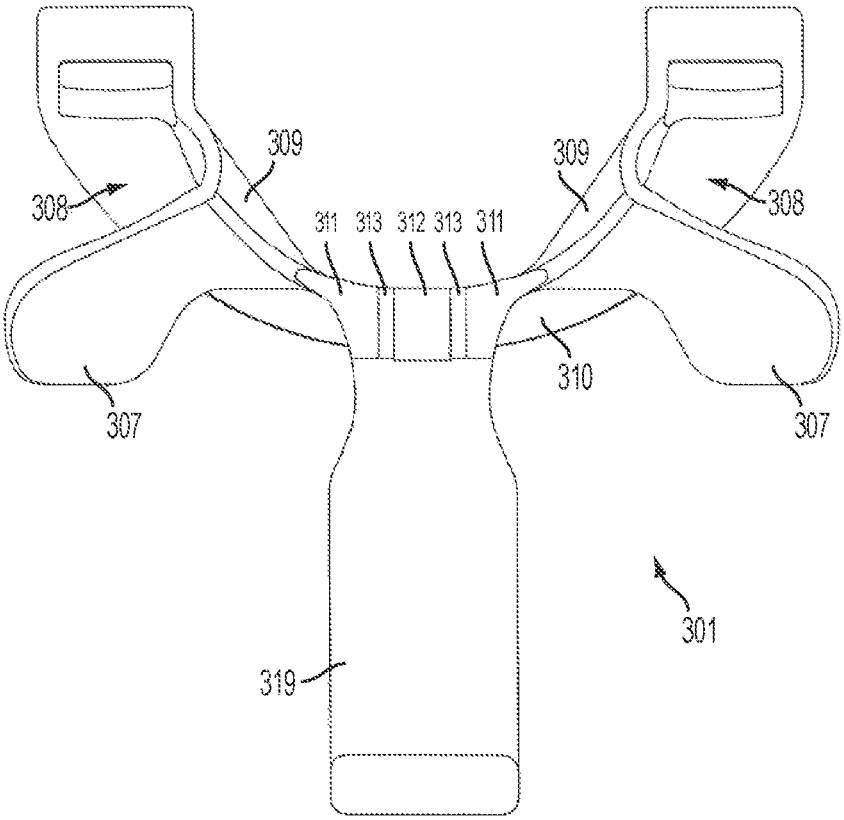
FIG. 73 is a front view of the handleless slingshot of FIGS. 50 and 64.
Figure 74:
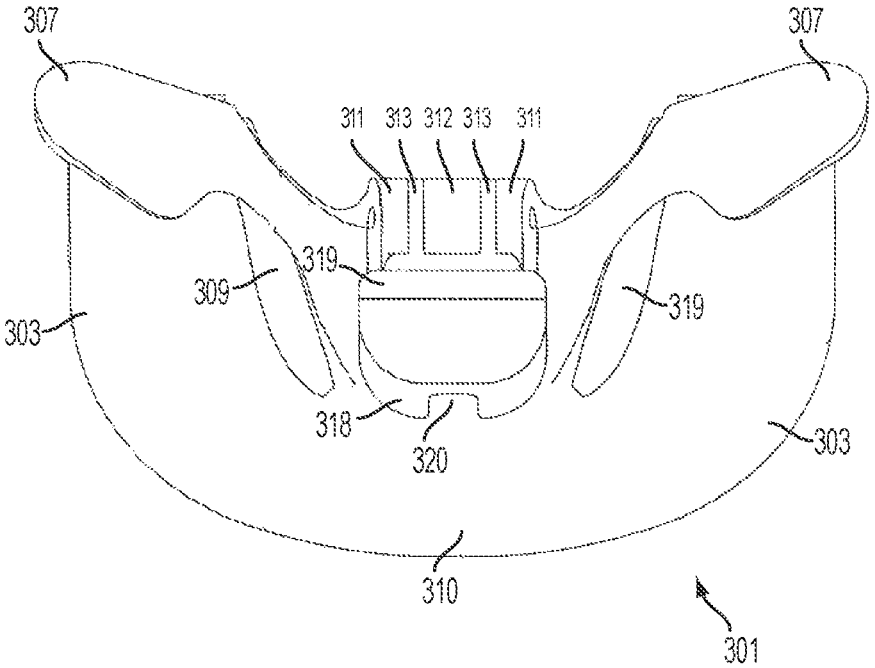
FIG. 74 is a bottom view of the handleless slingshot of FIGS. 50 and 64.

In a folded or stored configuration, shown in FIGS. 56-57, storage compartment 318 (closed with storage compartment lid 319) is disposed between arms 303 and generally parallel to guard area 310. This provides for a compact and portable device. In some embodiments, the storage compartment lid 319 may be contoured to match a contour of the body 302 in the folded position. In addition, the storage compartment lid 319 may include a foot 323 having an increased thickness relative to the rest of the storage compartment lid 319. The foot 323 may also contact the body 302 and have a mating contour with the body along this contact. To prepare slingshot 301 for use, a user unfolds storage compartment 318 (closed with storage compartment lid 319) by rotating storage compartment 318 through the front of slingshot 301 and downward until clip 316 engages groove 315 of body 302 of slingshot 301 to lock storage compartment 318 in an open position.

In an open, or unfolded, position (as shown, for example, in FIGS. 50, 58 and 59) storage compartment 318 may be opened by disengaging locking mechanism 322 and pivotally rotating storage compartment lid 319 away from storage compartment 318. This may be useful, for example, to load and/or remove shot or other supplies stored in storage compartment 318.

To shoot slingshot 301, storage compartment 318 and storage compartment lid 319 should be in the open and locked position. A user may then position guard area 310 of body 302 of slingshot 301 into the web of the user's hand between the user's thumb and index finger. The upper portions of the user's thumb and index finger should be in contact with groves 305 to correctly position slingshot 1.

When the band (not shown) is drawn, body 302 of slingshot 301 is torqued rearward, toward the user, and the guard area 310 engages the web of the user's hand to provide a minimal counter-torque. However, because the design of slingshot 301 moves the thumb and index finger pressure (contact) points forward of the band, slingshot 1 balances comfortably within the web of the user's hand without the need for the user to grip a handle when shooting the slingshot.

It will be appreciated that while storage compartment 318 is disposed in the vicinity of where a handle typically would be located in prior art slingshots when the user shoots the slingshot 301, storage compartment 318 need not be grasped or held by the user during shooting, and slingshot 301 may contact only the web of the user's hand and the user's thumb and index finger during shooting. Notwithstanding the foregoing, if desired by the user, storage compartment 18 may be used as a handle when in the open, unfolded and locked position.

It will be further appreciated that storage compartment 18 is optional on some embodiments of the slingshot. That is, for maximum portability, storage compartment 318 (and storage compartment lid 319) may be removed from body 302 and/or body 302 may be formed without body hinge mechanism 311. In this manner the slingshot will operate as described above with the slingshot contacting only the web of the user's hand and the user's thumb and index finger during shooting.

FIGS. 75-82 show various views of a handleless slingshot 401 according to another embodiment, with a storage compartment in an open, unfolded and locked position. FIGS. 83-90 show various views of the handleless slingshot 401 of FIGS. 75-82 with the storage compartment in a folded position.

It is understood that various features of the embodiment shown in FIGS. 75-90 may be similar or identical to the features described above with reference to FIGS. 50-74, and that further description of these features may be omitted below. In addition, certain features described below that are similar or identical to features described above may be referenced below and shown in FIGS. 75-90 using the same reference numbers as above.

Referring to FIGS. 75-82, the handleless slingshot 401 includes a body 402 having a body hinge mechanism 411. The handleless slingshot 401 also includes a storage compartment 418 having a storage compartment hinge mechanism 412, and a storage compartment lid 419 having a storage compartment lid hinge mechanism 413. The storage compartment 418 and storage compartment lid 419 are pivotally, or hingedly, connected to the body 402 for movement between the unfolded position (FIGS. 75-82) and the folded position (FIGS. 83-90).

The storage compartment 418 and storage compartment lid 419 are pivotable about a common axis and may be pivoted or rotated together. In addition, the storage compartment lid, 419, may pivot relative to the storage compartment 418 to allow access to an interior of the storage compartment 418.

Figure 75:
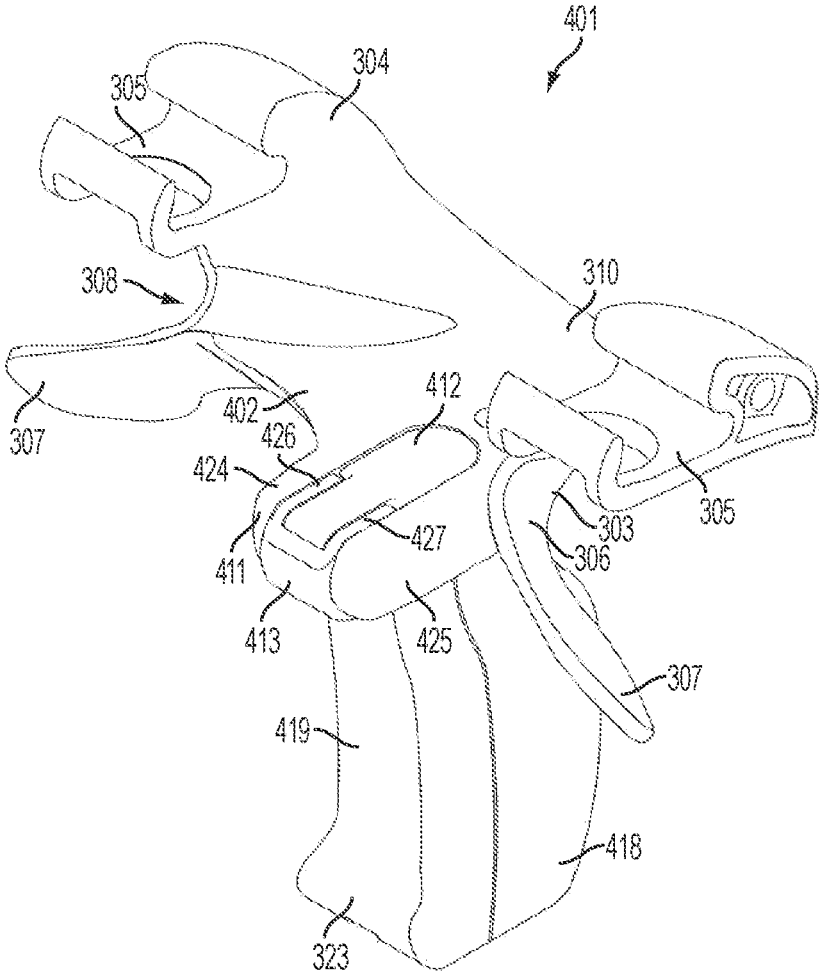
FIG. 75 is top, front perspective view of a handleless slingshot with a folding storage compartment in an unfolded (open) and locked position according to another embodiment.
Figure 76:
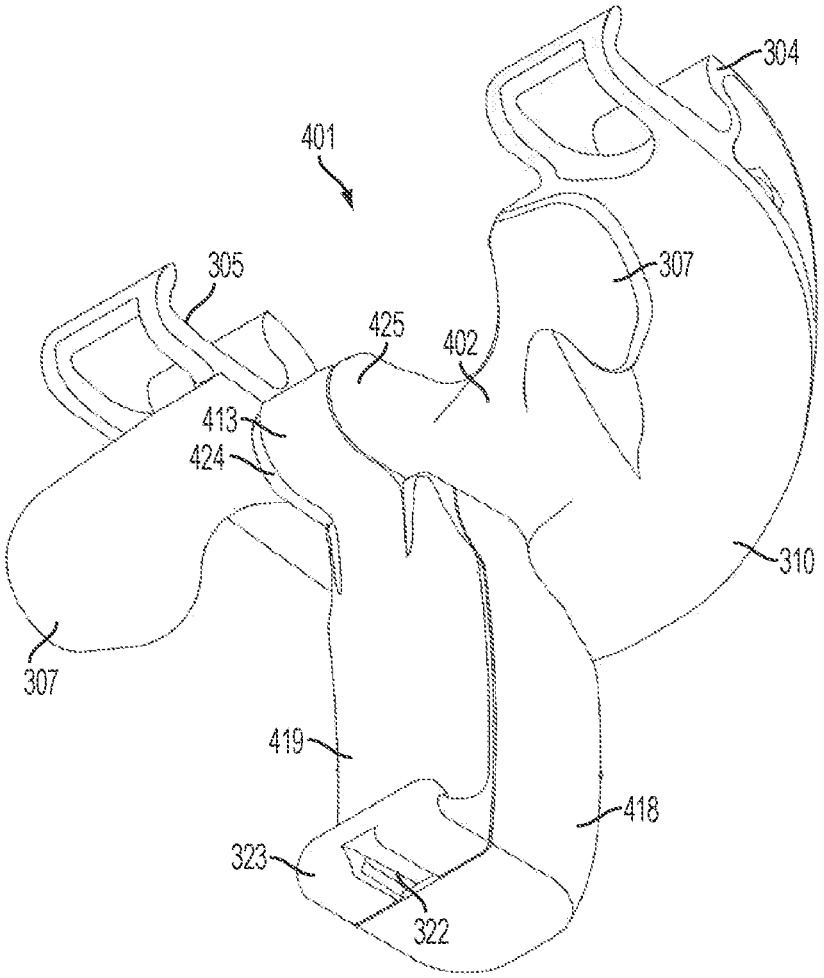
FIG. 76 is a bottom, front perspective view of the handleless slingshot of FIG. 75.
Figure 77:
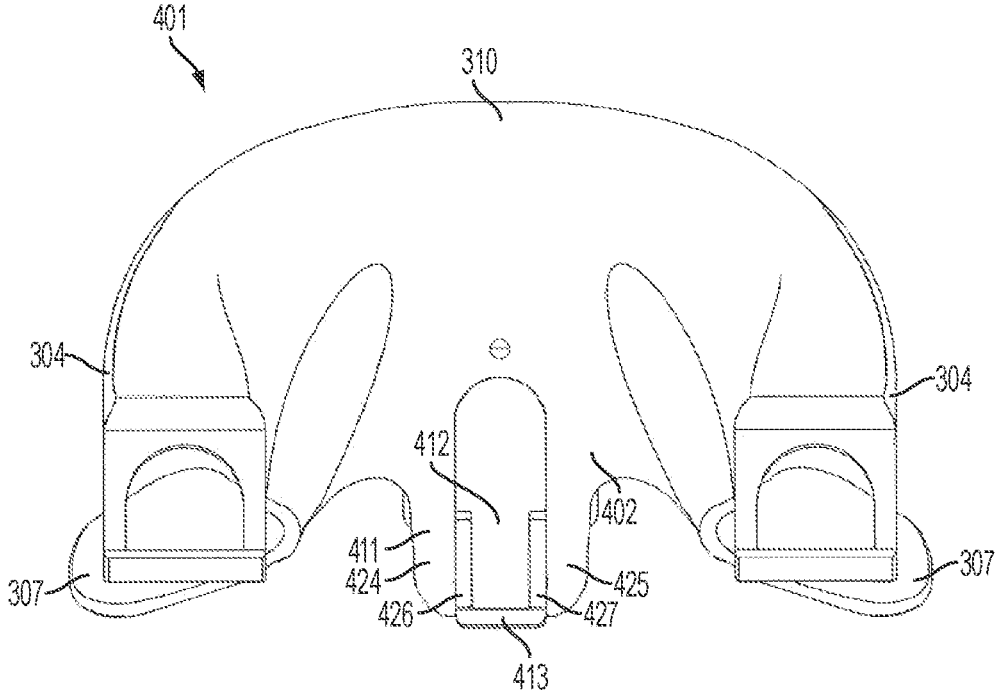
FIG. 77 is a top view of the handleless slingshot of FIG. 75.
Figure 78:
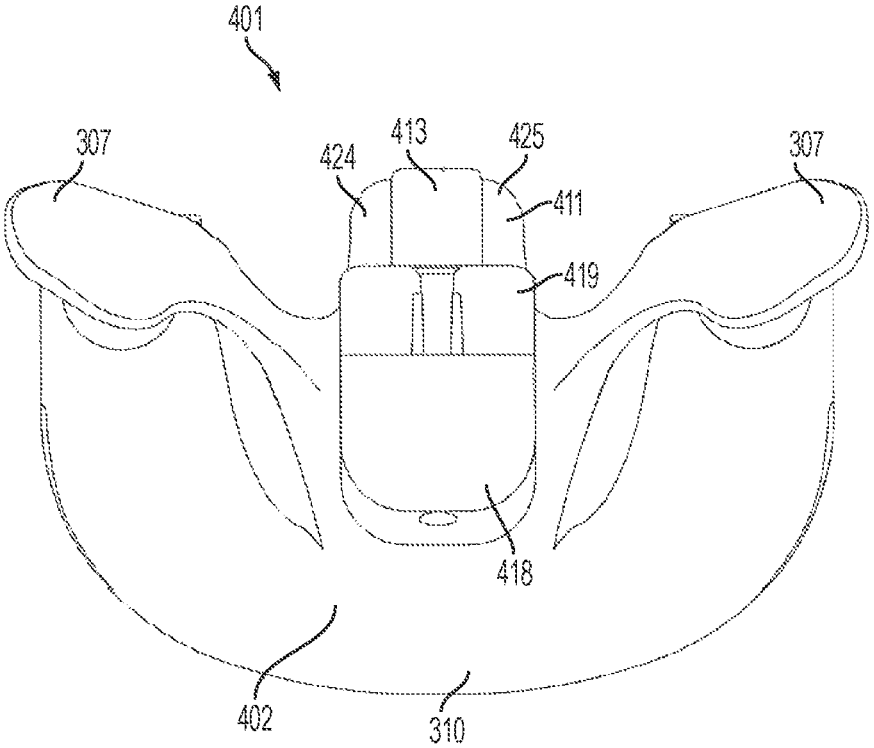
FIG. 78 is a bottom view of the handleless slingshot of FIG. 75.
Figure 79:
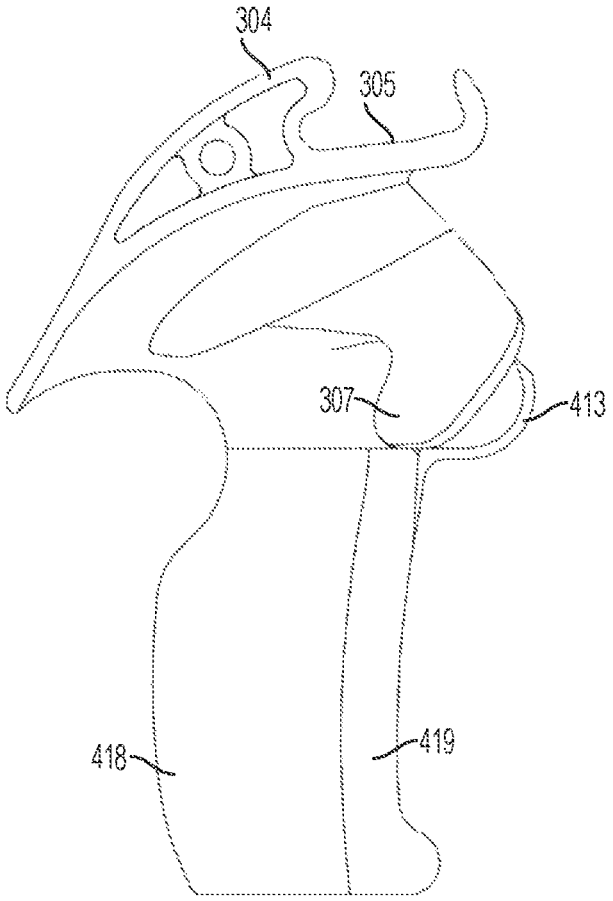
FIG. 79 is left side view of the handleless slingshot of FIG. 75.
Figure 80:
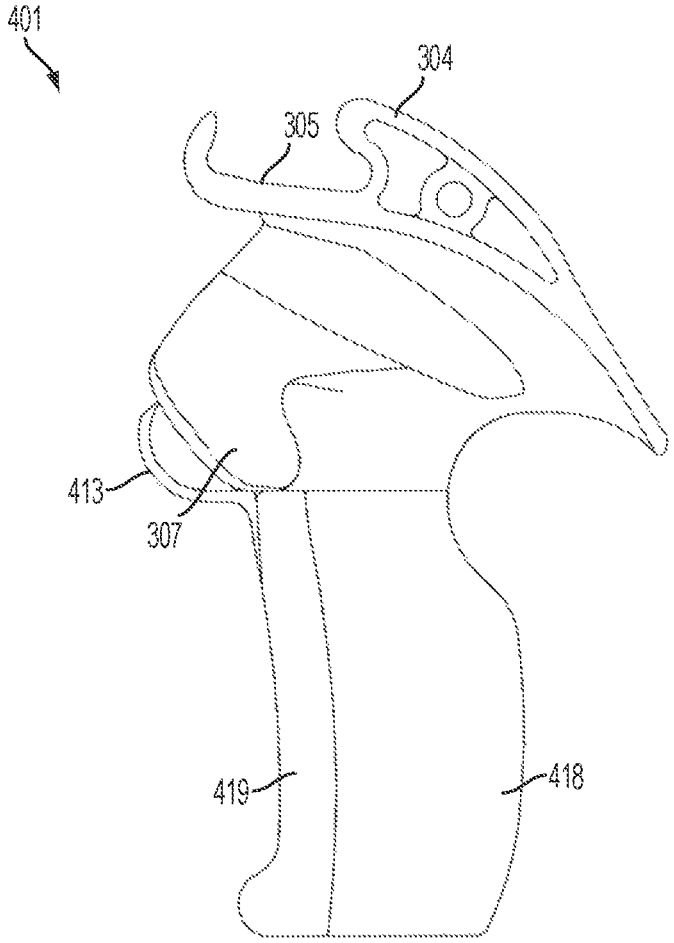
FIG. 80 is a right side view of the handleless slingshot of FIG. 75.
Figure 81:
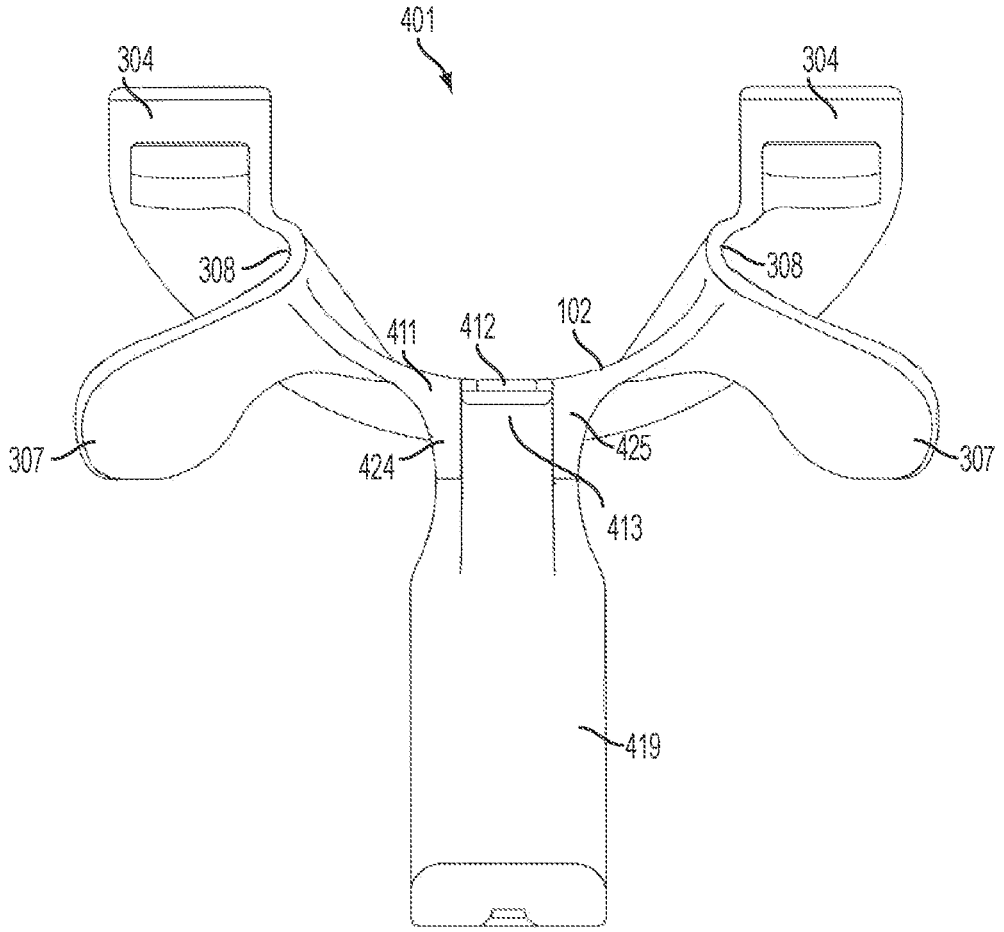
FIG. 81 is a front view of the handleless slingshot of FIG. 75.
Figure 82:
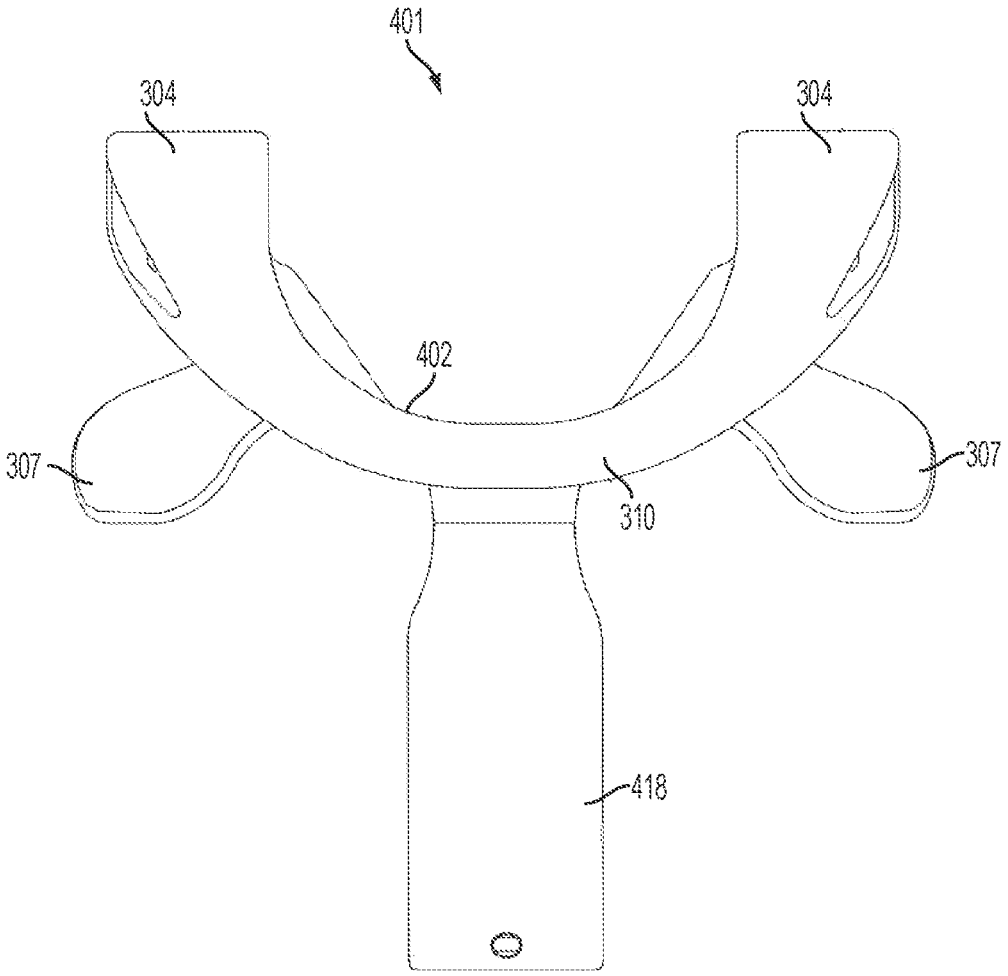
FIG. 82 is a rear view of the handleless slingshot of FIG. 75.

The storage compartment 418 and the storage compartment lid 419 are hingedly connected to the body hinge mechanism 411 of the body 402, at the storage compartment hinge mechanism 412 and the storage compartment lid hinge mechanism 413. In one embodiment, for example as shown in FIG. 75, the hinge body mechanism 411 includes a first ear 424 and a second ear 425 spaced from the first ear 424. The storage compartment hinge mechanism 412 and the storage compartment lid hinge mechanism 413 are positioned between the first ear 424 and the second ear 425.

The storage compartment lid hinge mechanism 413 includes a first leg 426 and a second leg 427 spaced from the first leg 426. The storage compartment hinge mechanism 412 is positioned between the first leg 426 and the second leg 427. The common axis extends through the first ear 424, the second ear 425, the first leg 426, the second leg 427 and the storage compartment hinge mechanism 412.

Figure 83:
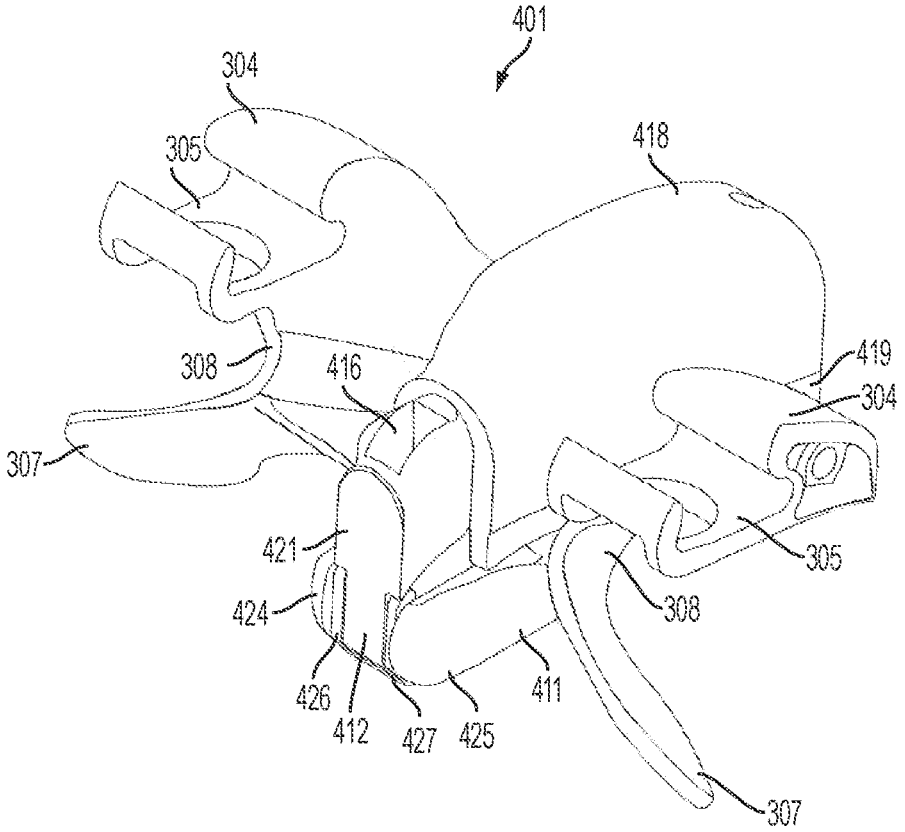
FIG. 83 is a front, top perspective view of the handleless slingshot of FIG. 75 with the folding storage compartment in a fully folded position.
Figure 84:
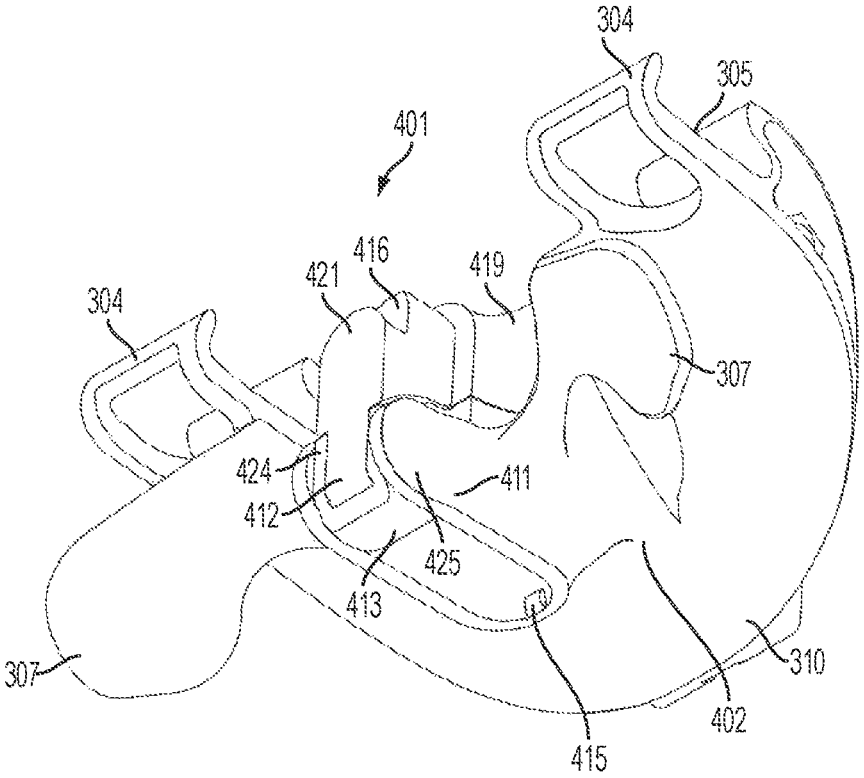
FIG. 84 is a front, bottom perspective view of the handleless slingshot of FIG. 83.
Figure 85:
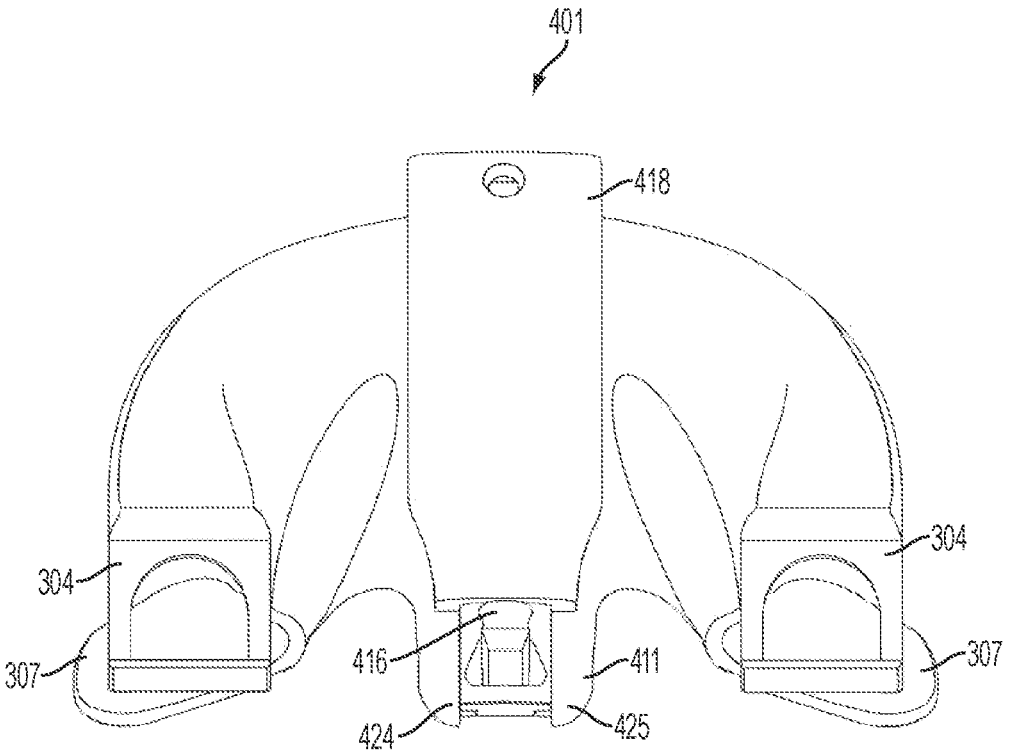
FIG. 85 is a top view of the handleless slingshot of FIG. 83.

Referring to FIGS. 83-90, to the handleless slingshot 401 is shown with the storage compartment 418 in the folded position. As shown in FIGS. 83 and 84, for example, the storage compartment 418 includes a mounting base 421. The storage compartment hinge mechanism 412 is formed at one end of the mounting base 421. A latching mechanism is formed at an opposite end of the mounting base 421 from the storage compartment hinge mechanism. The latching mechanism may be, for example, a latching opening 416 formed within the mounting base 421.

Figure 86:
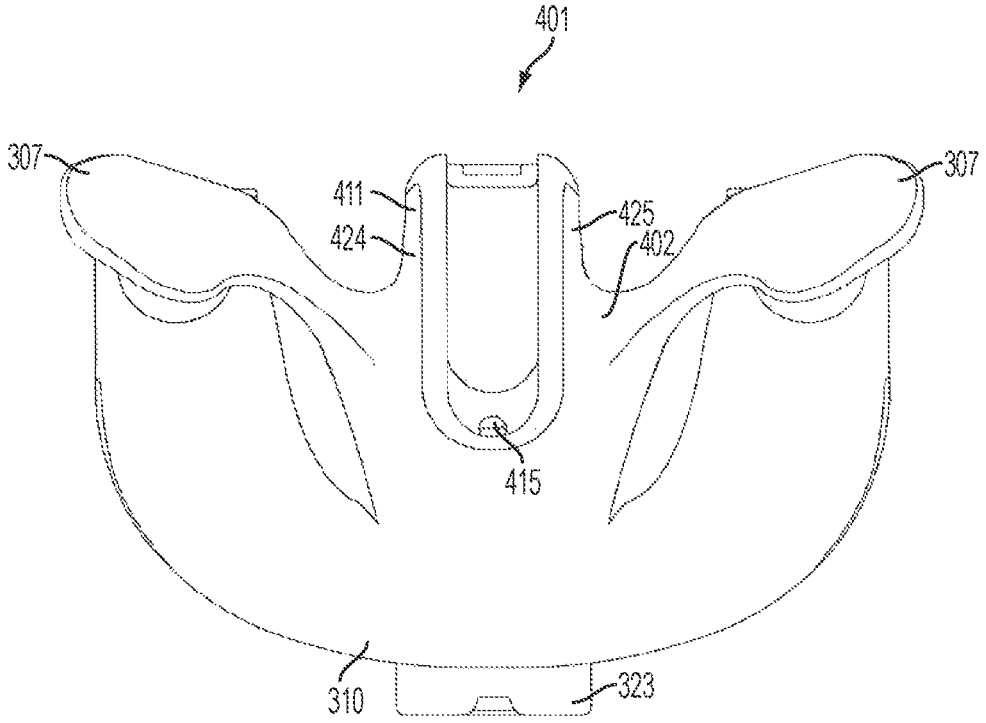
FIG. 86 is a bottom view of the handleless slingshot of FIG. 83.
Figure 87:
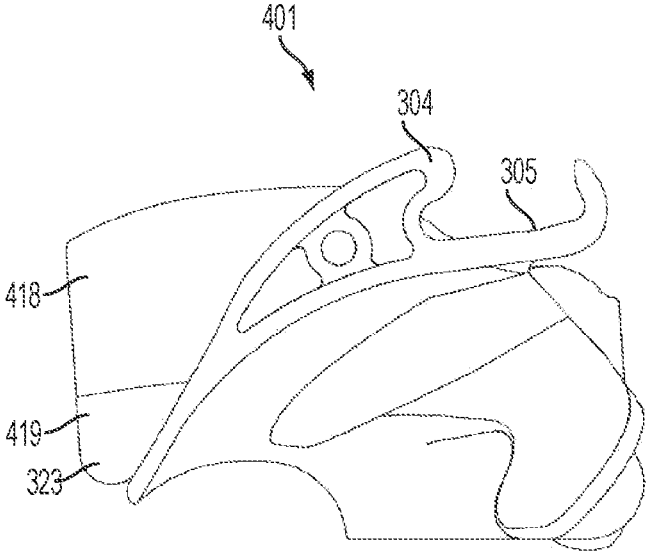
FIG. 87 is a left side view of the handleless slingshot of FIG. 83.
Figure 88:
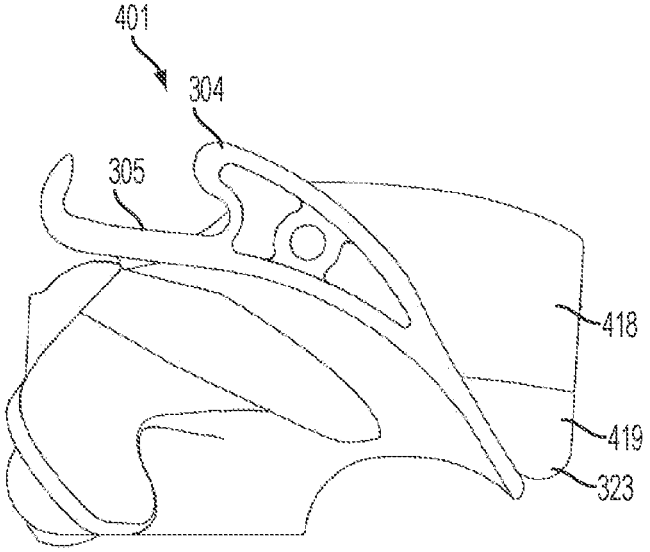
FIG. 88 is a right side view of the handleless slingshot of FIG. 83.
Figure 89:
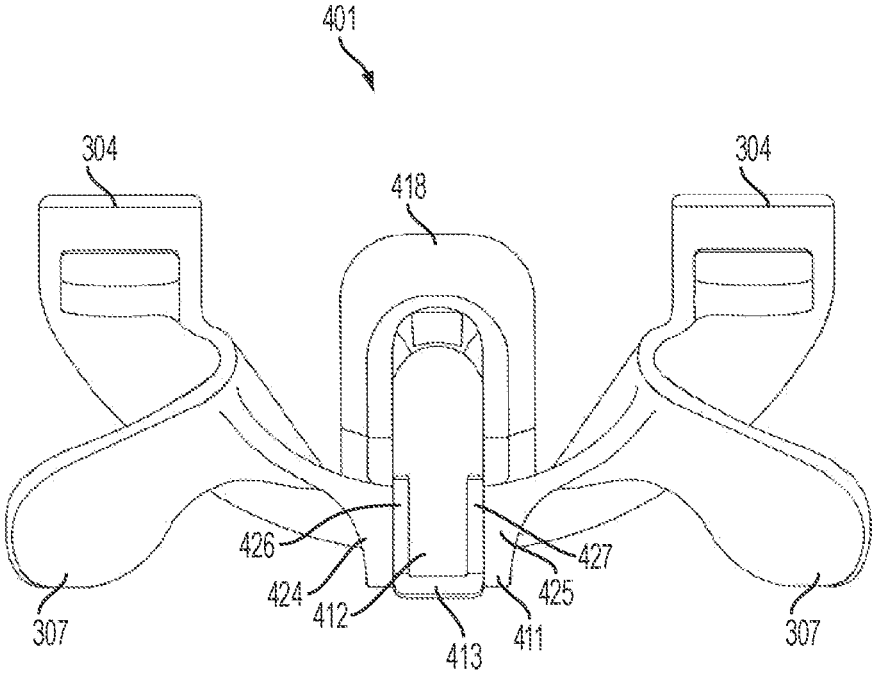
FIG. 89 is a front view of the handleless slingshot of FIG. 83.
Figure 90:
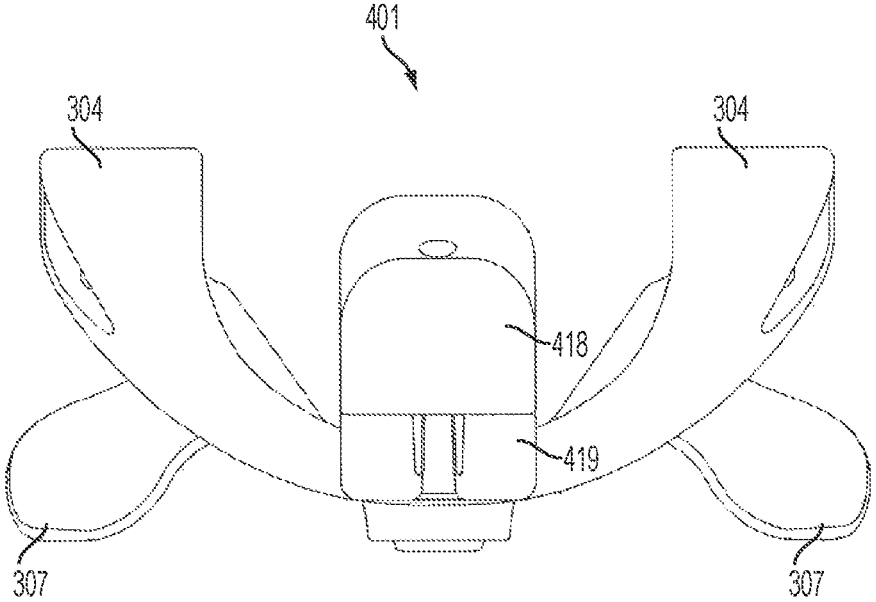
FIG. 90 is a rear view of the handleless slingshot of FIG. 83.
Figure 91:
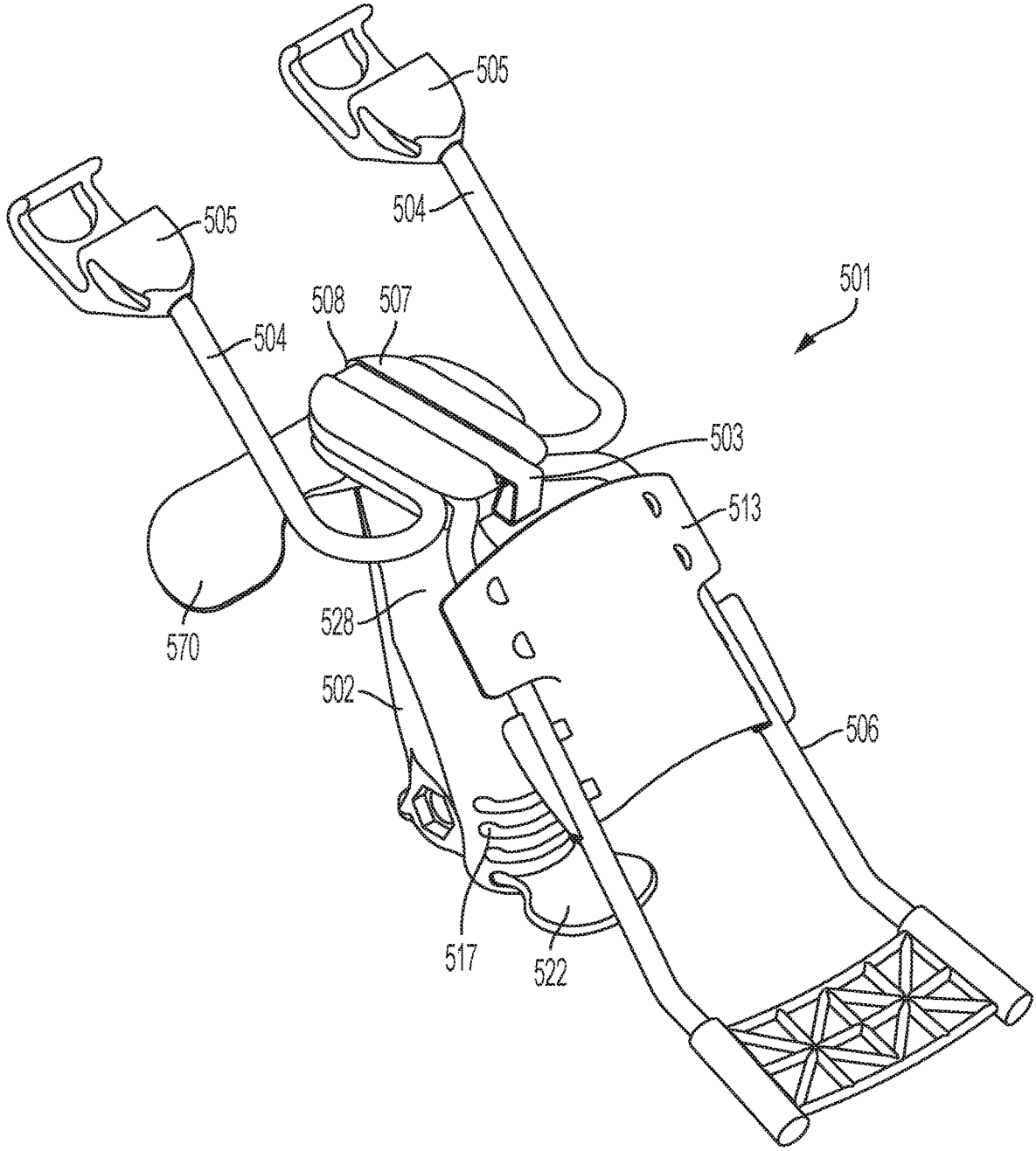
FIG. 91 is a perspective view of a slingshot according to another embodiment described herein.
Figure 92:
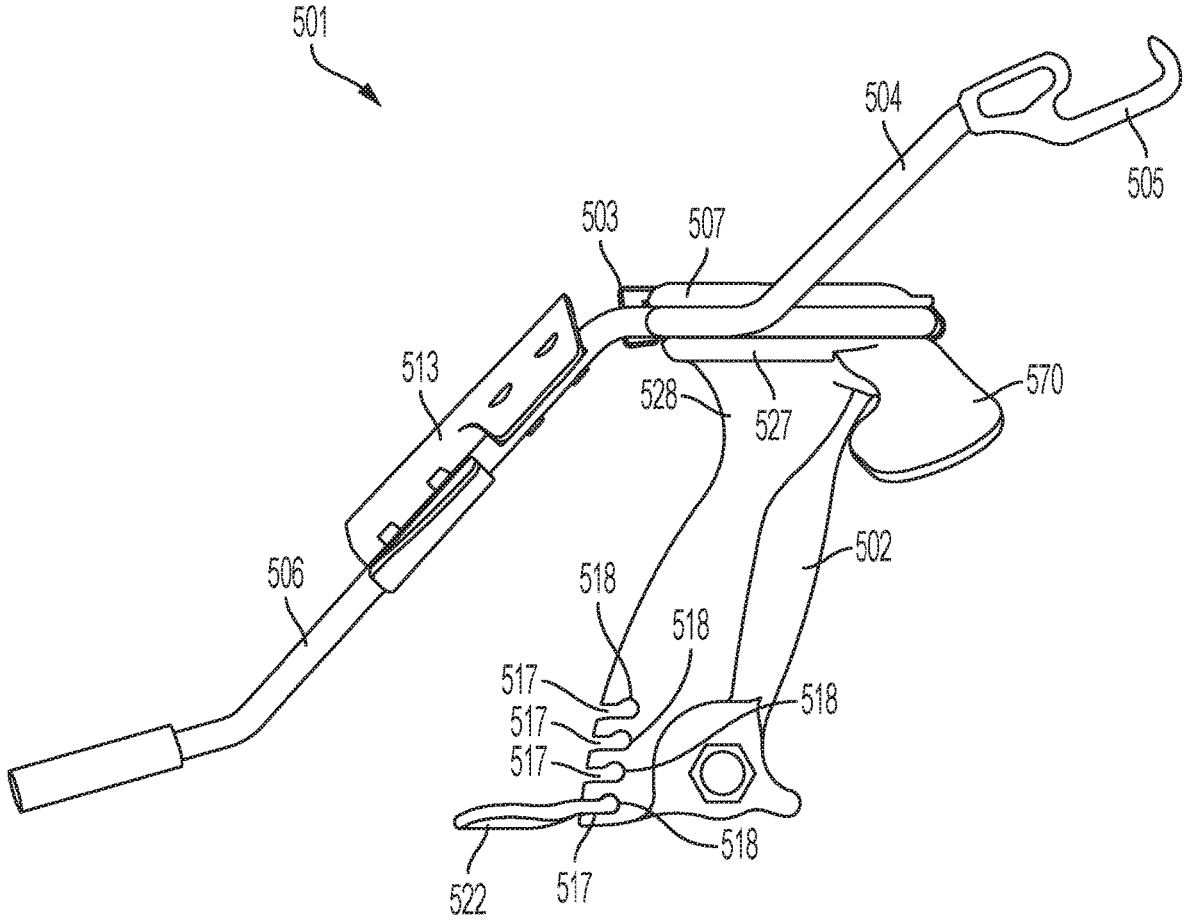
FIG. 92 is a left side view of the slingshot of FIG. 91.

As seen in FIGS. 84 and 86, for example, the body 402 includes a cooperating latching mechanism formed therein. The cooperating latching mechanism may be, for example, a latching tab 415 configured to releasably engage the latching opening to releasably secure or lock the storage compartment 418 in the open, unfolded position. The engagement between the latching tab 415 and the latching opening may be, for example, a friction fit or an interlocking fit.

Figure 38:
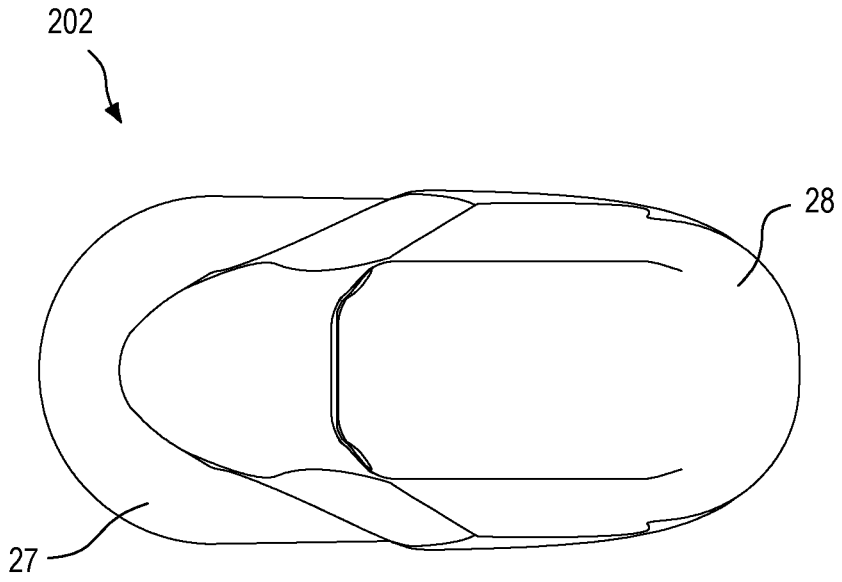
FIG. 38 is a bottom view of the handle of FIG. 36.
Figure 39:
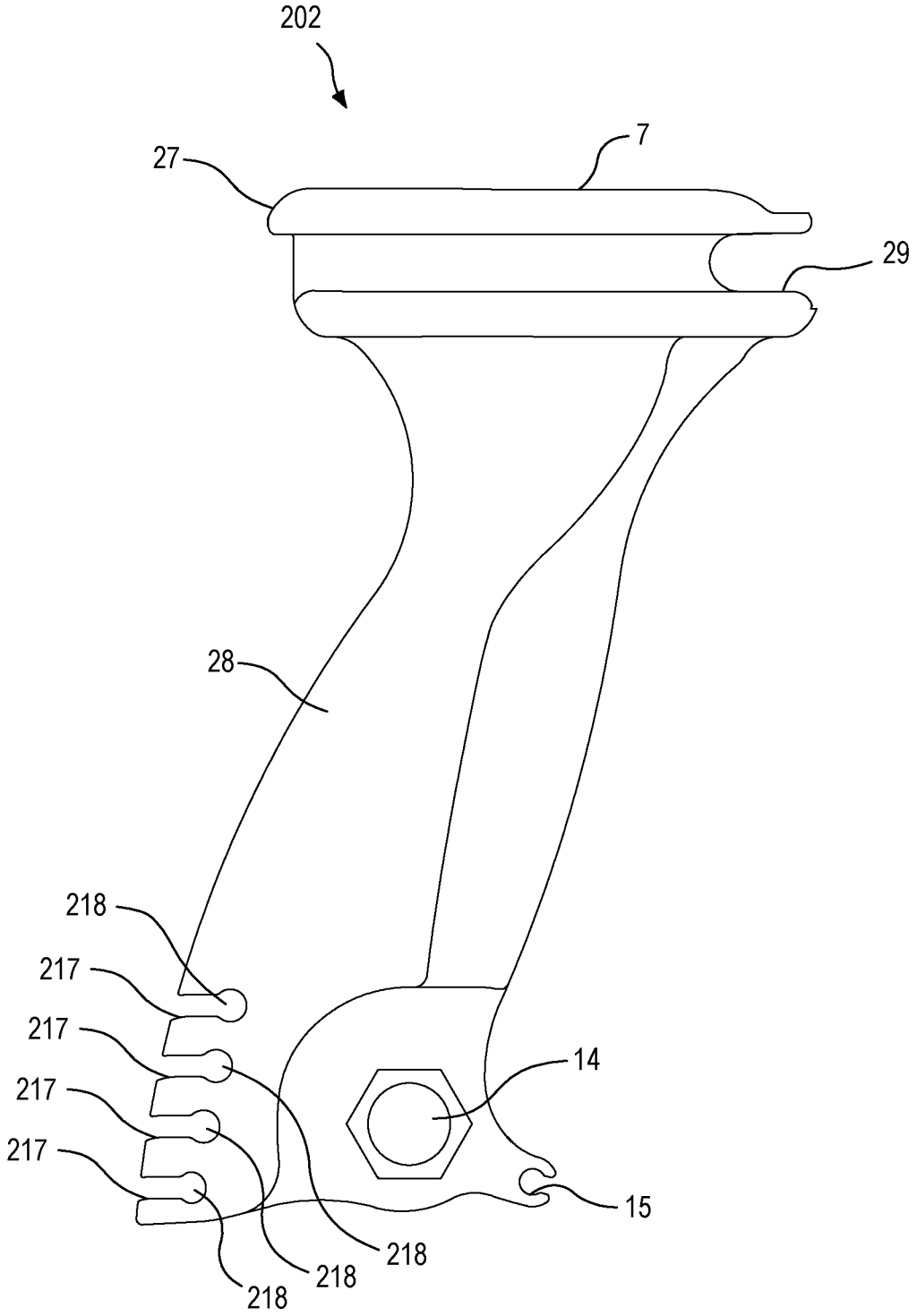
FIG. 39 is a left side view of the handle of FIG. 36.
Figure 40:
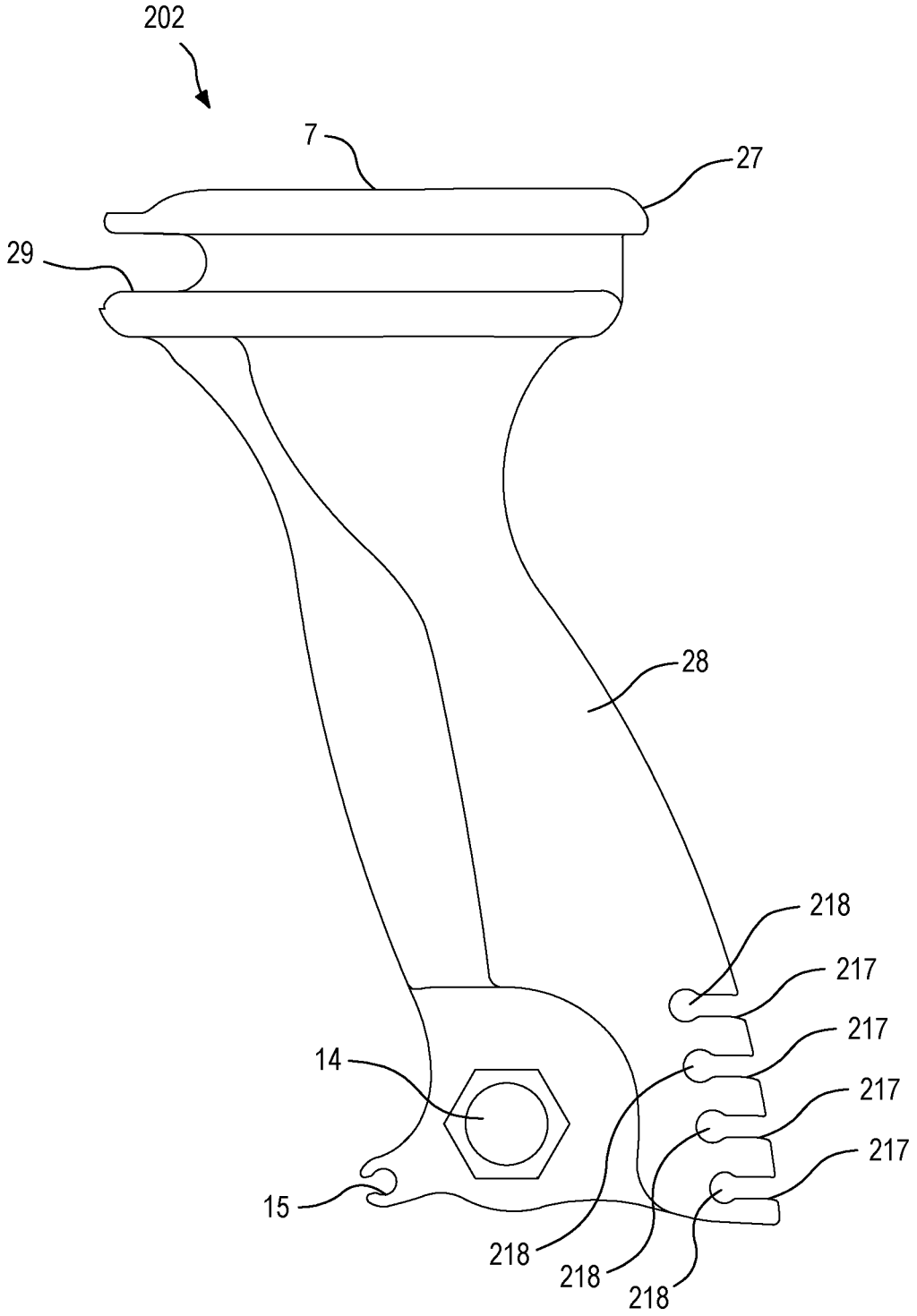
FIG. 40 is a right side view of the handle of FIG. 36.
Figure 41:
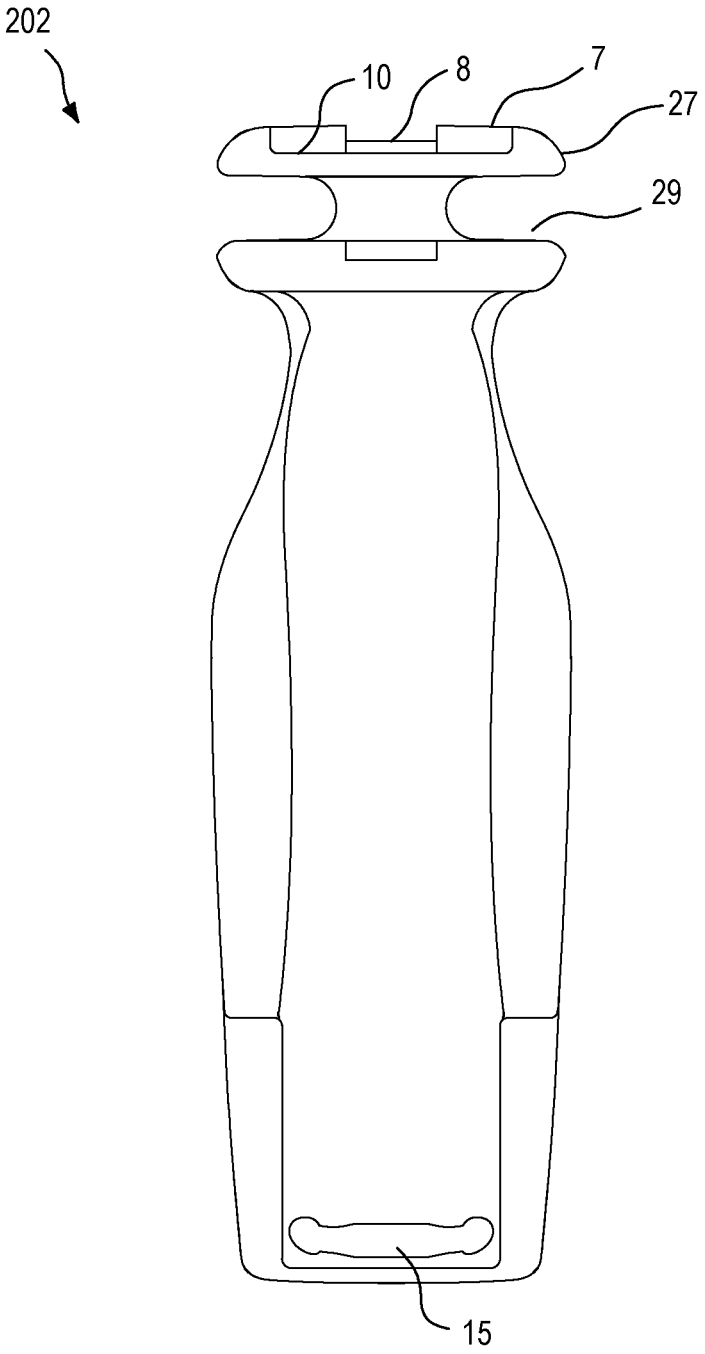
FIG. 41 is a front view of the handle of FIG. 36.

With the storage compartment lid 419 in the folded position, for example, as shown in FIGS. 38 and 39, the storage compartment lid 419 may mating engage the body 402. For example, the storage compartment lid 419 may have a contour corresponding to a contour of the body 402 of the handleless slingshot 401.

It is understood that the features described above may be used together with, implemented in and/or substituted for other various features of the examples described above. For example, the latching mechanisms and cooperating latching mechanisms described above may be implemented in either of the handleless slingshots 301, 401 shown in FIGS. 50-74 or FIGS. 75-90. Similarly, the hinge mechanisms of the body 302, 402, storage compartment 318, 418 and storage compartment lid 319, 419 may be used with the handleless slingshots 301, 401 shown in FIGS. 50-74 or FIGS. 75-90.

FIGS. 91-120 show a slingshot 501 according to another embodiment described herein. Referring generally to FIGS. 91-98, the slingshot 501 includes a handle 502, a pair of arms 504 extending upwardly and forwardly from the handle 502, and an arm brace 506. The pair of arms 504 includes band attachment devices 505 at respective ends thereof. In one embodiment, a bail guard 513 may be attached to the arm brace 506.

The slingshot 501 further includes a retaining clip 503. The retaining clip 503 is configured to secure the arm brace 506 and the pair of arms 504 to the handle 502.

The handle 502 may be formed similarly to handle 2 described in the embodiments above and shown in FIGS. 36-42, for example. As such, further description of features in handle 502 that are similar or identical to features in handle 2 may be omitted below. Further, it is understood that various features of the handle 2 of FIGS. 35-42 may be used together with or replace various features of the handle 502, and vice versa.

FIGS. 99-105 show different views of the handle 502 according to an embodiment described herein. The handle 502 includes a gripping portion 528 and a plurality of positioning elements 517 spaced apart in a height direction for a distance along a rearward face of the handle 502. Each positioning element 517 may be, for example, a positioning groove, and each positioning groove may be formed having the same or substantially the same size and shape as the other positioning grooves. Each positioning groove may include an associated channel section 518 formed continuously therewith, the channel section 518 being enlarged relative to the remainder of the positioning groove 517. For example, the channel section 518 may have a greater height or thickness than the remainder of the positioning groove 517.

The handle 502 also includes a flat top 507 having an elongated recess 508, a mounting base 527 and a peripheral groove 529. In one embodiment, the recess 508 may be formed in the top face of the flat top 507. The recess 508 is configured to receive the retaining clip 503 for securing the arm brace 506 and the pair of arms 504 to the handle 502.

As described above with reference to the embodiments in FIGS. 36-52, the recess 8 includes a differently dimensioned end 10 to receive a portion of the handle guard 11. However, in the present embodiment described herein with reference to FIGS. 91-105, the differently dimensioned end may be omitted and the recess 8 may have a substantially constant width and depth along its length. As described further below, this is because in the embodiments of FIGS. 91-105, a handle guard may be omitted and thus, the retaining clip 503 may be accommodated in the recess 508 without overlapping or abutting a handle guard.

Figure 95:
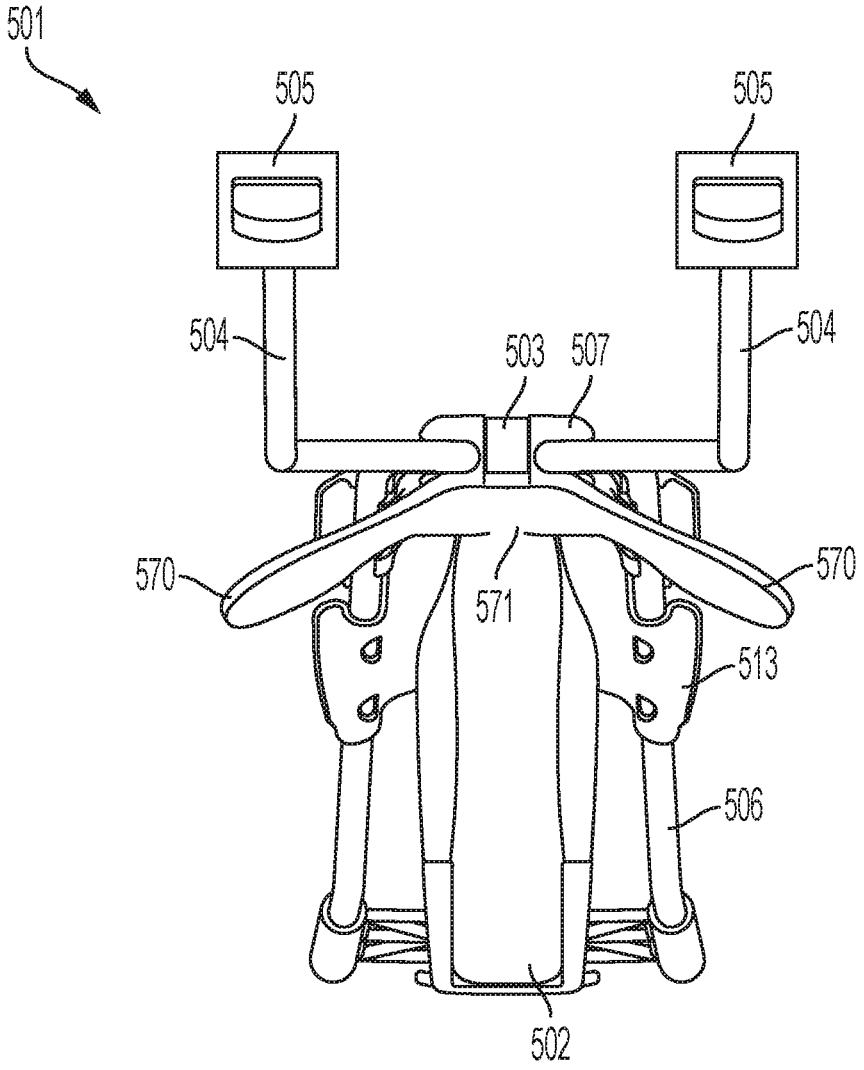
FIG. 95 is a front view of the slingshot of FIG. 91.
Figure 96:
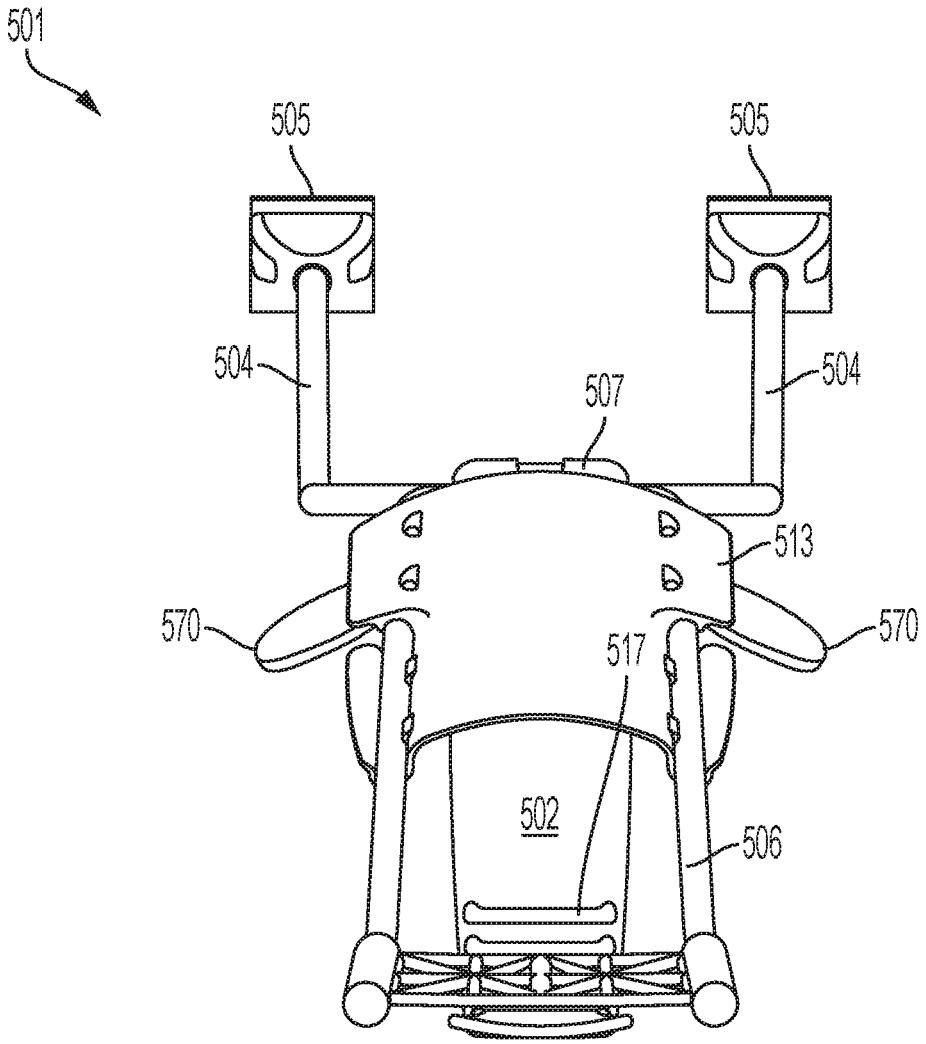
FIG. 96 is a rear view of the slingshot of FIG. 91.
Figure 97:
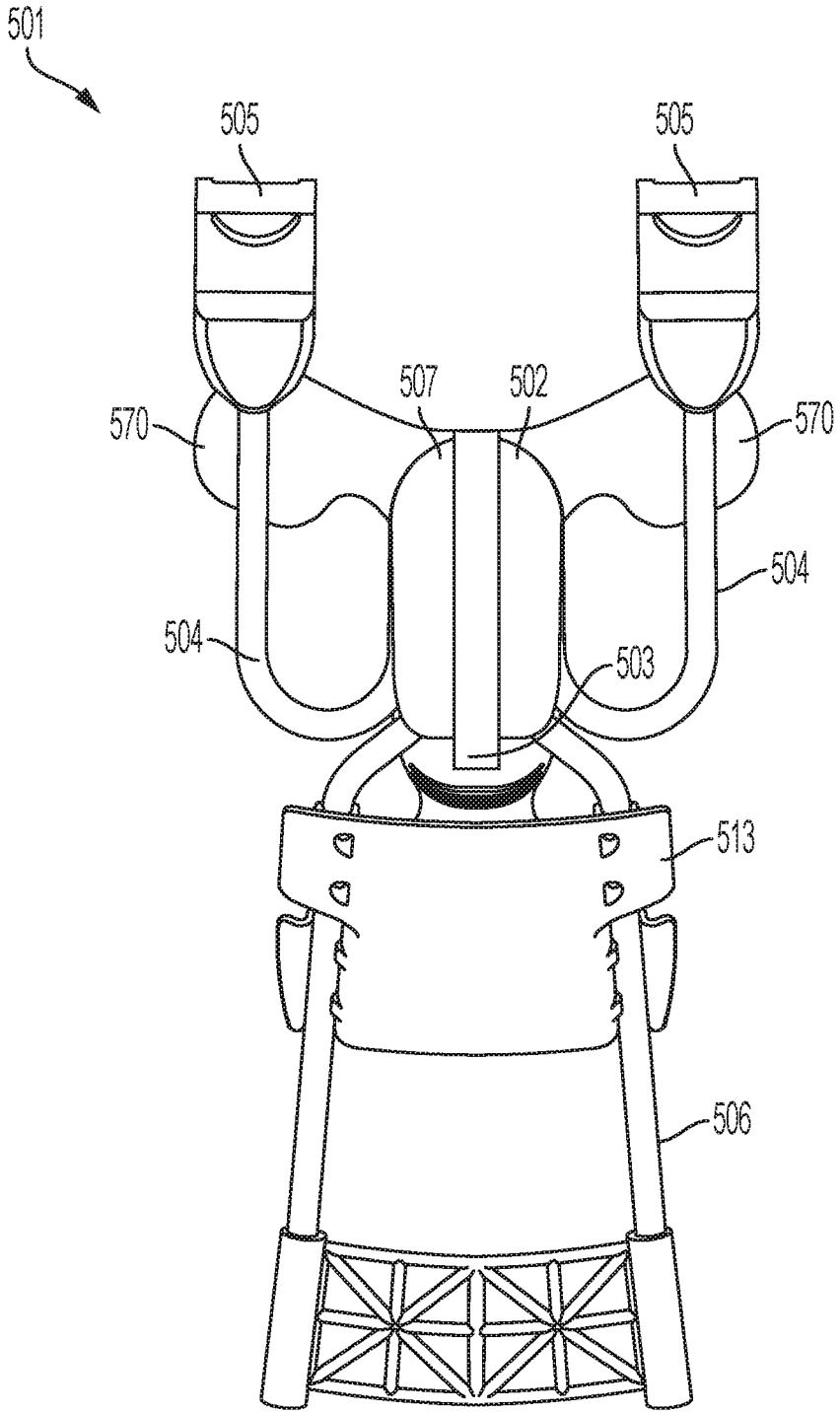
FIG. 97 is a top view of the slingshot of FIG. 91.
Figure 98:
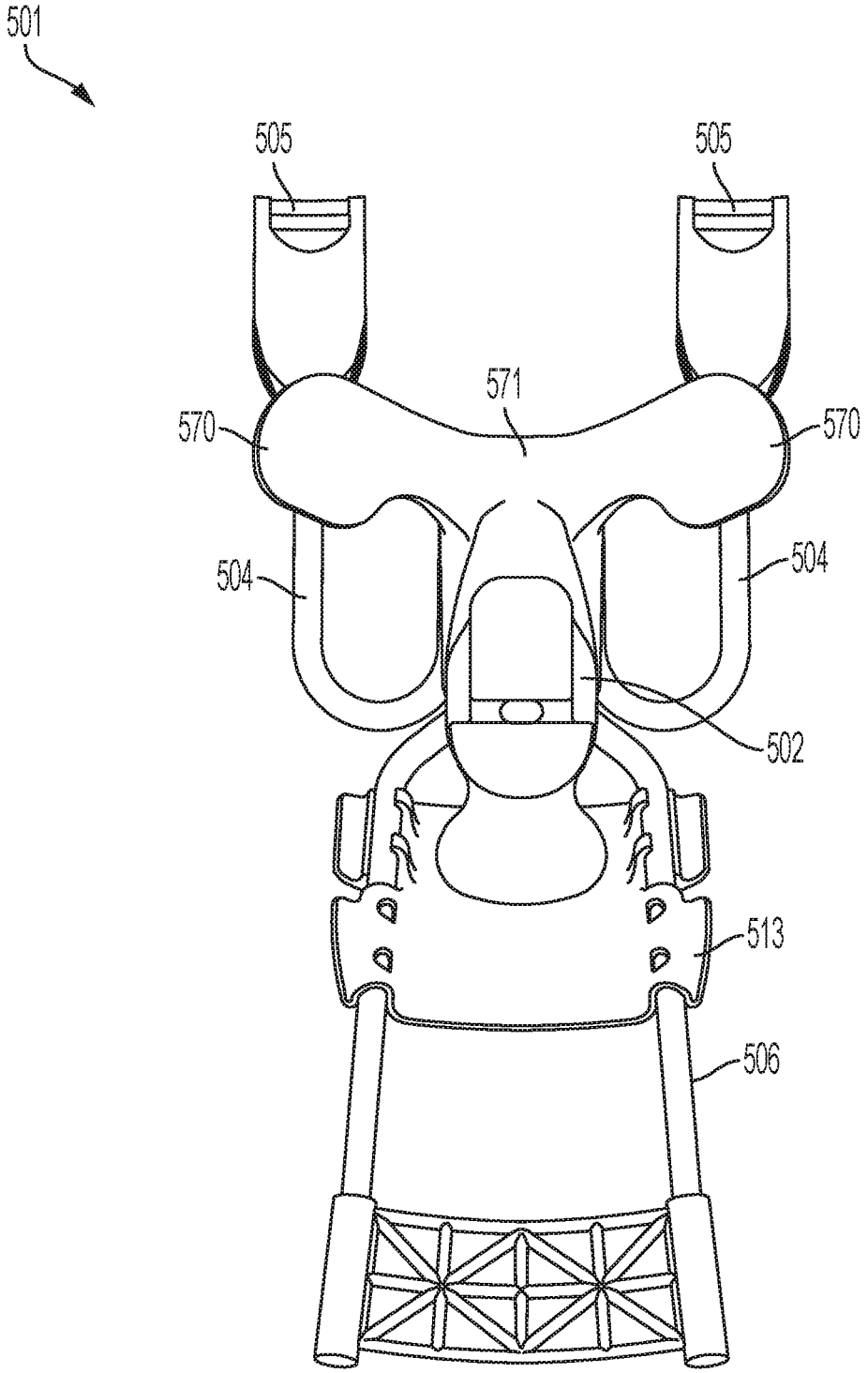
FIG. 98 is a bottom view of the slingshot of FIG. 91.
Figure 99:
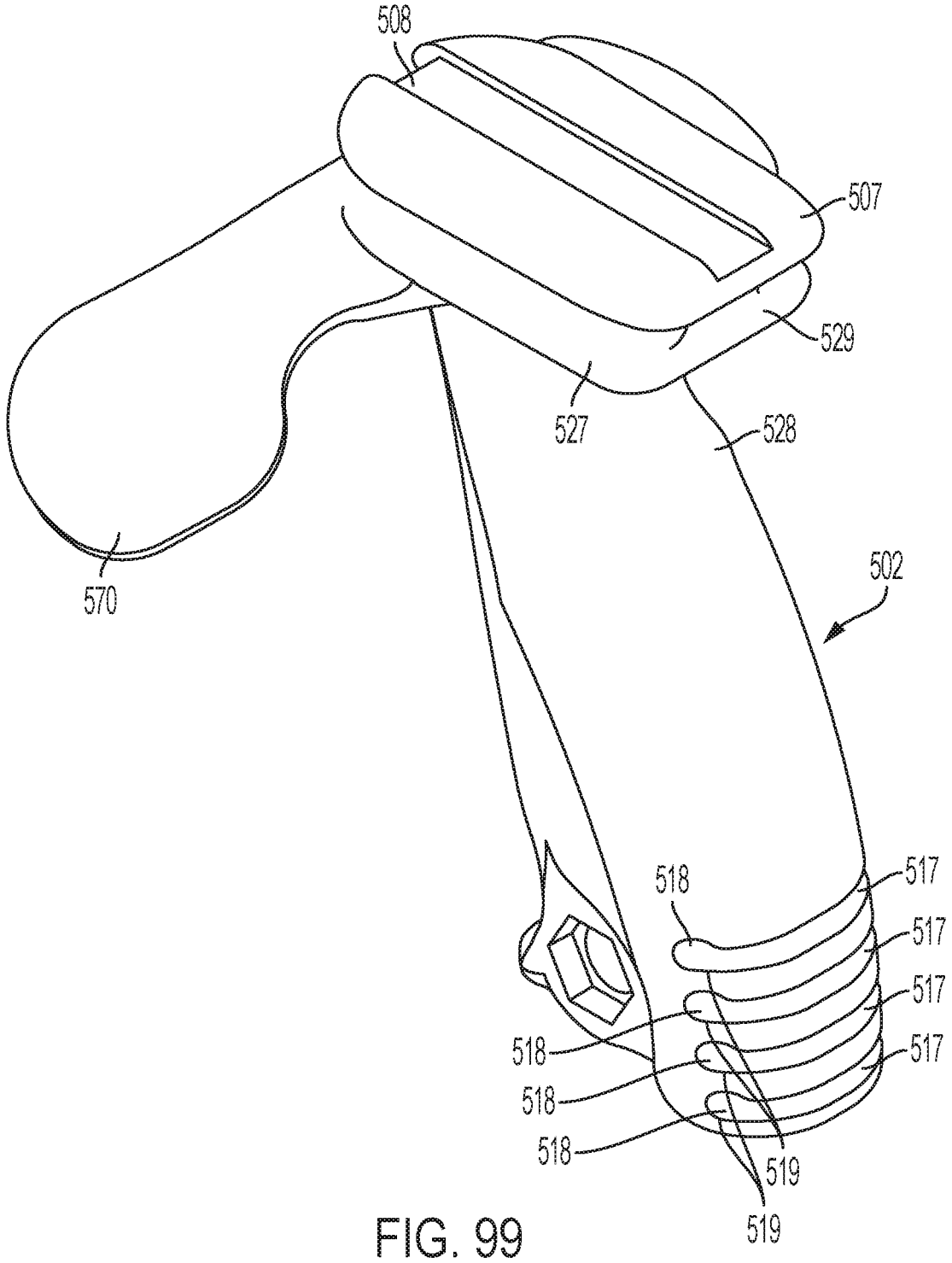
FIG. 99 is an enlarged perspective view of a handle of the slingshot in FIG. 91, according to an embodiment described herein.
Figure 100:
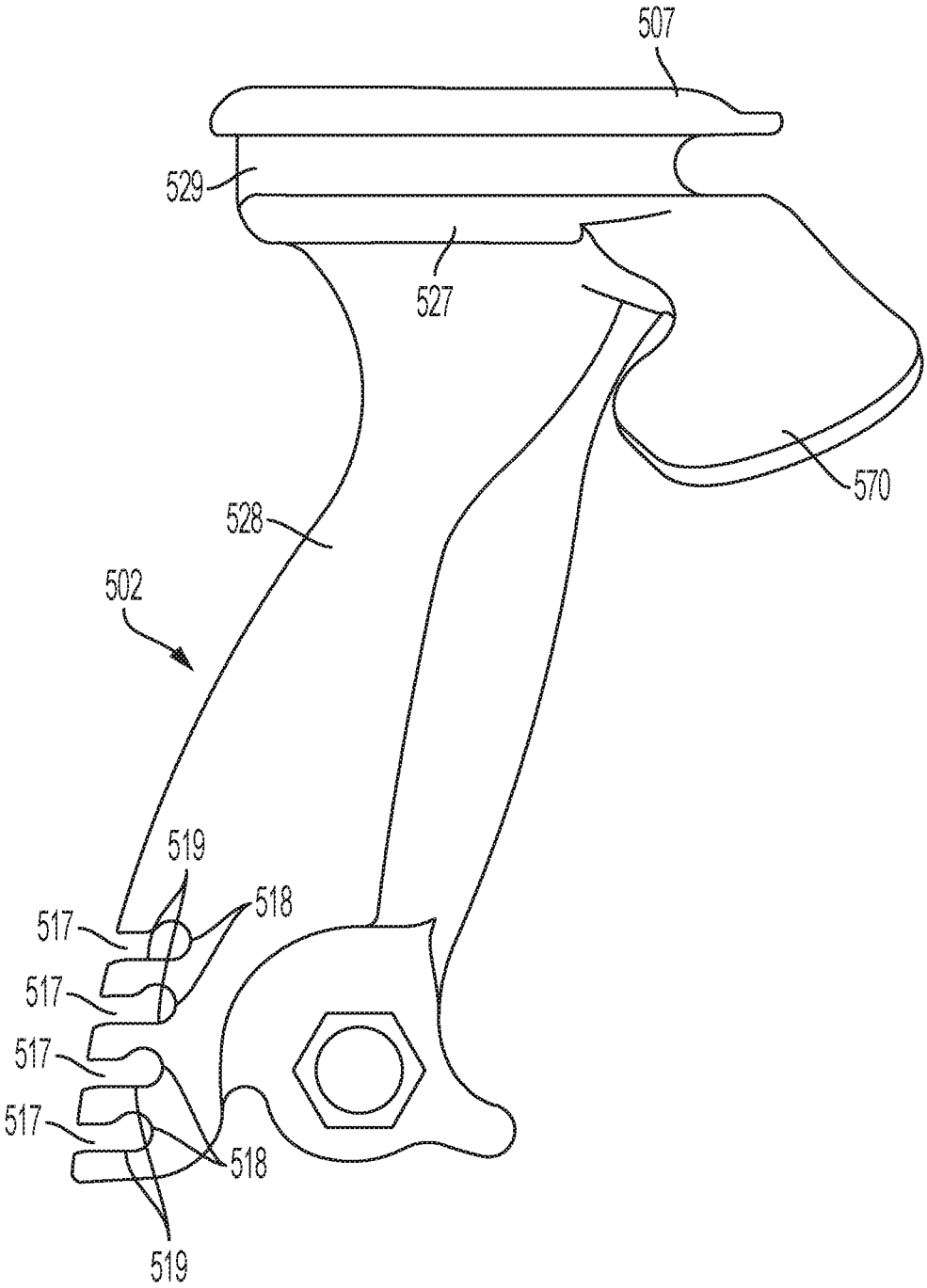
FIG. 100 is a left side view of the handle of FIG. 99.
Figure 101:
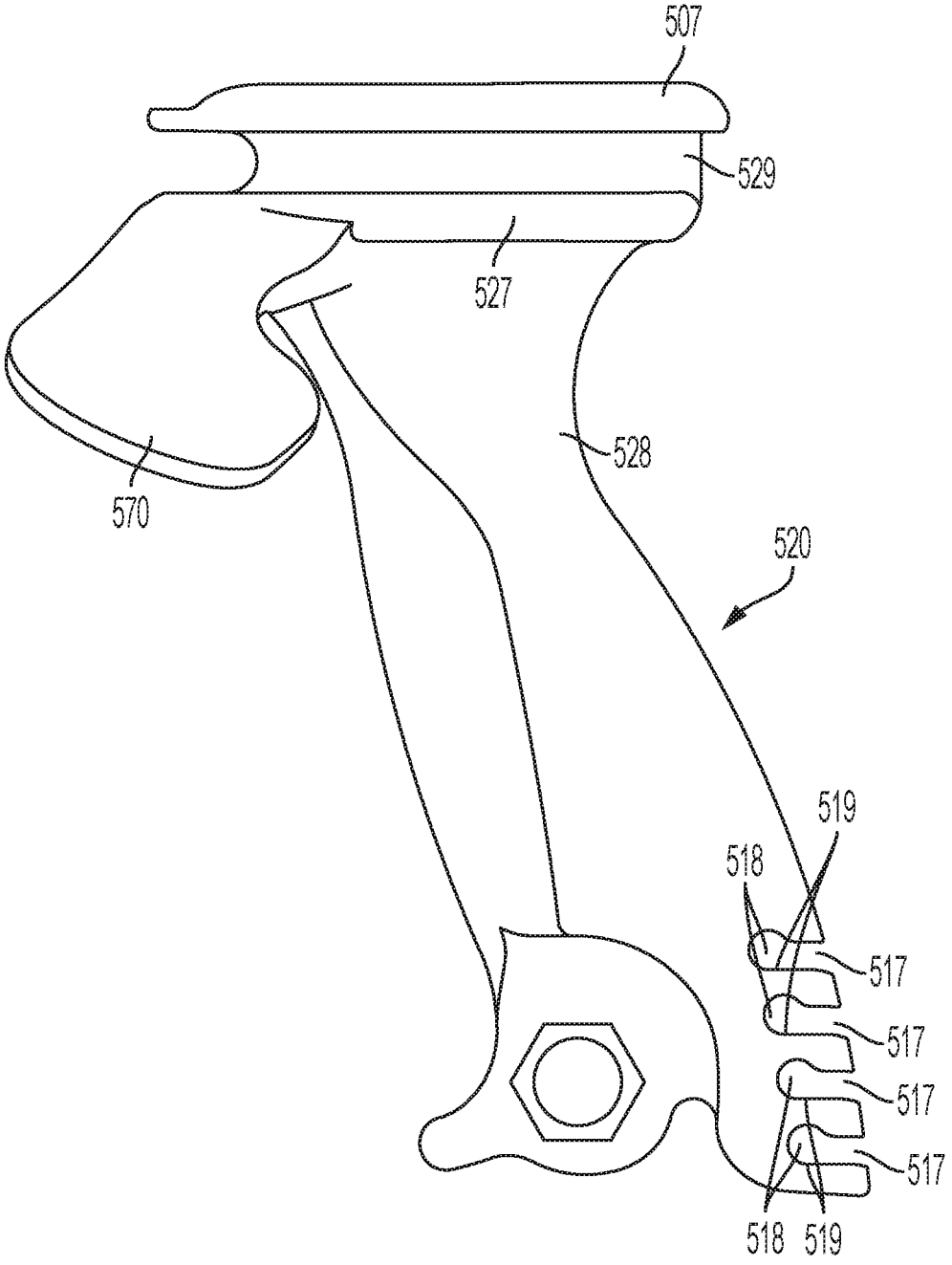
FIG. 101 is a right side view of the handle of FIG. 99.
Figure 102:
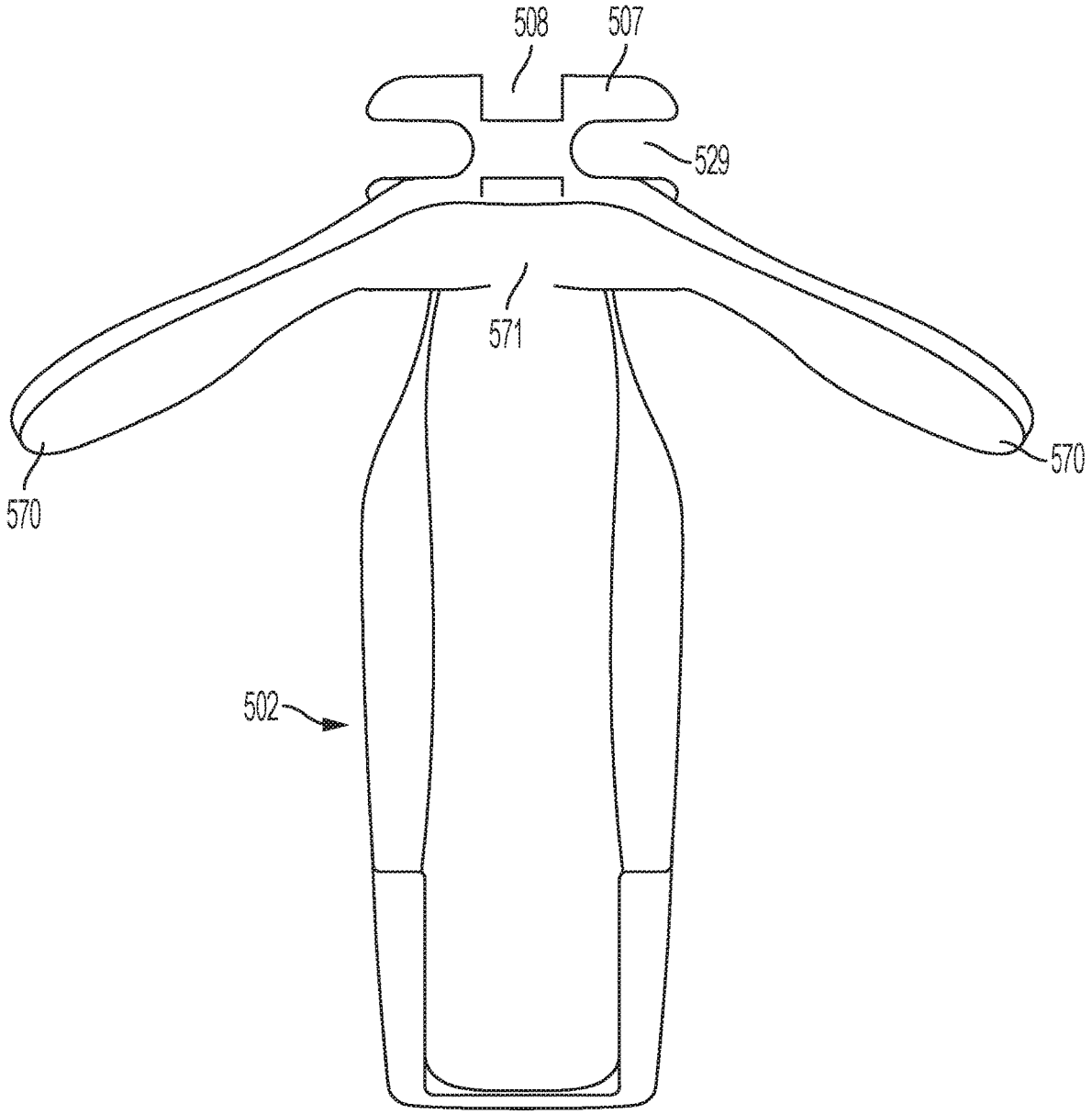
FIG. 102 is a front view of the handle of FIG. 99.
Figure 103:
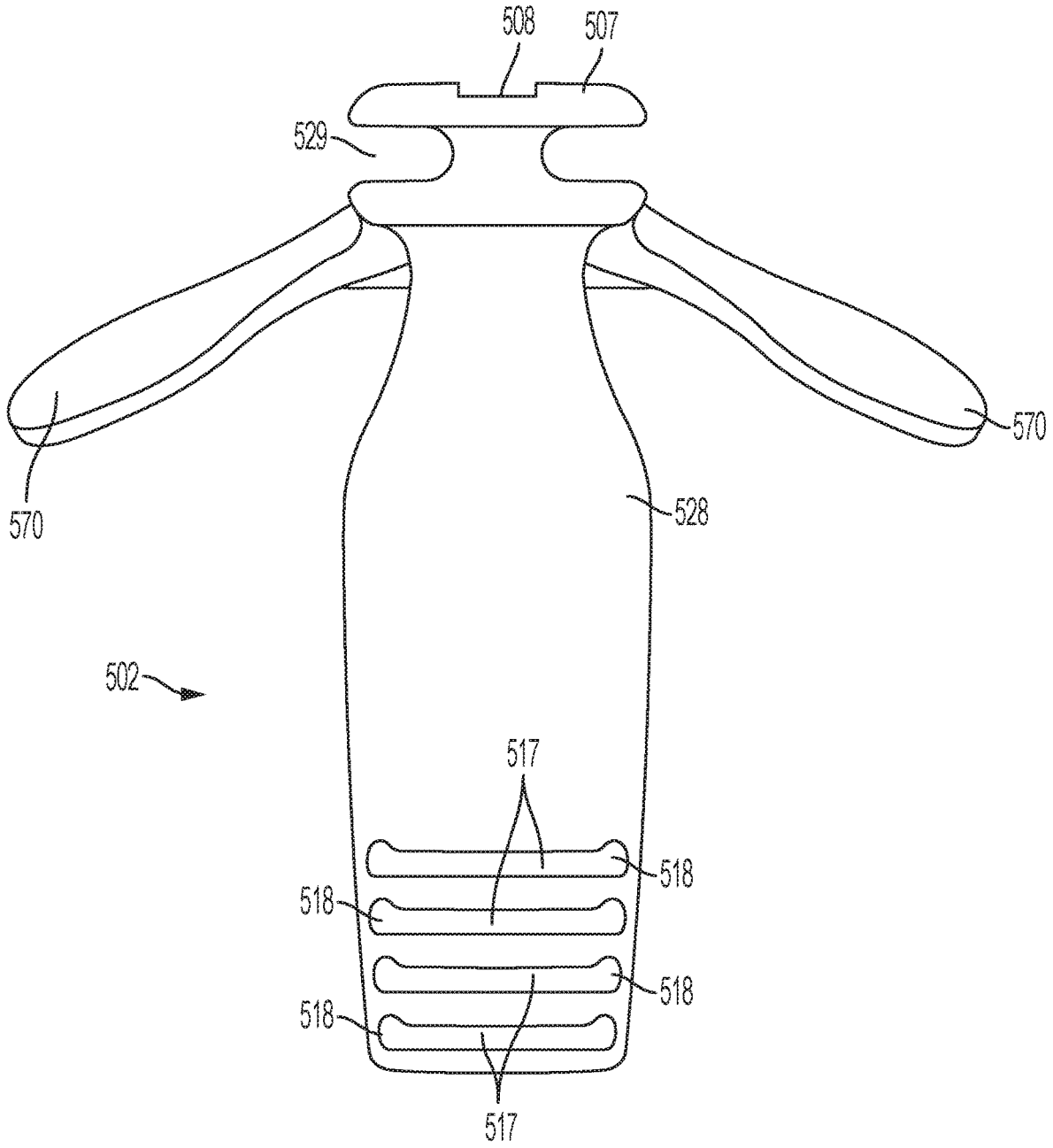
FIG. 103 is a rear view of the handle of FIG. 99.
Figure 104:
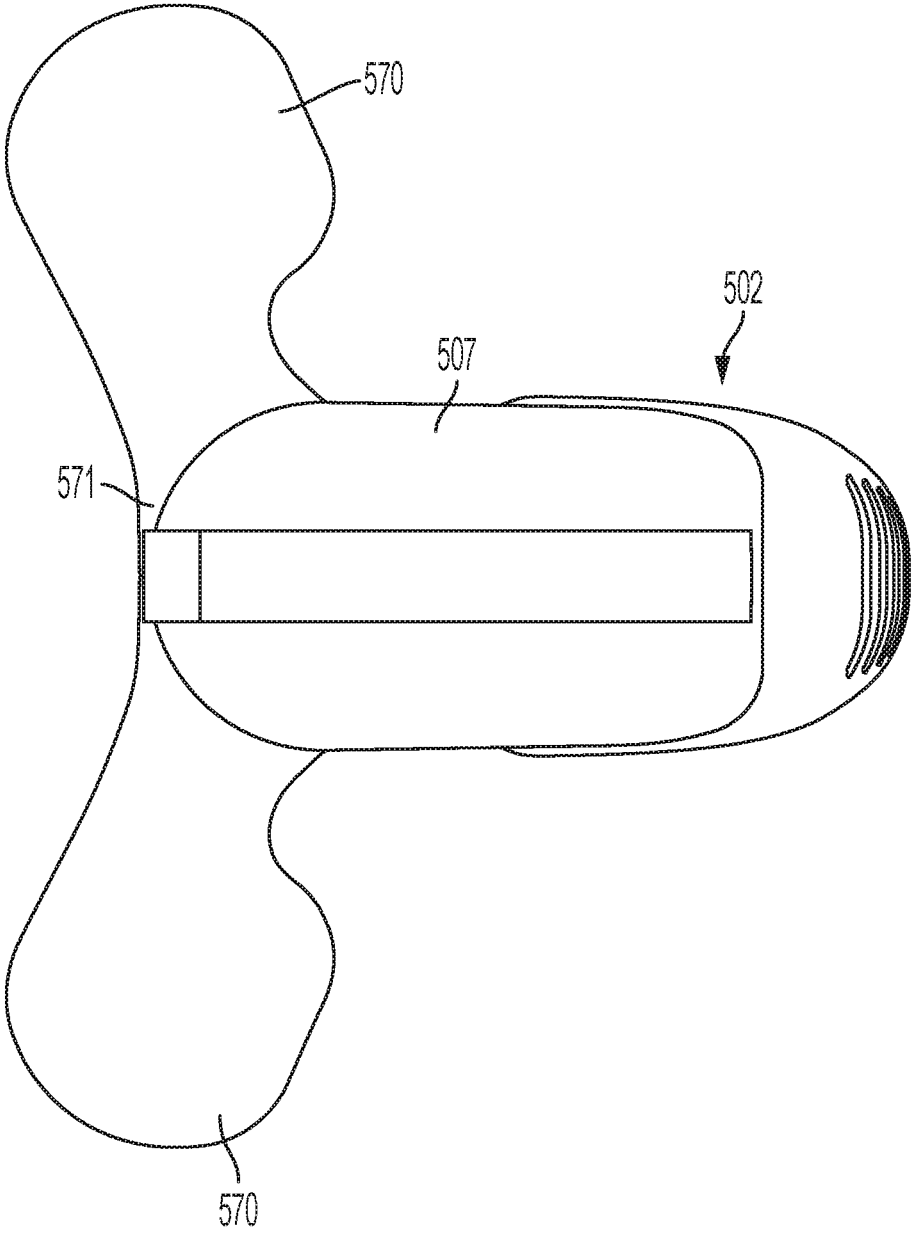
FIG. 104 is a top view of the handle of FIG. 99.
Figure 105:
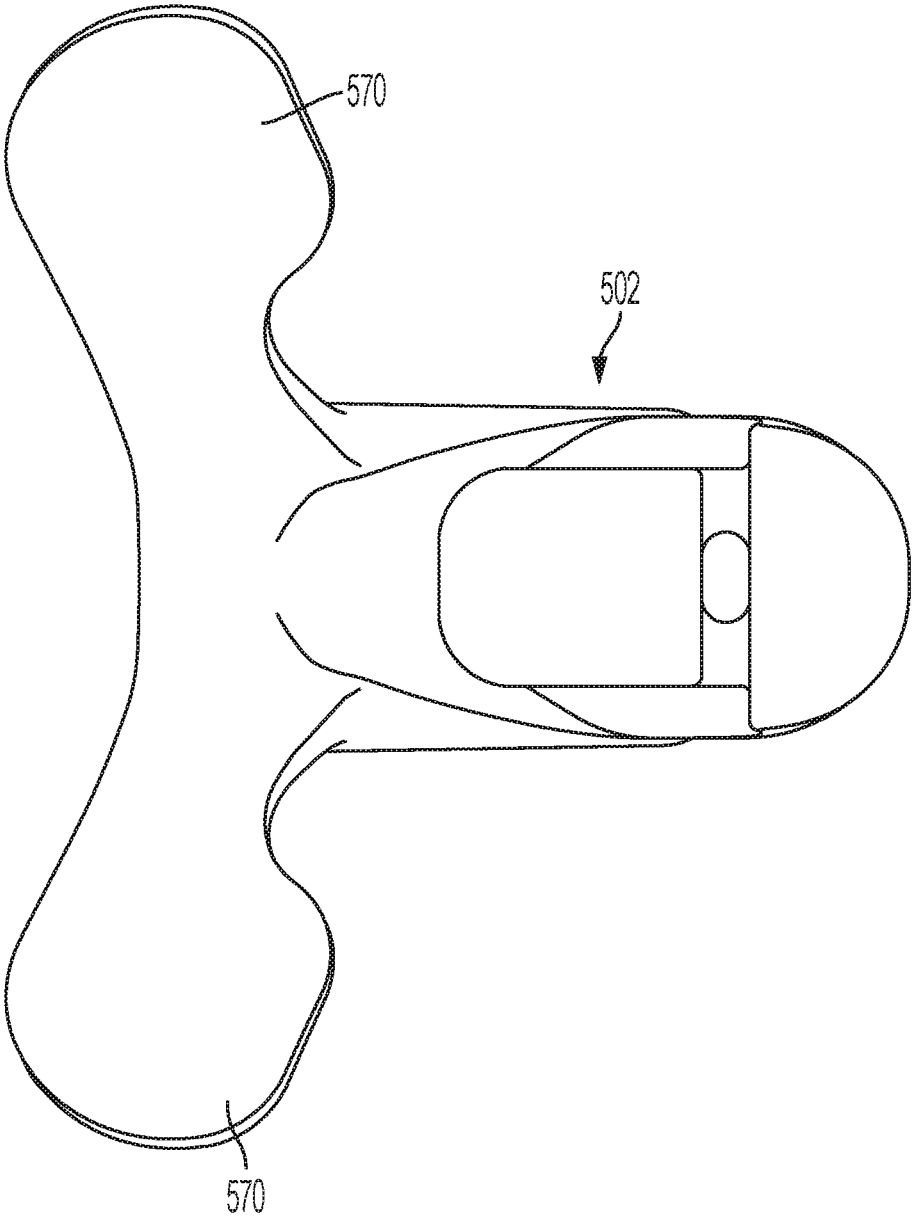
FIG. 105 is a bottom view of the handle of FIG. 99.
Figure 106:
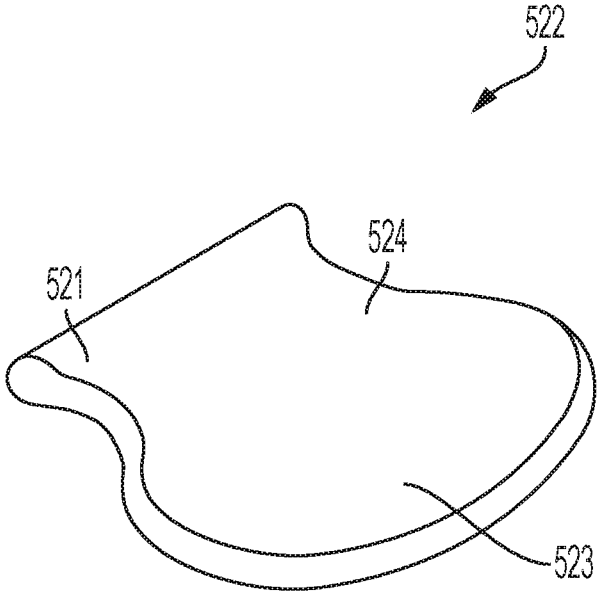
FIG. 106 is an enlarged perspective view of the palm plate of the slingshot of FIG. 91 according to an embodiment described herein.
Figure 107:
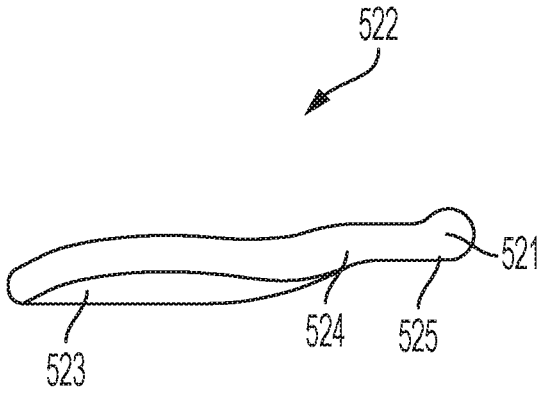
FIG. 107 is a left side view of the palm plate of FIG. 106.
Figure 108:
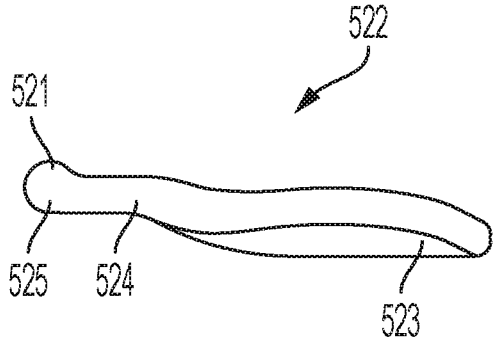
FIG. 108 is a right side view of the palm plate of FIG. 106.
Figure 109:
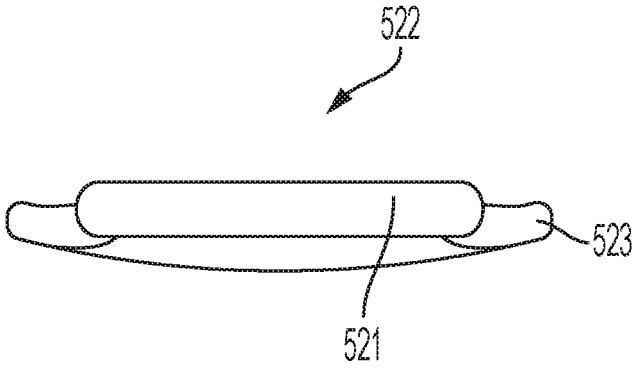
FIG. 109 is a front view of the palm plate of FIG. 106.
Figure 110:
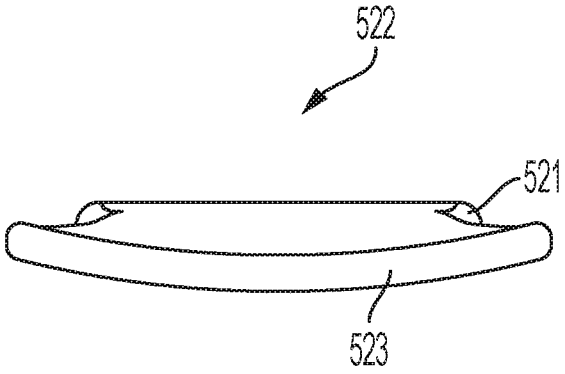
FIG. 110 is a rear view of the palm plate of FIG. 106.
Figure 111:
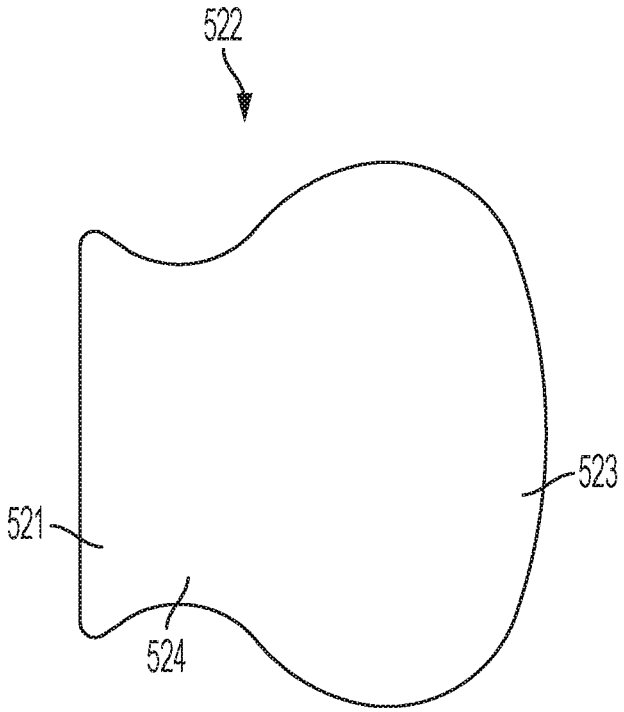
FIG. 111 is a top view of the palm plate of FIG. 106.
Figure 112:
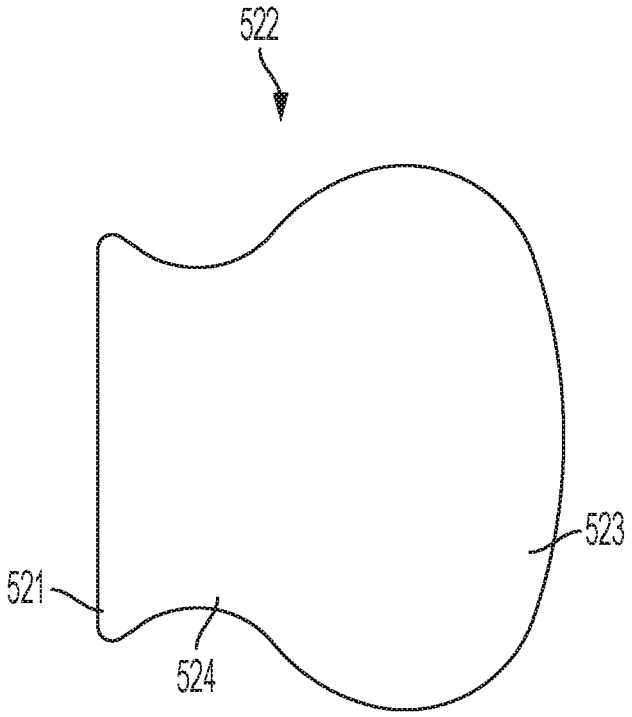
FIG. 112 is a bottom view of the palm plate of FIG. 106.
Figure 113:
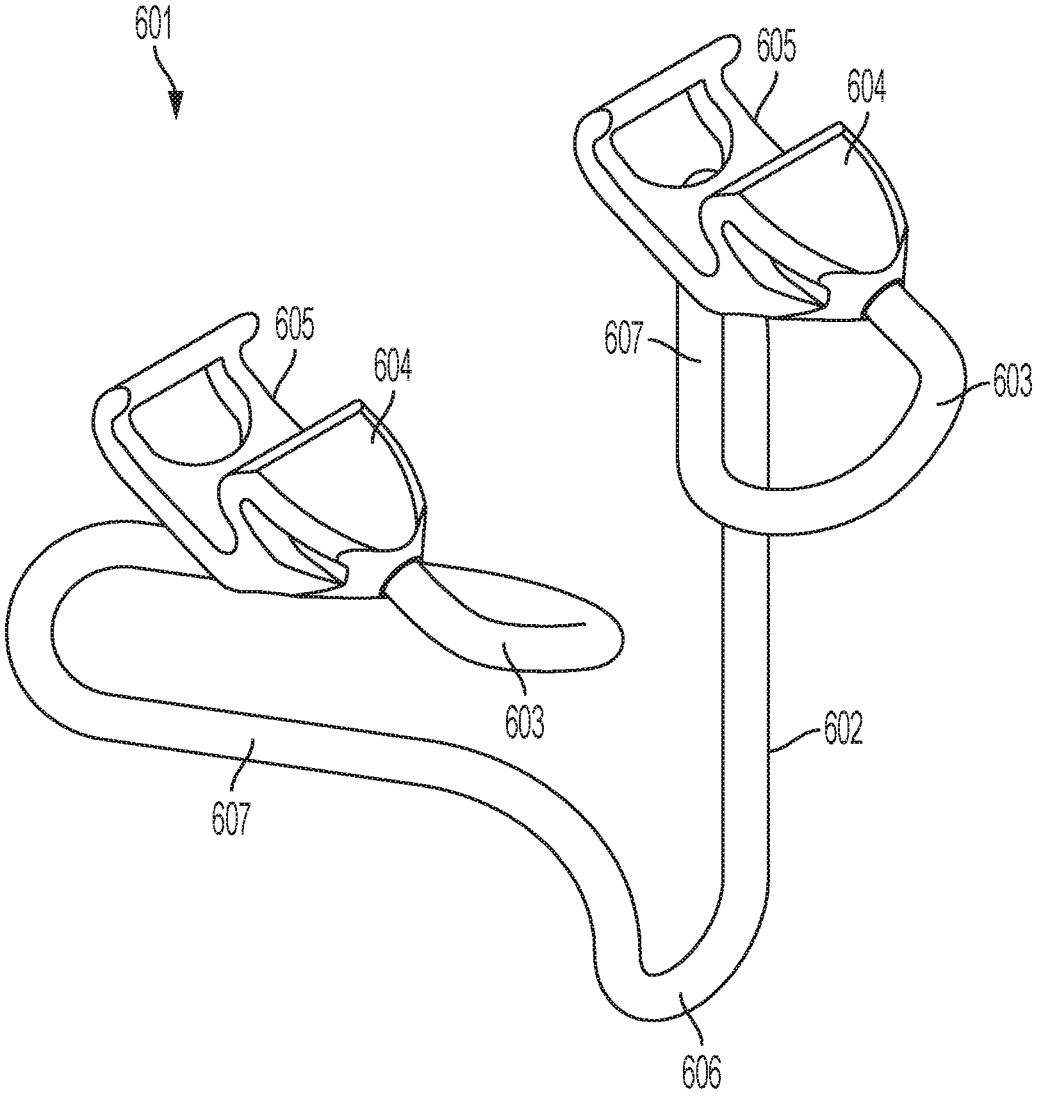
FIG. 113 is a rear perspective view of a slingshot according to another embodiment described herein.
Figure 114:
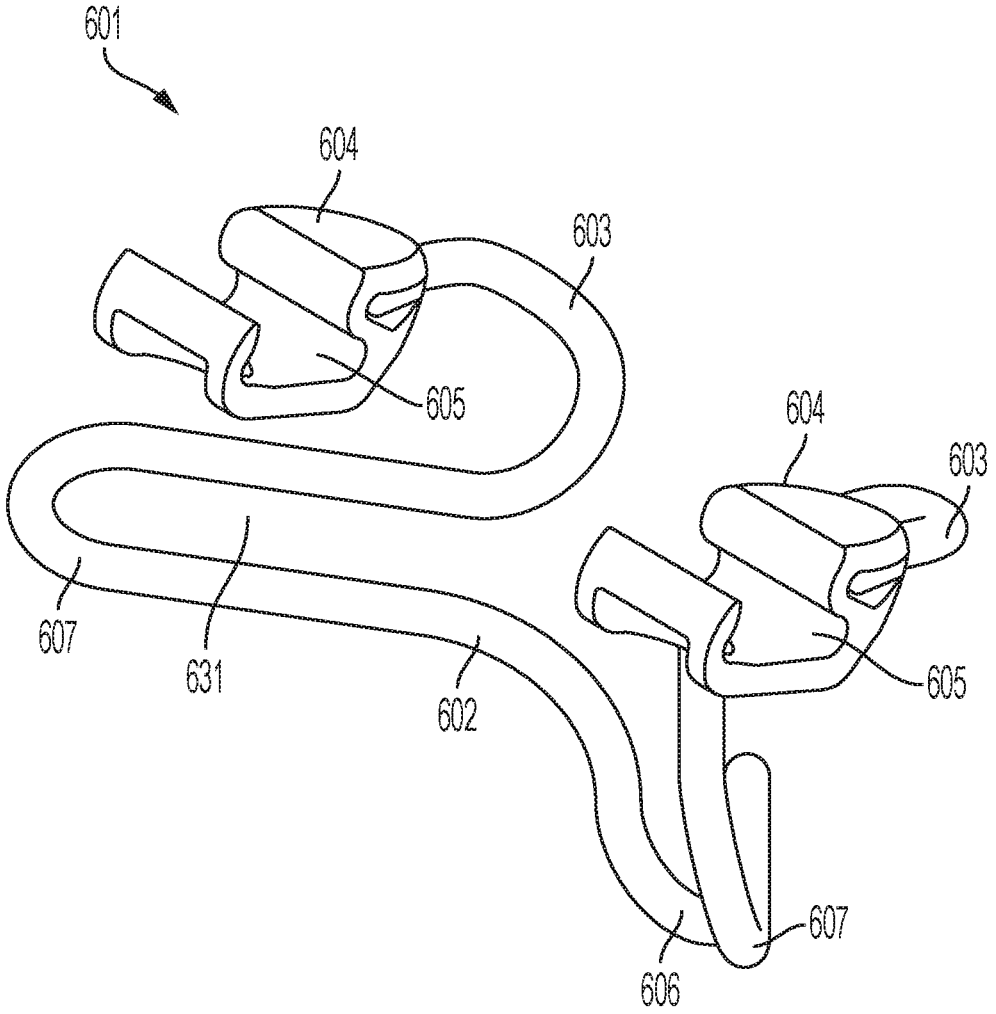
FIG. 114 is a front perspective view of the slingshot of FIG. 113.
Figure 115:
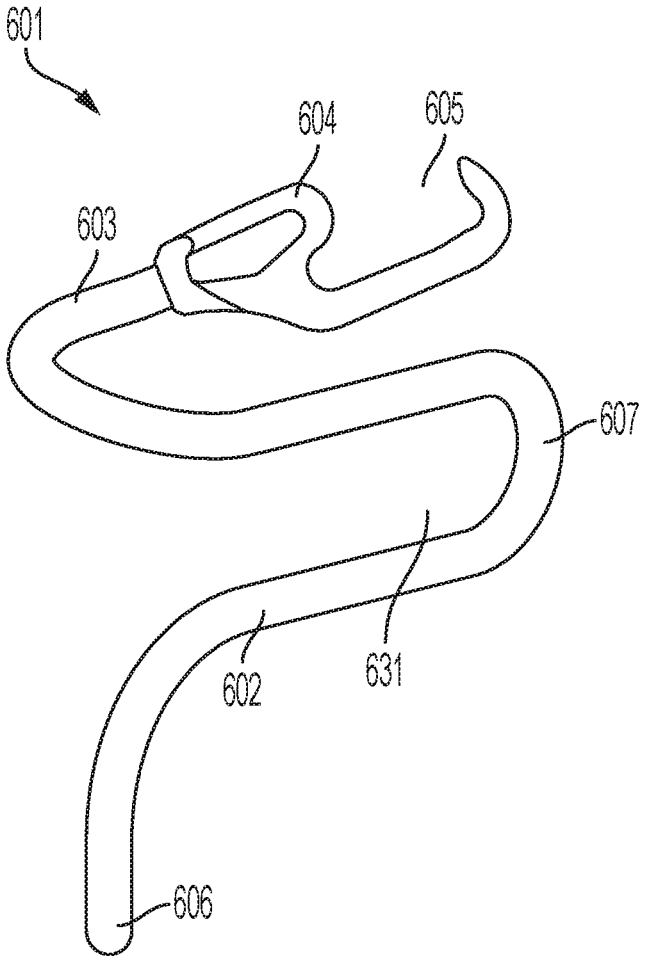
FIG. 115 is a left side view of the slingshot of FIG. 113.
Figure 116:
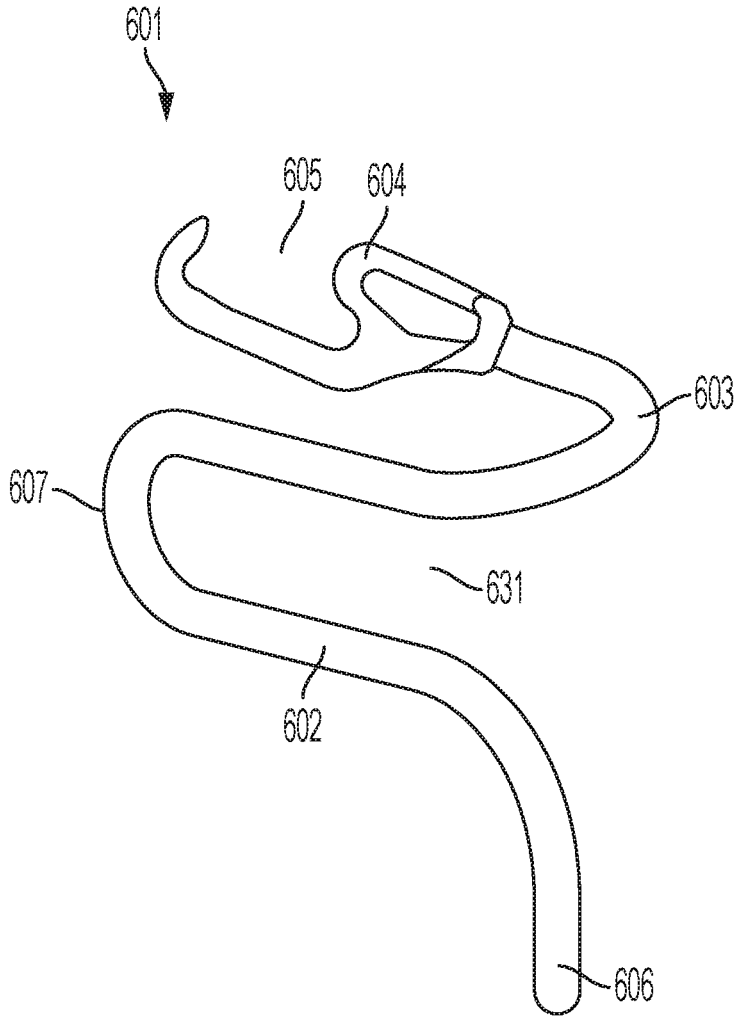
FIG. 116 is a right side view of the slingshot of FIG. 113.
Figure 117:
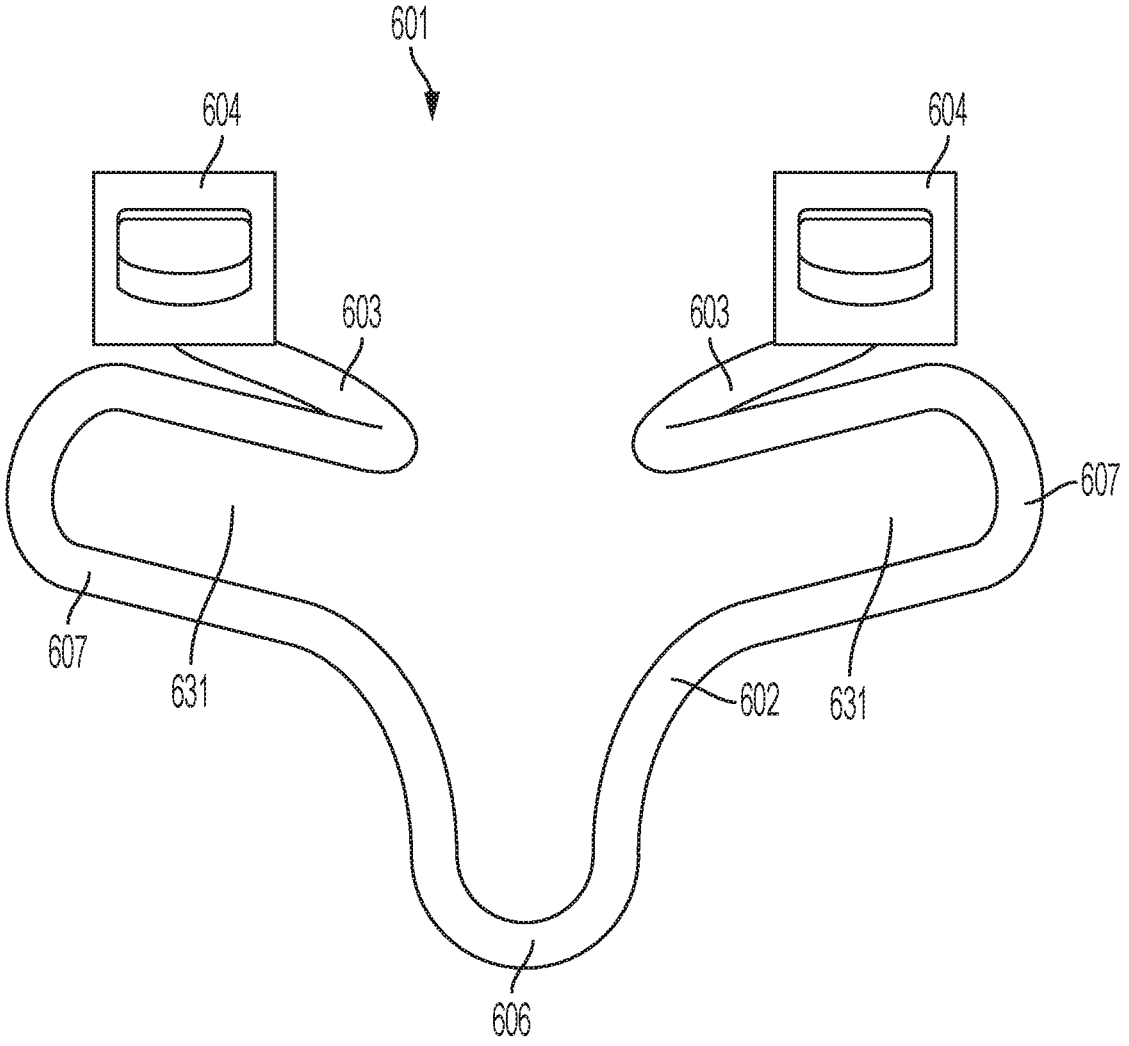
FIG. 117 is a front view of the slingshot of FIG. 113.
Figure 118:
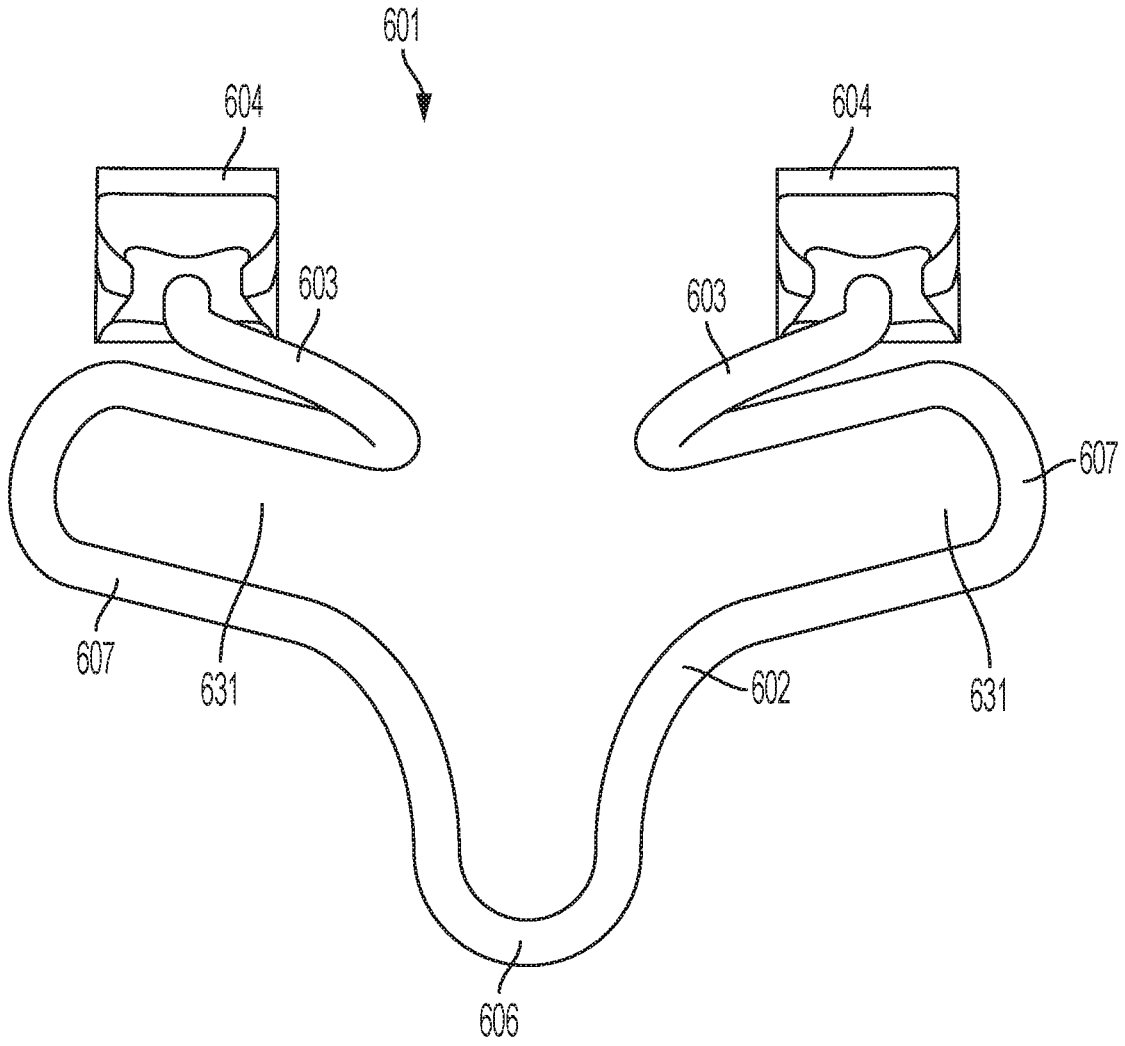
FIG. 118 is a rear view of the slingshot of FIG. 113.
Figure 119:
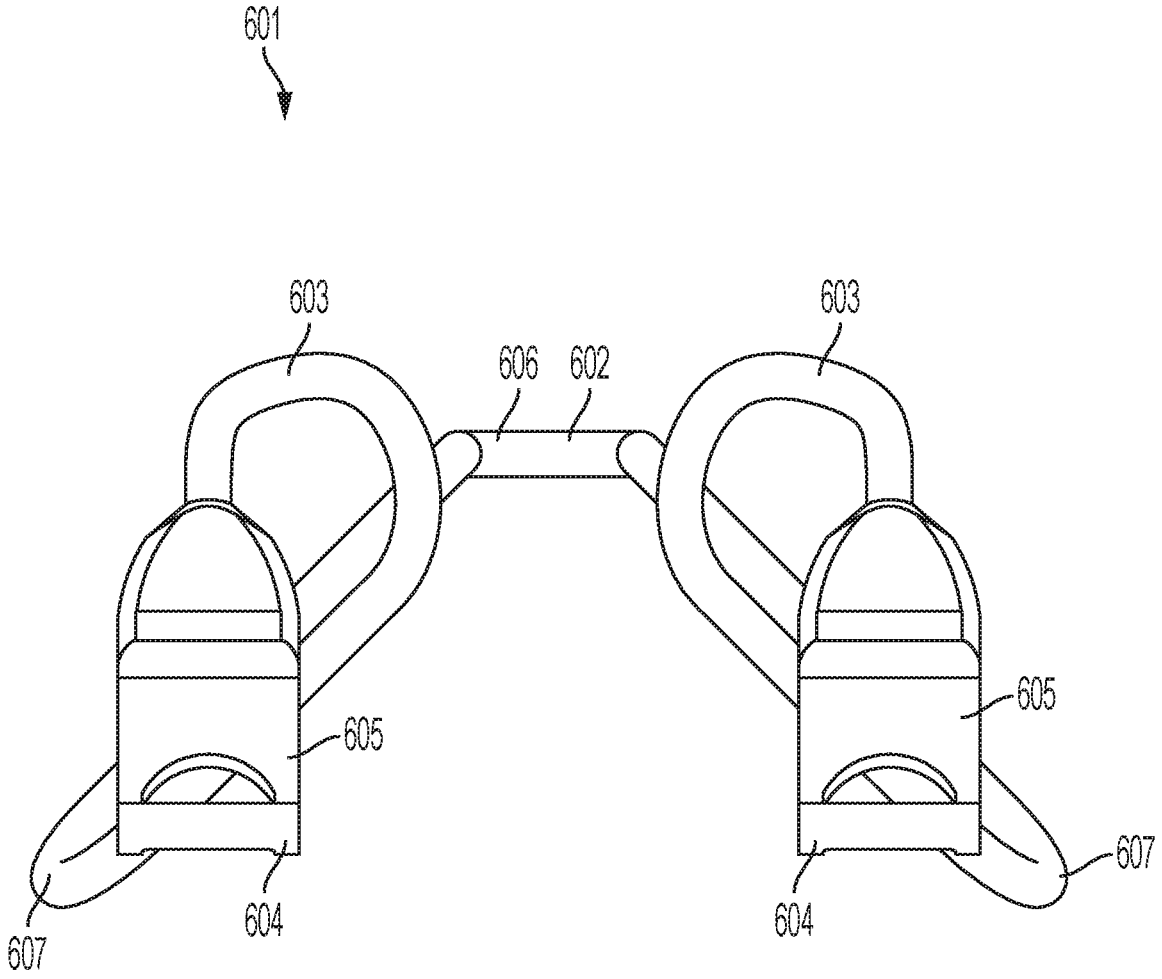
FIG. 119 is a top view of the slingshot of FIG. 113.
Figure 120:
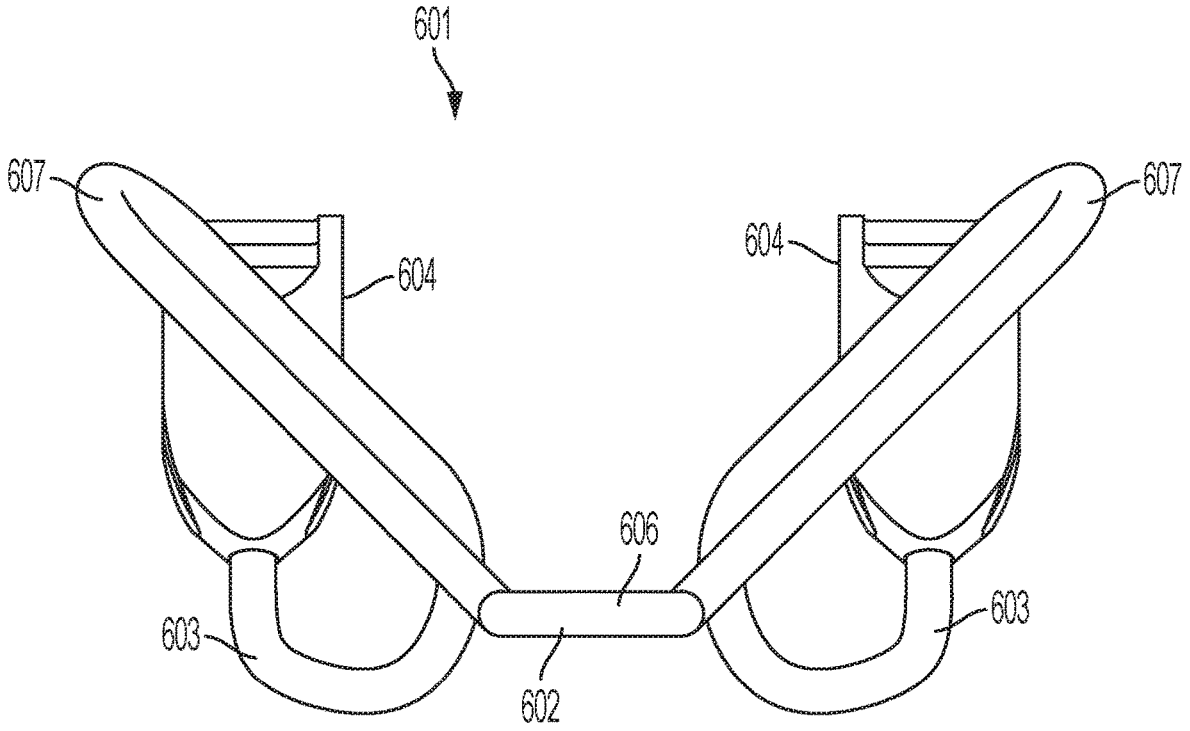
FIG. 120 is a bottom view of the slingshot of FIG. 113.

Referring further to FIGS. 91-105, in one embodiment, the handle 502 includes a pair of wings 570. The wings 570 may be positioned generally opposite of each other and may extend, at least in part, laterally outward and forward from the handle 502. The wings 570 may also be positioned at or just below the flat top 507. In one embodiment, as shown in FIGS. 95 and 96, for example, the wings 570 may be angled downwardly from a center section 571 at the handle 502. The wings 570 are configured to be used as resting points or supports for a user's thumb and finger, for example, an index finger. That is, when gripping the handle 502 of the slingshot 501, the user may position their thumb on one of the wings 570 and their index finger on the other wing 570. Thus, the user's thumb and/or fingers may support the slingshot 501 via the wings 570. The user's palm and other fingers may be disposed on the gripping portion 528 of the handle 502. By gripping the handle 502 as described above, the user's thumb, index finger, palm and other fingers may be positioned substantially away from a travel path a slingshot band during a recoil motion, such that the band may avoid contact with the user's hand. Accordingly, the slingshot 501, may be provided without a handle guard, which may allow for easier assembly and reduce likelihood of improper assembly. In addition, omitting the handle guard may provide a lighter and less bulky slingshot.

Figure 93:
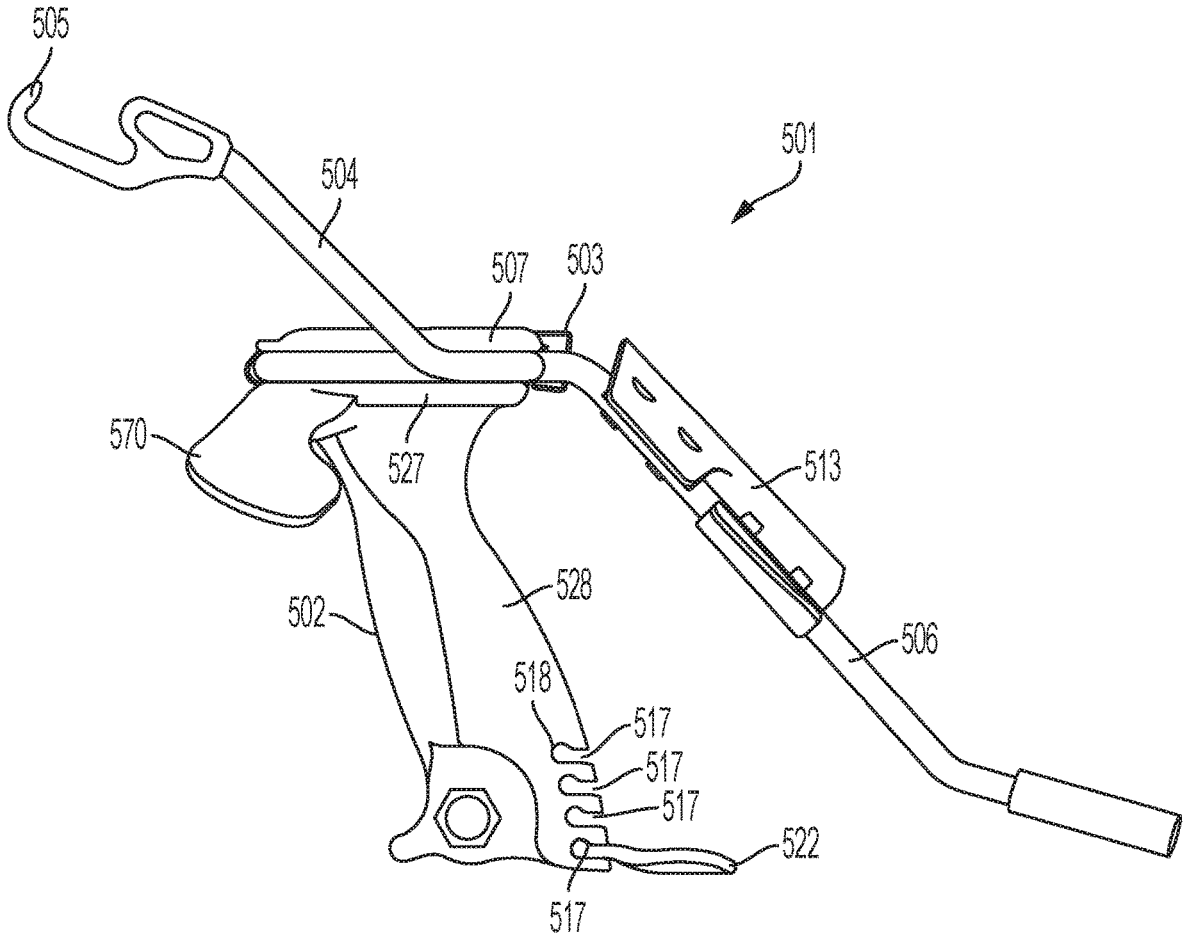
FIG. 93 is a right side view of the slingshot of FIG. 91 having a palm plate in a first position.
Figure 94:
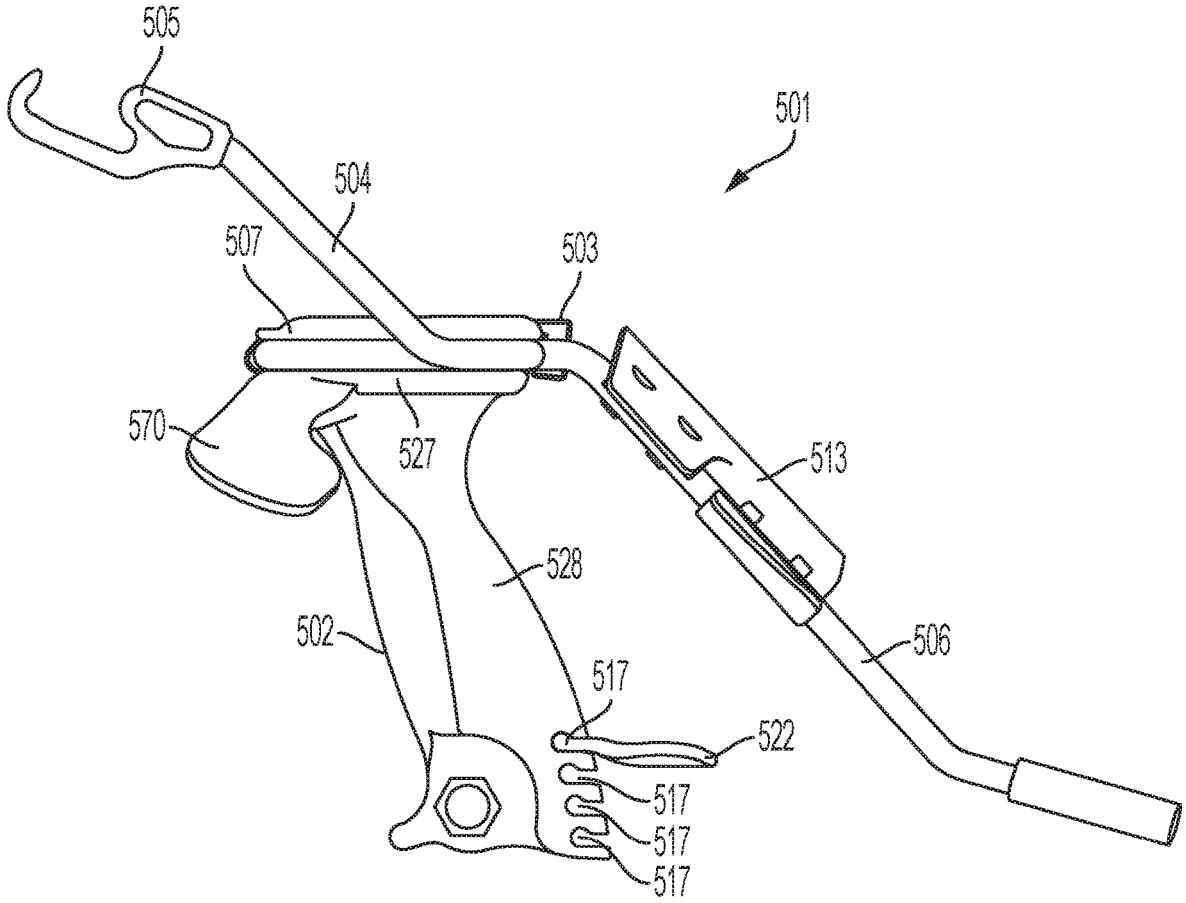
FIG. 94 is a right side view of the slingshot of FIG. 91 having the palm plate in a second position.

Referring to FIGS. 91-94, the slingshot 501 may also include a palm plate 522 configured for placement at different positions along a length of the handle 502 in the different positioning elements or grooves 517. For example, as shown in FIG. 93, the palm plate 522 may be removably secured in the lowermost positioning element 517. Referring to FIG. 94, the palm plate 522 may be removed from the lowermost positioning element 517 and secured in another positioning element, such as the uppermost positioning element 517. Accordingly, the palm plate 522 may be positioned at different lengths along handle 502 to accommodate users having different hand sizes.

In one embodiment, the palm plate 522 and the positioning elements 517 may be formed substantially the same as the palm plate 22 and positioning elements 17 described in the embodiments above, or the palm plate 222 and positioning elements 217 described in the embodiments above.

With reference to FIGS. 106-112, in one embodiment, the palm plate 522 may have a body 523, an intermediate lip 524 and an enlarged tongue 521. The enlarged tongue 521 is configured to be received, separately, in each of the positioning elements 517 to removably secure the palm plate 522 to the handle 502. In one embodiment, the enlarged tongue 521 is configured to engage the channel section 518 of the positioning elements 517. Thus, the palm plate 522 may be removably secured in a positioning element 517 by way of, for example, a positive interlock and/or a friction fit between the palm plate 522 and the positioning element 517. In one embodiment, the positive interlock and/or friction fit may be formed, at least in part, between the enlarged tongue 521 and the channel section 518. In one embodiment, the palm plate 522 may be inserted or removed from a positioning element 517 by laterally moving the palm plate 522 through the positioning element 517, relative to the handle 502.

Figure 46:
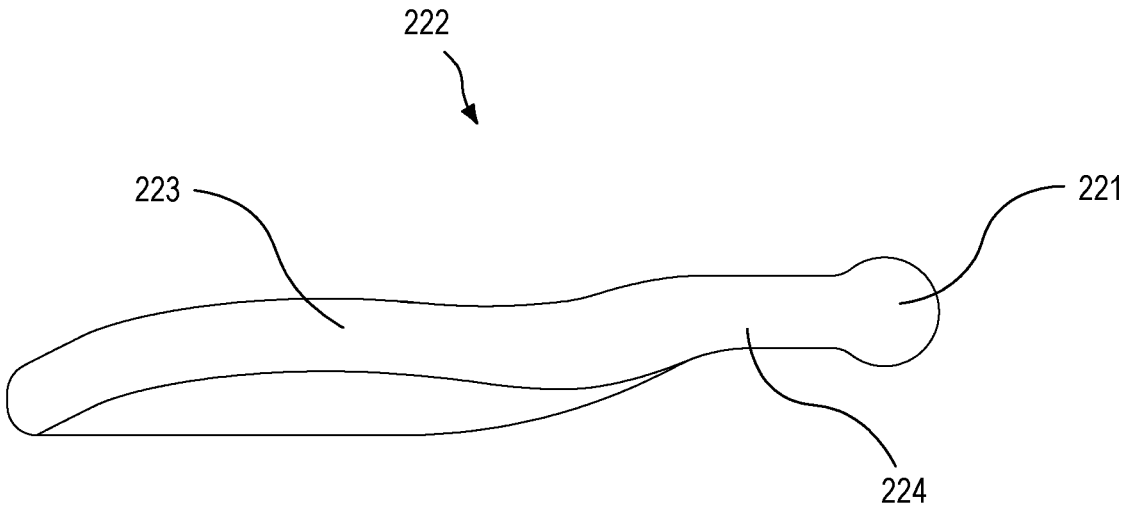
FIG. 46 is a left side view of the palm plate of FIG. 43.
Figure 47:
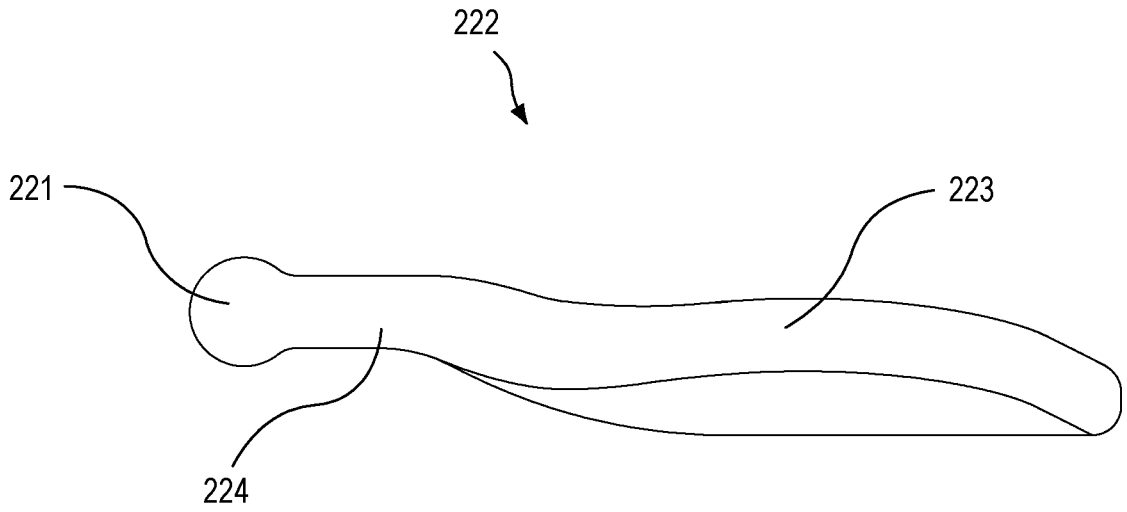
FIG. 47 is a right side view of the palm plate of FIG. 43.
Figure 48:
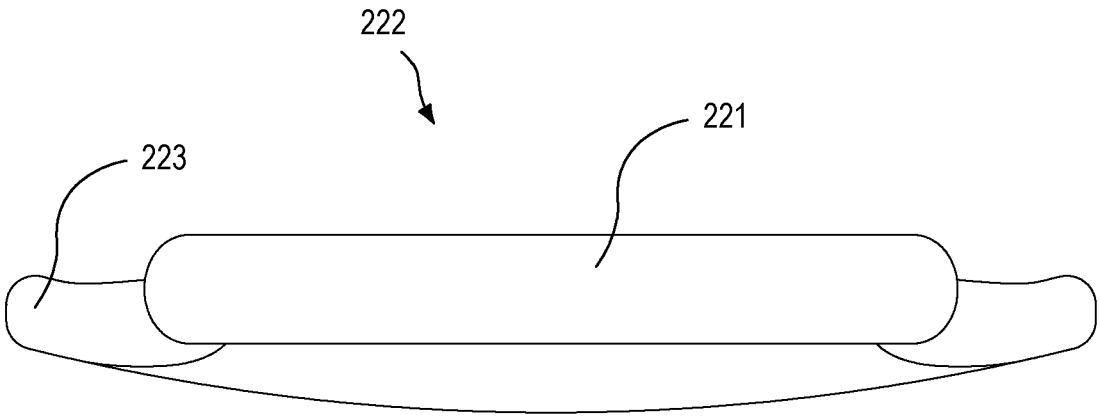
FIG. 48 is a front view of the palm plate of FIG. 43.
Figure 49:
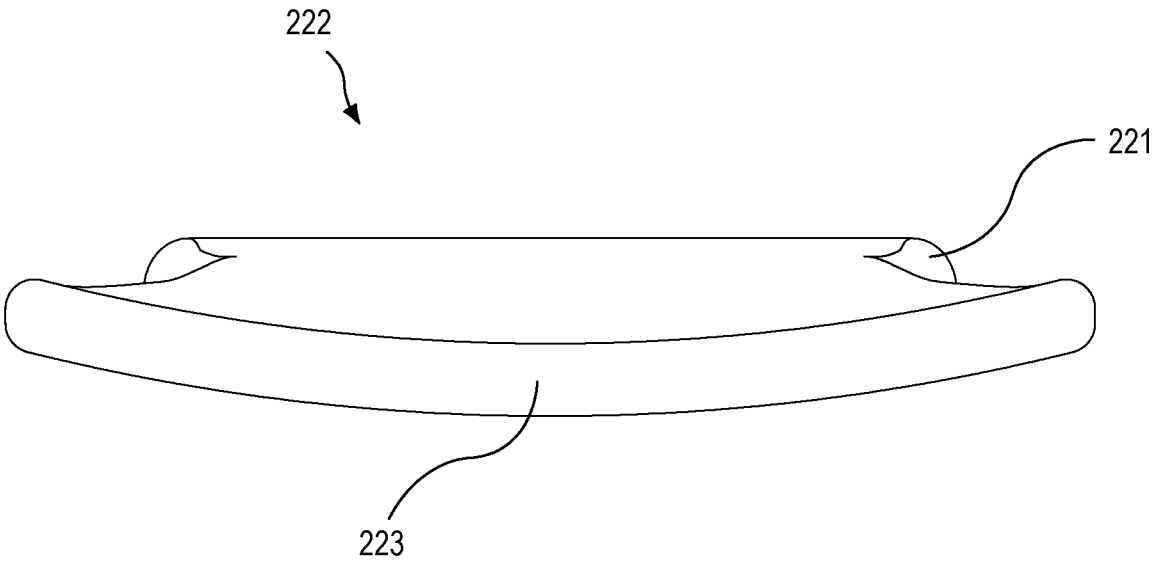
FIG. 49 is a rear view of the palm plate of FIG. 43.
Figure 50:
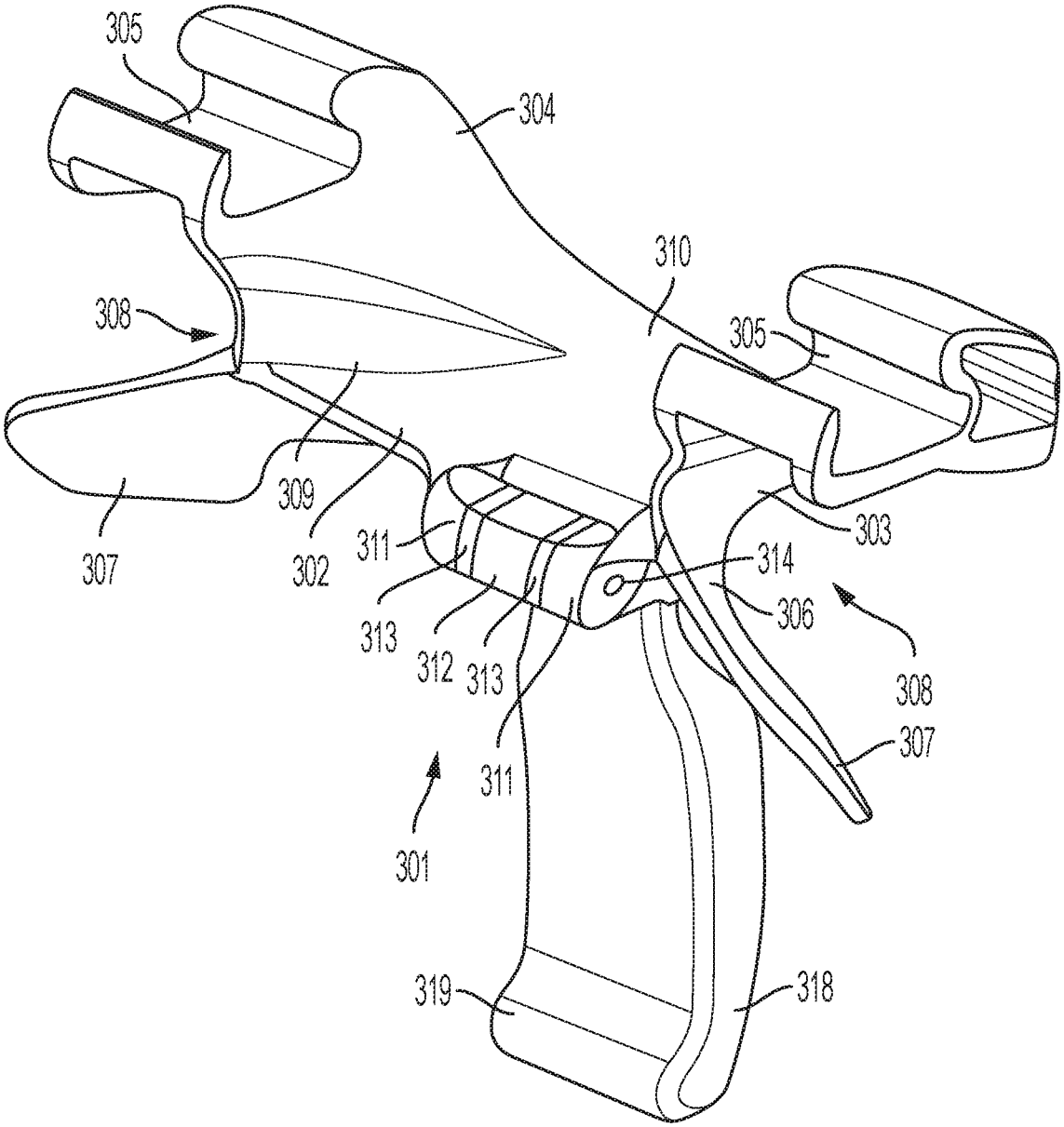
FIGS. 50 and 64 are front perspective views of a handleless slingshot with folding storage compartment according to one embodiment.
Figure 51:
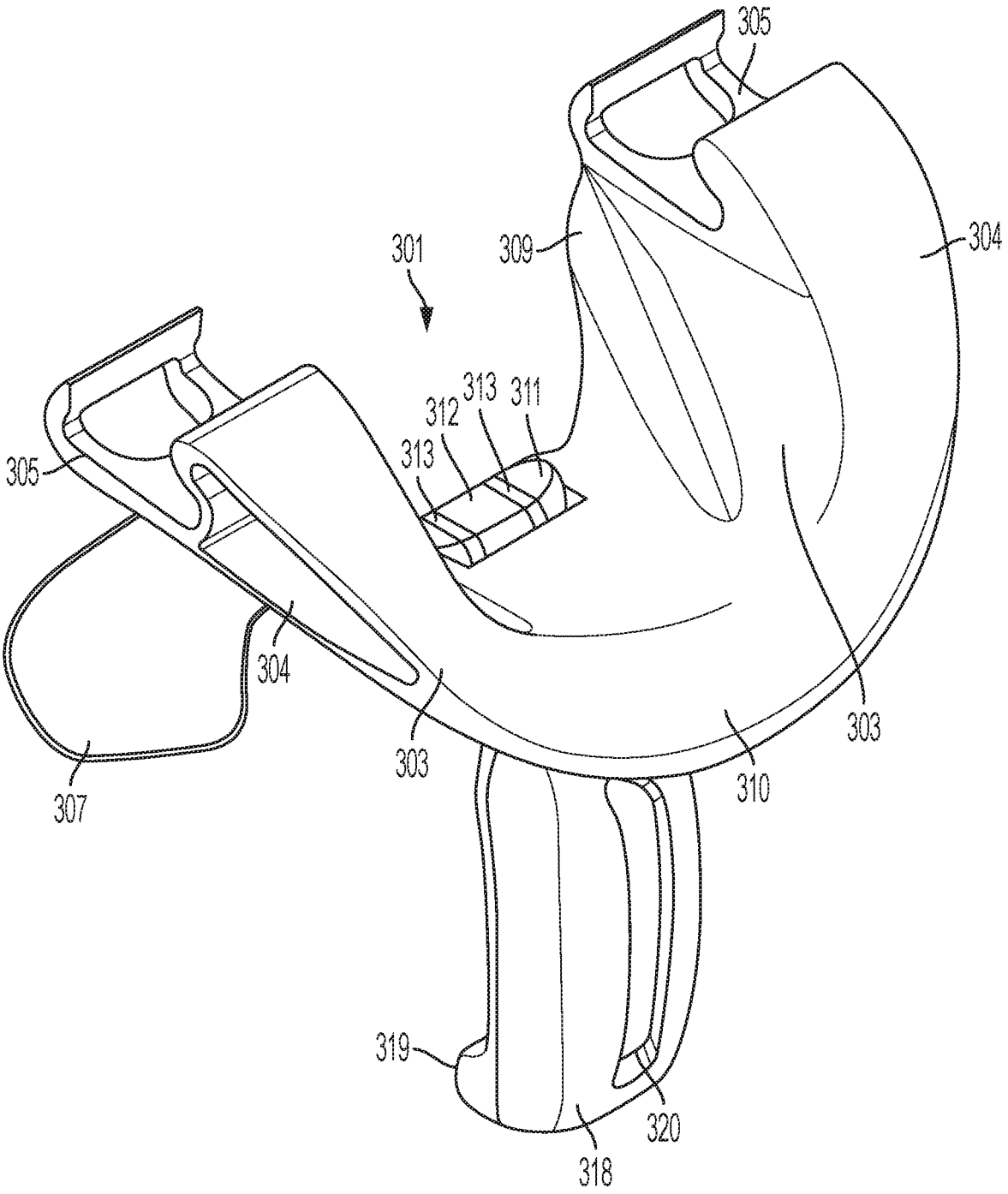
FIG. 51 is a rear perspective view of the handleless slingshot of FIGS. 50 and 64.
Figure 52:
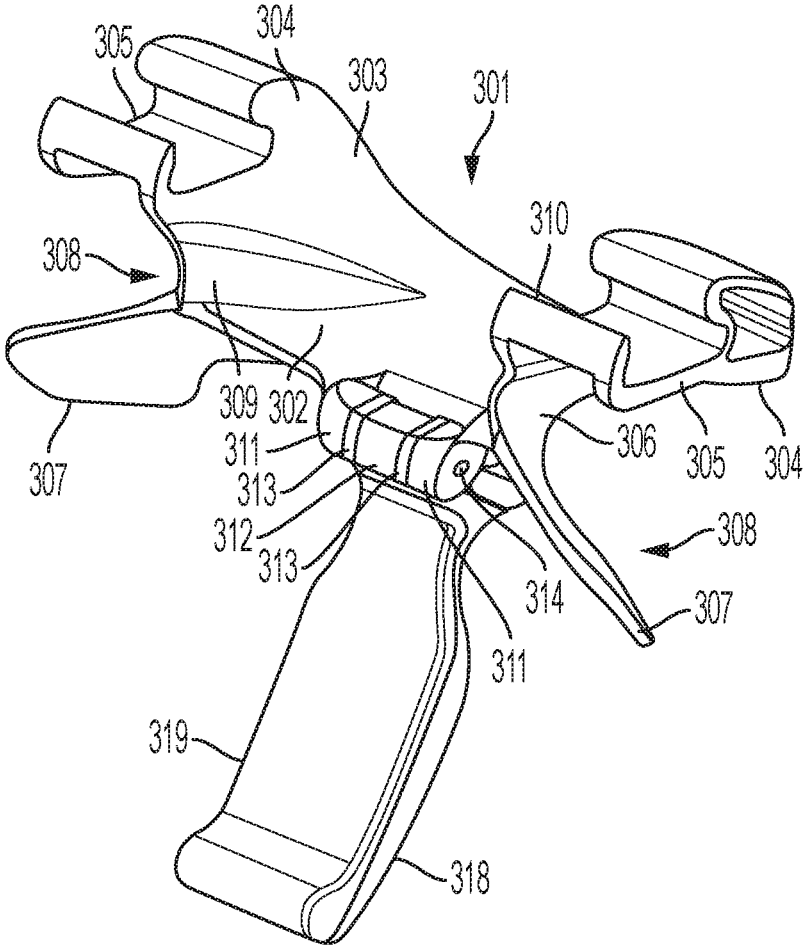
FIG. 52 is a front perspective view of the handleless slingshot of FIGS. 50 and 64, with the folding storage compartment in a partially folded position.
Figure 53:
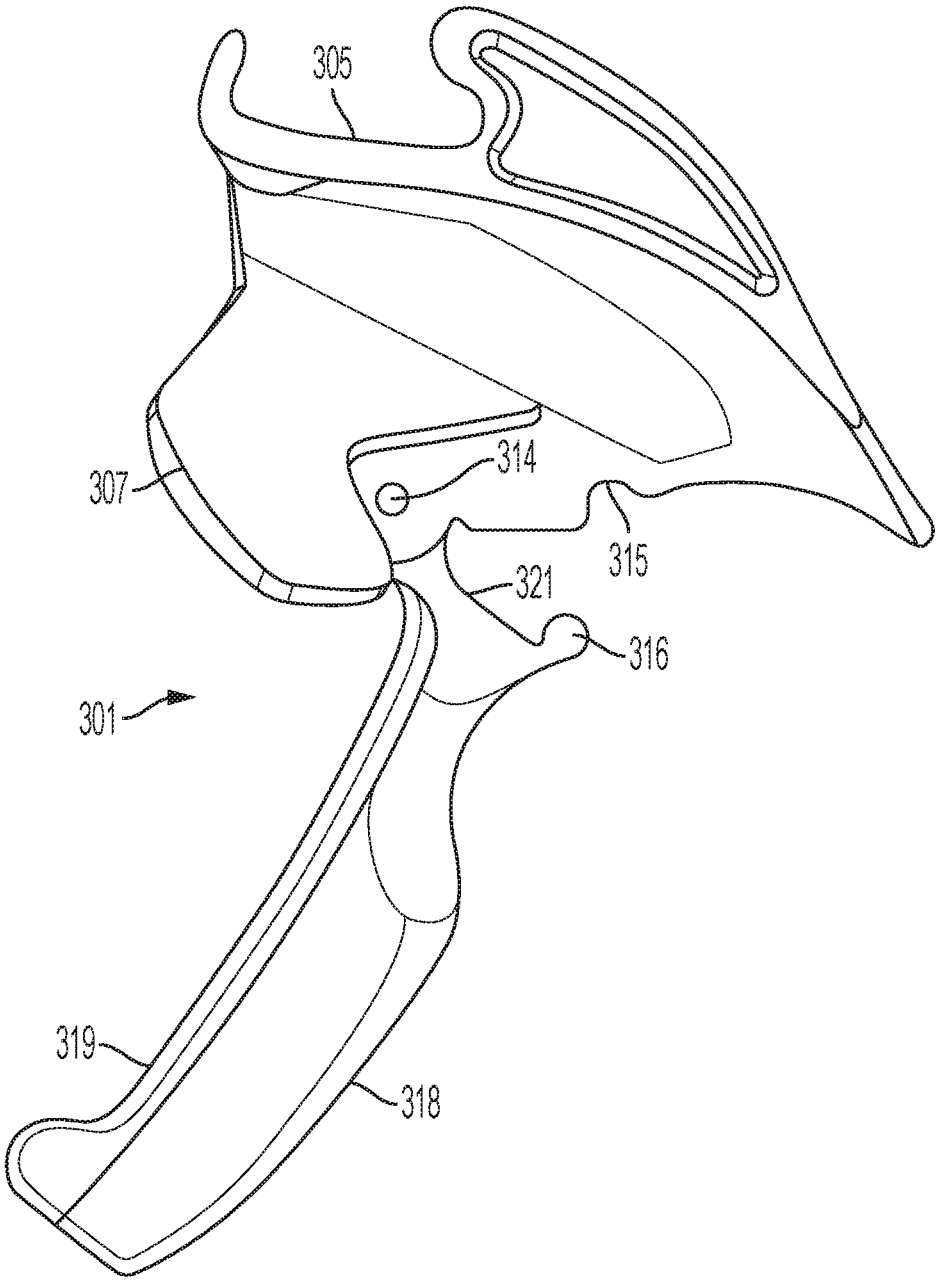
FIG. 53 is a right side view of the handleless slingshot of FIG. 52.
Figure 54:
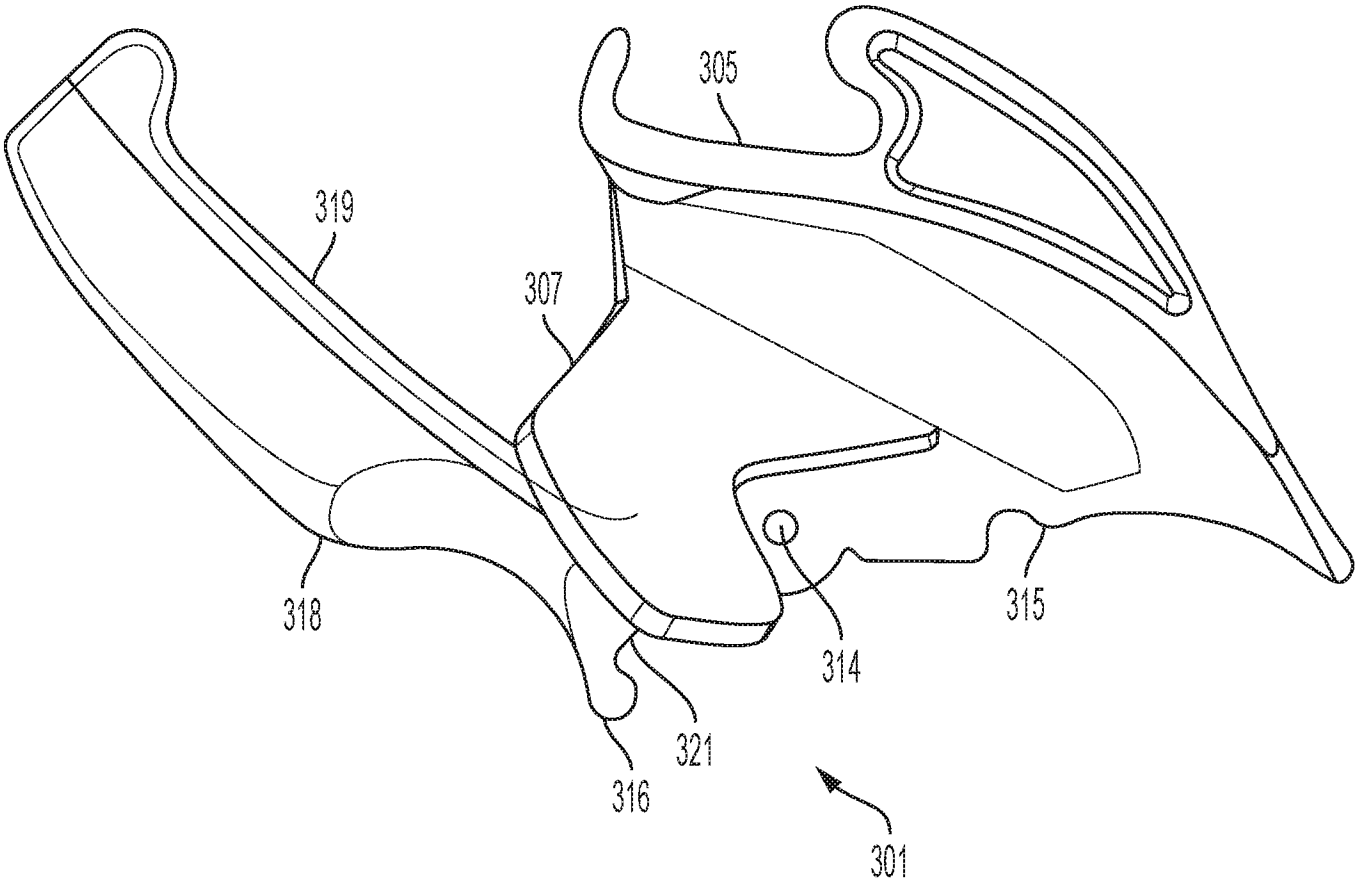
FIG. 54 is a right side view of the handleless slingshot of FIGS. 50 and 64, showing the folding storage compartment in a further partially folded position.
Figure 55:
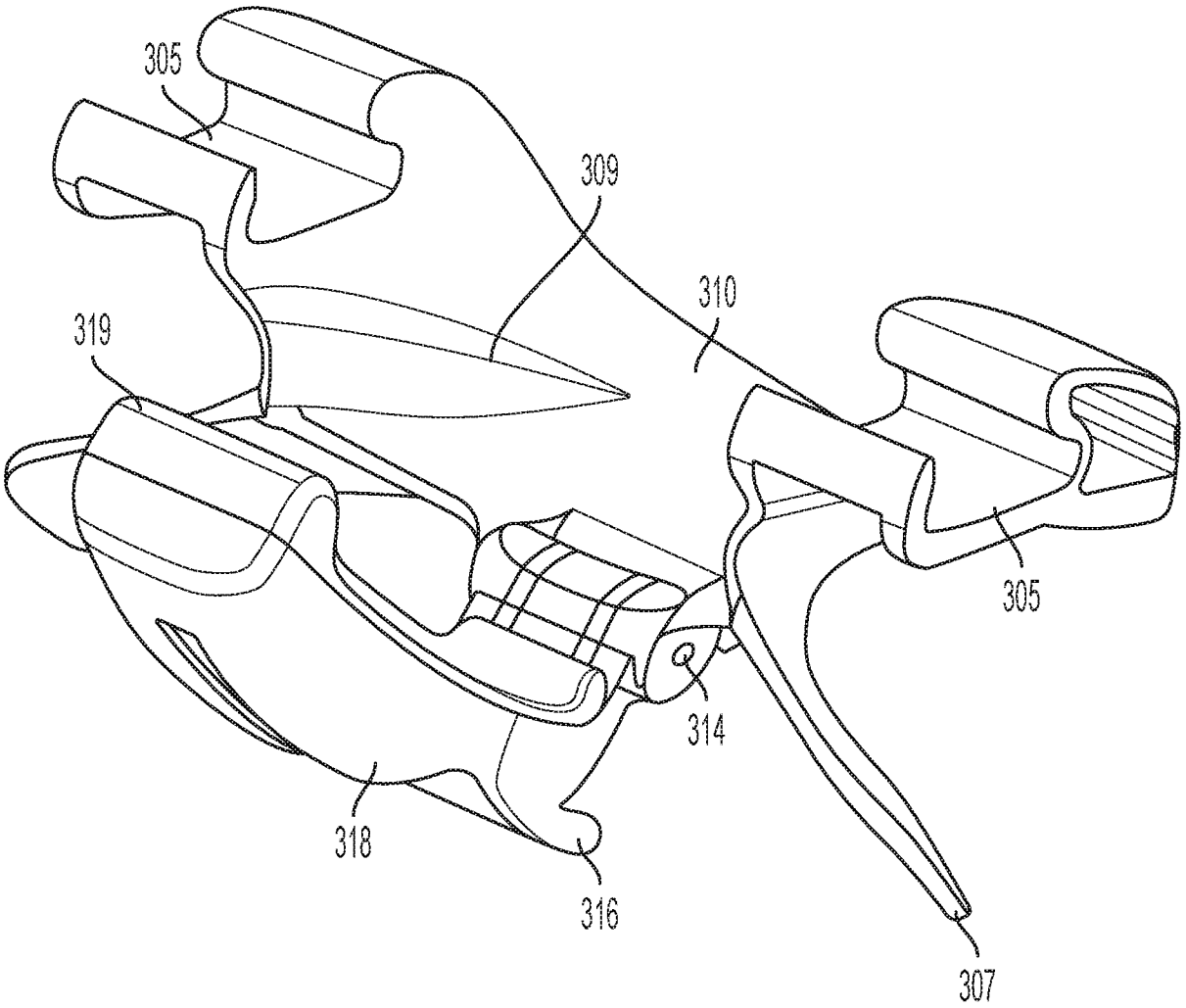
FIG. 55 is a front perspective view of the handleless slingshot of FIG. 54.

In one embodiment, the palm plate 522 may be formed having a different contour or profile than the palm plate 222 described in the embodiments above. For example, with reference to FIGS. 107 and 108, for example, a lower edge 525 of the enlarged tongue may be formed as a substantially flat section, extending substantially flush with a lower edge of the intermediate lip 524. In contrast, as shown in FIGS. 46 and 47, for example, the enlarged tongue 221 may be formed such that it increases thickness (i.e., in the vertical direction in the orientation of FIGS. 46 and 47) relative to the intermediate lip 224 on both upper and lower edges.

Figure 42:
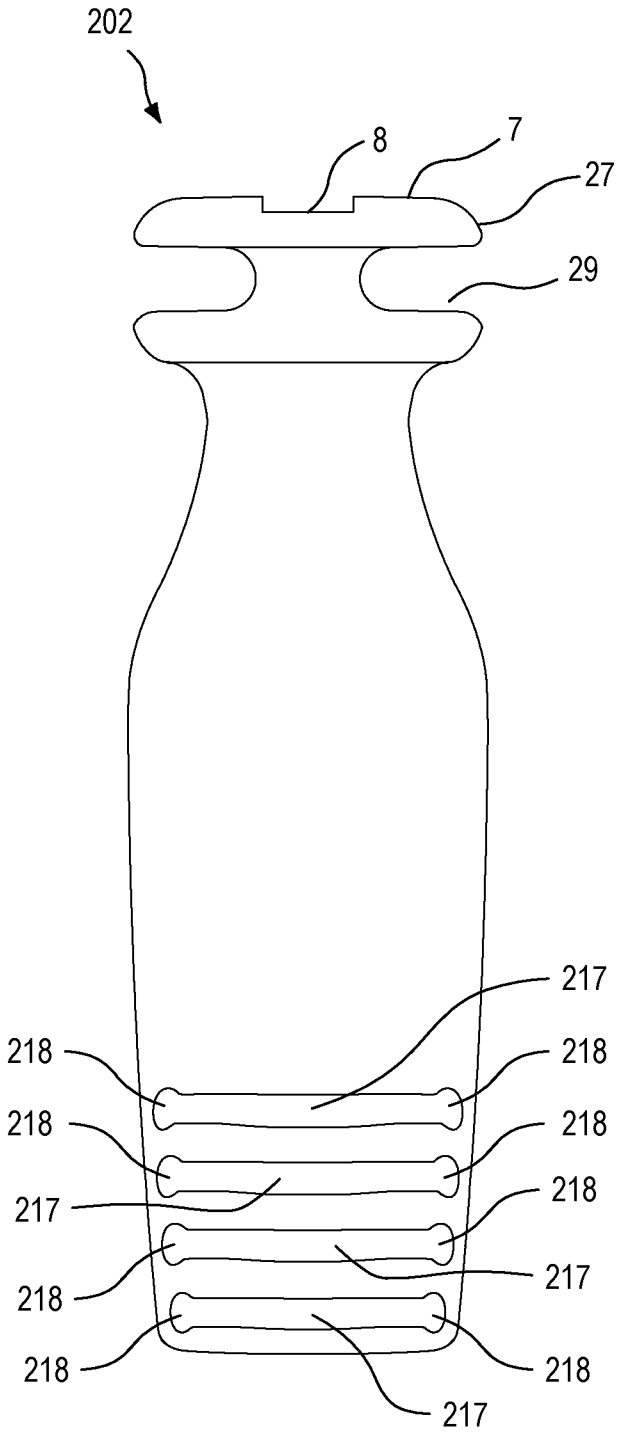
FIG. 42 is a rear view of the handle of FIG. 36.
Figure 43:
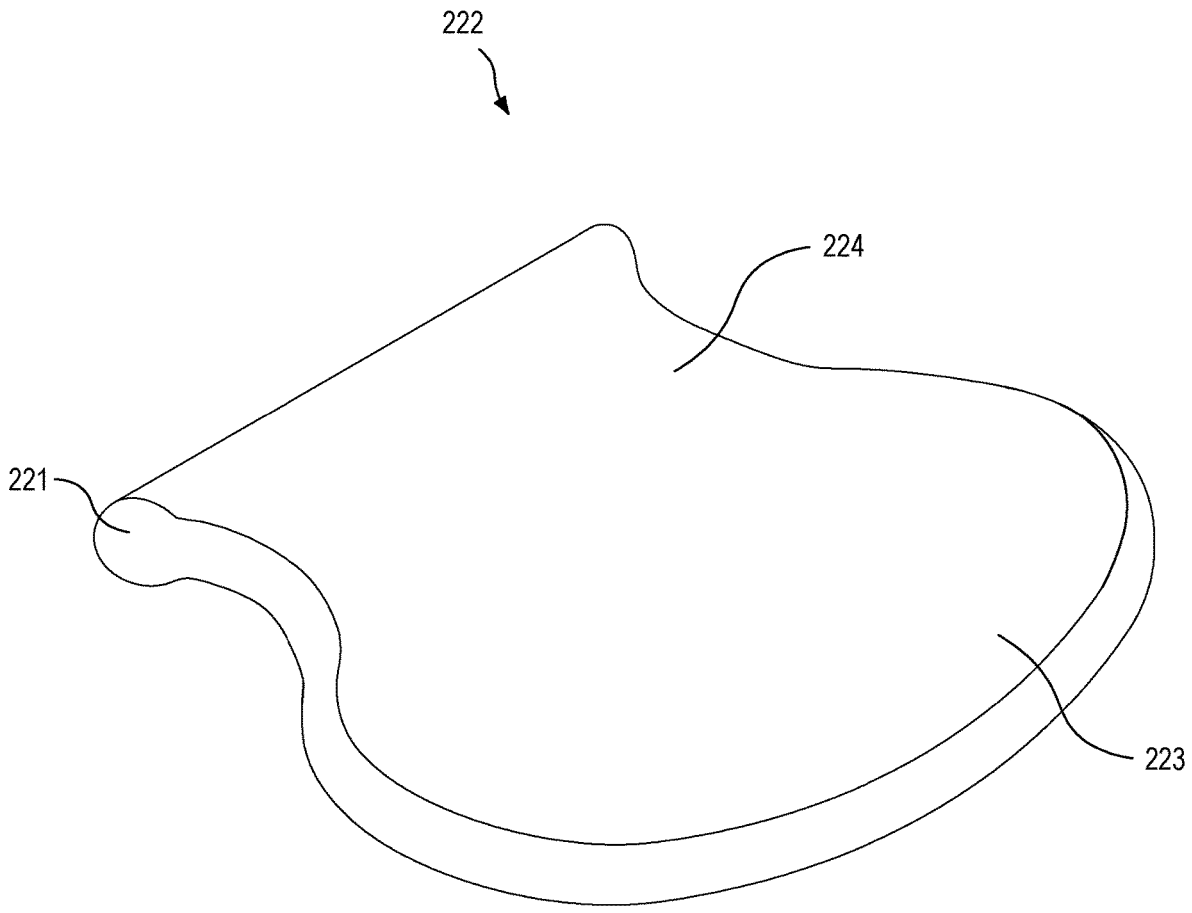
FIG. 43 is an enlarged perspective view of a palm plate of the slingshot according to another embodiment.
Figure 44:
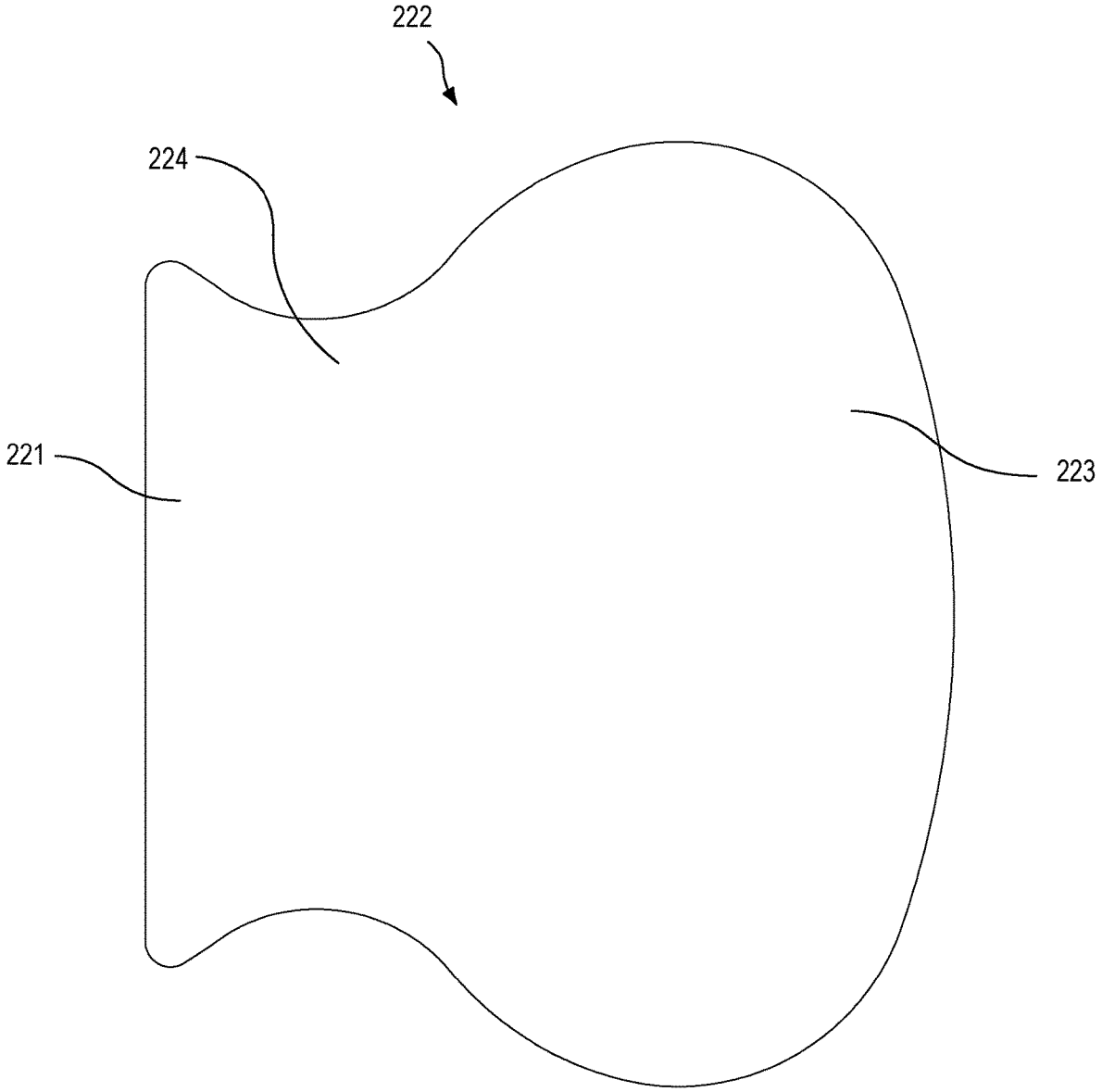
FIG. 44 is a top view of the palm plate of FIG. 43.
Figure 45:
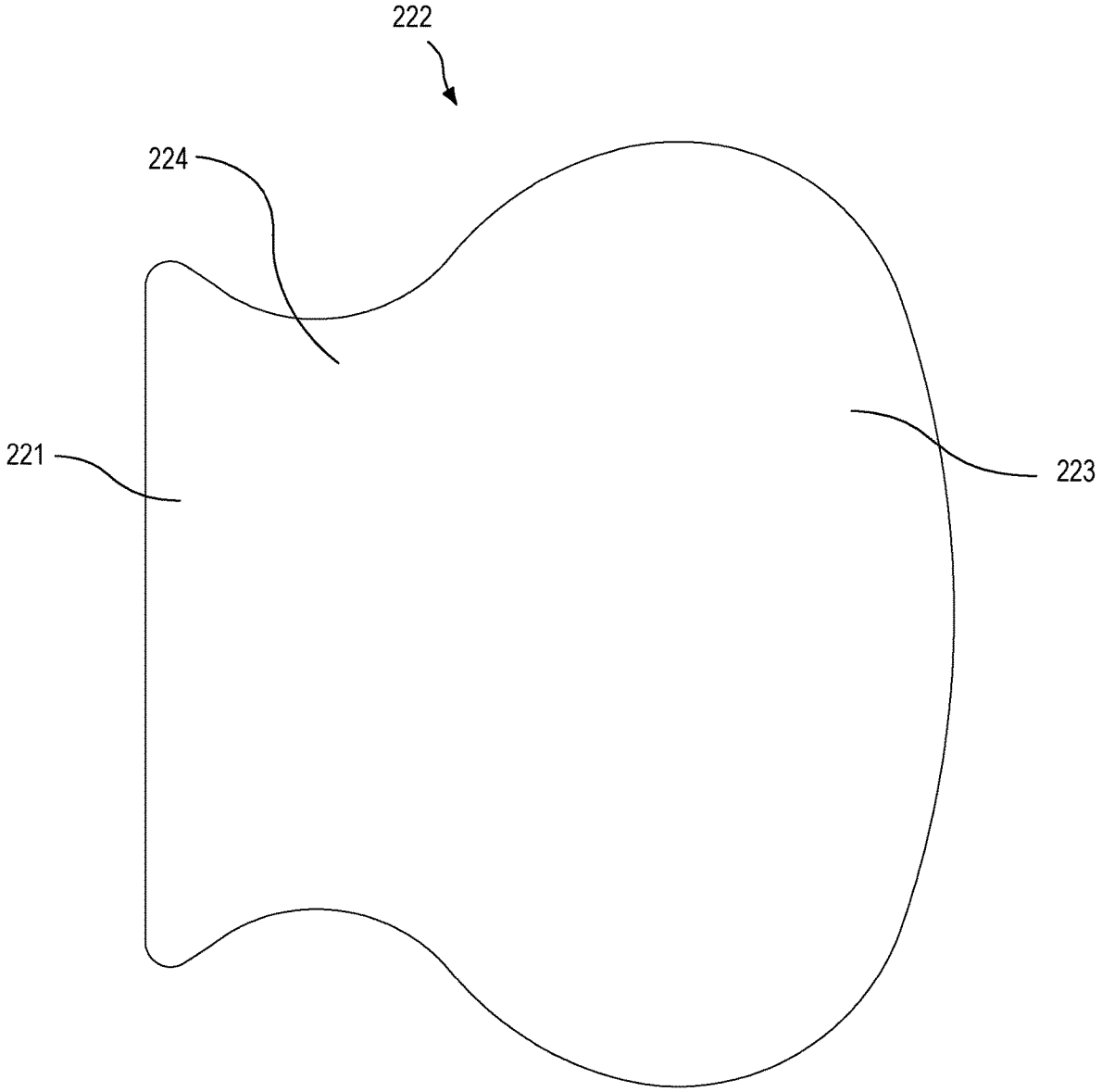
FIG. 45 is a bottom view of the palm plate of FIG. 43.

Similarly, the channel section 518 of each positioning element 517 may be formed having a different profile compared to the enlarged channels 218 of the grooves 217 in the embodiment above, such that the profile of the channel sections 518 generally corresponds in shape and size to the profile of the enlarged tongue 521 on the palm plate 522. For example, with reference to FIGS. 99-101, a lower edge 519 of the channel section 518 of each positioning element 517 may be substantially flat and flush with a remainder of the positioning element 517. In contrast, as shown in FIG. 42, for example, the enlarged channels 218 of an embodiment above may include generally round upper and lower edges to correspond to the profile of the enlarged tongue 221 of the palm plate 222. Accordingly, in the embodiments described herein, and shown, for example in FIGS. 91-112, the palm plate 522 may be held within one of the positioning elements 517 in way that resists rotation due to the corresponding flat lower edges 525, 519 of the enlarged tongue 521 and channel section 518, respectively.

In the embodiments described above and shown in FIGS. 91-112, a user may grip the slingshot 501 by positioning their palm on the gripping portion of the handle 502 and positioning their index finger and thumb on respective wings 570. In this manner, the user's hand may be substantially out of a travel path of the slingshot band during recoil of the band. As such, a handle guard may be omitted in these embodiments. In addition, the palm plate 522 is adjustable along a length of the handle 502 by alternatively and removably positioning at least partially within a positioning element 517 of the plurality of positioning elements 517. The palm plate 522 is configured to support a user's hand thereon, and is adjustable along the length of the handle 502 to accommodate differently sized hands.

FIGS. 113-120 show a slingshot 601 according to another embodiment described herein. Referring generally to FIGS. 113-120, the slingshot 601 includes a body 602 having a pair of integrated arms 603. The body 602 also includes an upper portion 604 at an end of each arm 603, the upper portion 604 serving as a band mount, and having a groove 605 configured to receive a clip (not shown) for securing a band (not shown) to respective upper portions 604. The upper portions 604 may be similar or identical to the band attachment device 5 described above. The body 602 also includes a pair of wings 607 and a lower portion 606 extending between and connecting the wings 607 to one another.

In one embodiment, the body 602 is formed as a wire body or wire-like body. The wire may be formed as a single, continuous structure and may be sufficiently rigid to as to limit elastic deformation and substantially avoid plastic deformation when subjected to regular forces encountered during normal use of the slingshot 601. It is understood, however, that the present disclosure is not limited to this configuration, and the body 602 may be formed of a plurality of wire or wire-like components secured together. Alternatively, or in addition, the body 602 may be formed having reinforced or strengthened sections to resist unintentional deformation and increase durability. In one embodiment, the body 602 may be formed of a metal material. In another embodiment, the body 602 may be formed of, for example, a polymer or a composite material.

In one embodiment, the lower portion 606 may be formed substantially as a "U" shaped section, and may be positioned generally in a central region of the slingshot 601 in a lateral direction. The lower portion 606 may also function as an arm or wrist brace during use of the slingshot 601. For example, the lower portion 606 may be brought into contact against and be braced on the user's arm or wrist while the band is drawn back and loaded.

As best shown in FIGS. 115-118, each wing 607 may be formed having an open area 631 configured to receive a portion of the user's hand, such as a thumb or finger. In one embodiment, one wing 607 may receive the user's thumb while the other wing 607 may receive the user's index finger. Further, in one embodiment, each wing 607 may be formed generally as an open loop of wire and may be elongated. It is understood that the user's thumb and/or finger may alternatively be positioned against the respective wings 607, rather than extend into the open areas 631. It is also understood that the wings 607 may be formed in different shapes or sizes, so long as they may be used to support the slingshot on a user's hand, for example, at a thumb and index finger, during use.

The arms 603 are connected to the upper portions 604 using one or more known, suitable fastening techniques, such as adhesives, threaded fasteners and the like. In addition, in one embodiment, the slingshot 602 may be symmetric about a centerline extending from a front to a rear of the slingshot 602 and about a centerline extending from a top to a bottom of the slingshot 602.

Accordingly, the embodiments above, and in the examples shown in FIGS. 113-120, the slingshot 601 may be a handleless slingshot, in that a traditional handle and gripping portion intended to be grasped by a user's palm and fingers are omitted. Rather, the slingshot 601 of this embodiment may be braced against the user's arm or wrist, and further supported, for example, by a user's thumb and index finger at the pair of wings 607. Further, in this embodiment, by providing a shaped wire or wire-like body 602, materials used in manufacturing the slingshot may be reduced or limited when compared to traditional slingshots, thereby reducing weight and bulkiness of the device. Further, the terminology "wire" and "wire-like" refers generally to an elongated piece of material formed in a desired shape. The "wire" or "wire-like" body 602 may also be formed having a same cross-sectional shape and size throughout an entirety of its length. However, it is understood that the present disclosure is not limited to such a configuration. For example, as noted above, in some embodiments, the body may include strengthened or reinforced sections, which may be formed, for example, by providing an increased thickness of material.

Figure 121:
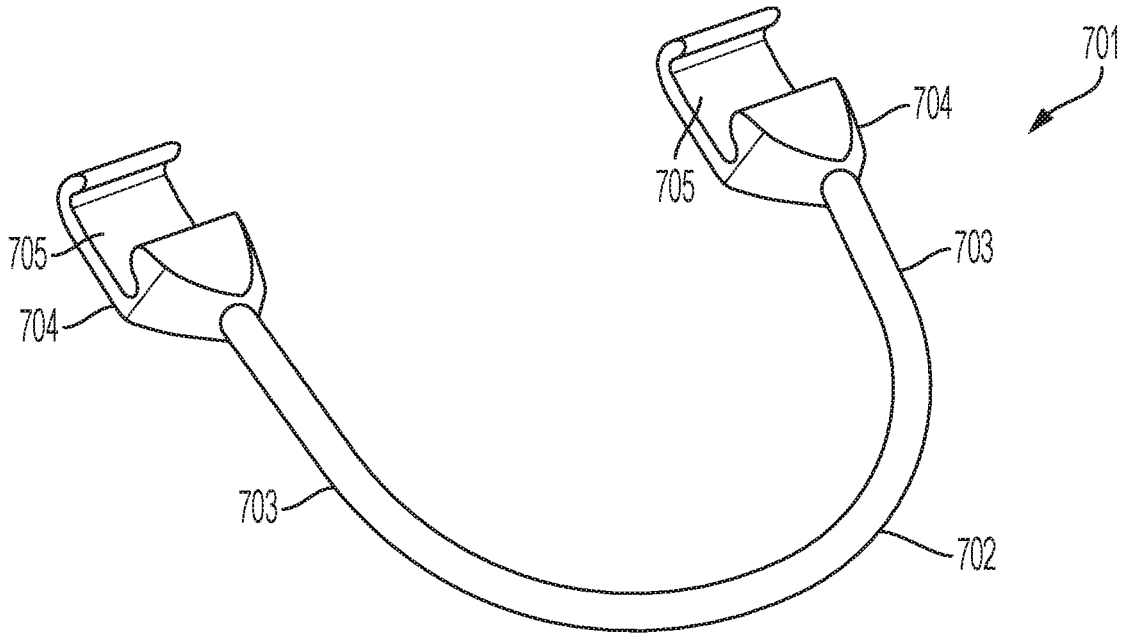
FIG. 121 is a perspective view of a slingshot according to another embodiment described herein.
Figure 122:
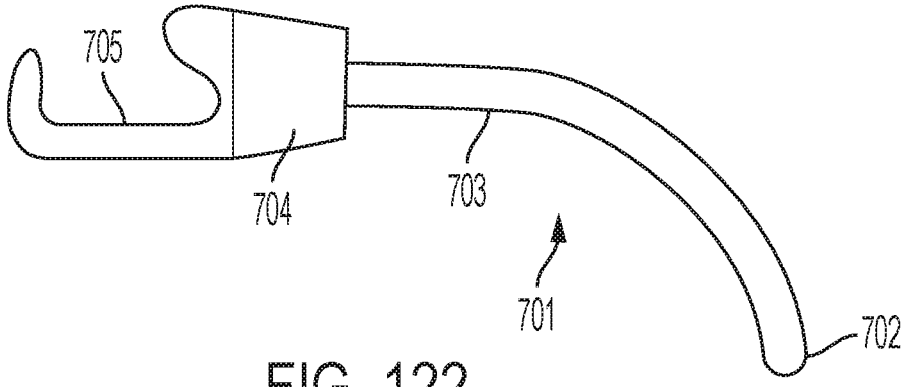
FIG. 122 is a side view of the slingshot of FIG. 121.
Figure 123:
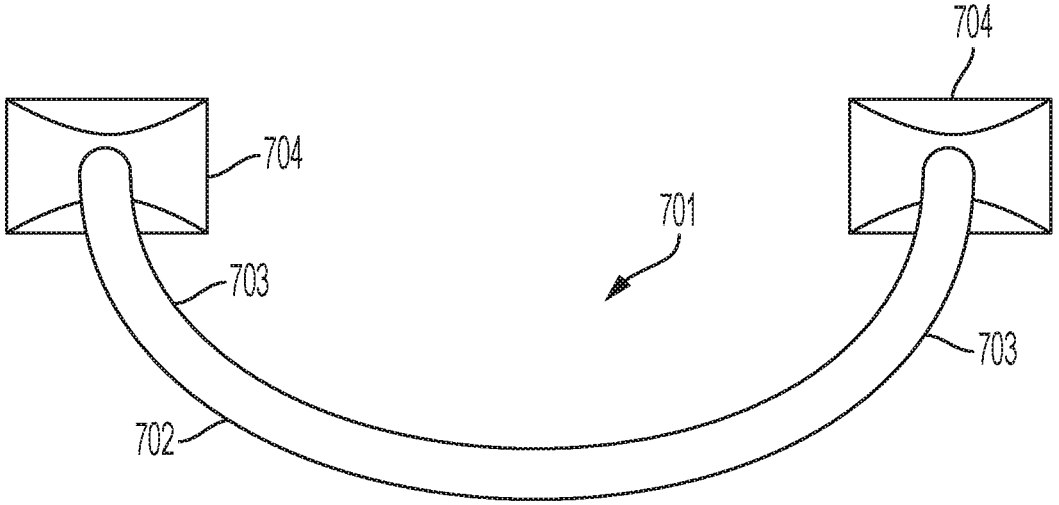
FIG. 123 is a rear view of the slingshot of FIG. 121.

FIGS. 121-126 show a slingshot 701 according to another embodiment described herein. Referring generally to FIGS. 121-123, slingshot 701 includes a body 702 having a pair of integrated arms 703. The body 702 also includes an upper portion 704 at an end of each arm 703, the upper portion 704 serving as a band mount, and having a groove 705 configured to receive a clip (not shown) for securing a band (not shown) to respective upper portions 704. The upper portions 705 may be similar or identical to the band attachment device 5 described above. It will be appreciated by those skilled in the art that other band attachment devices and means may be used to secure the band to slingshot 701 without departing from the scope of the present disclosure.

As further shown in FIGS. 121-123, body 702 is formed as a single, continuous piece of material, which may be a wire or wire-like material made of metal, plastic, wood or any other suitable material. In the disclosed embodiment, body 702 is form in the shape of a compound-bent "U," which generally follows the general contour of body 302 of slingshot 301 shown in FIGS. 50-74.

Figure 124:
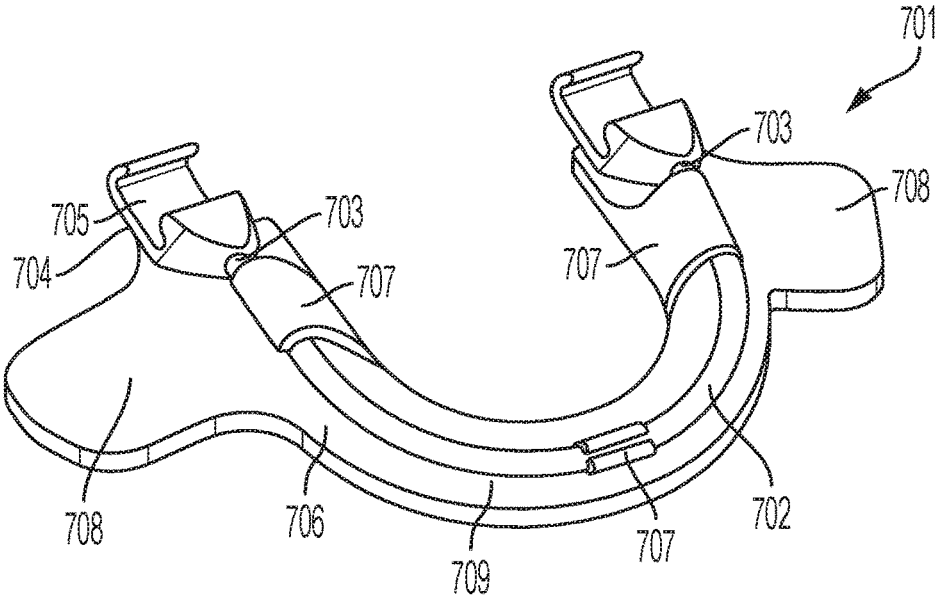
Figure 125:
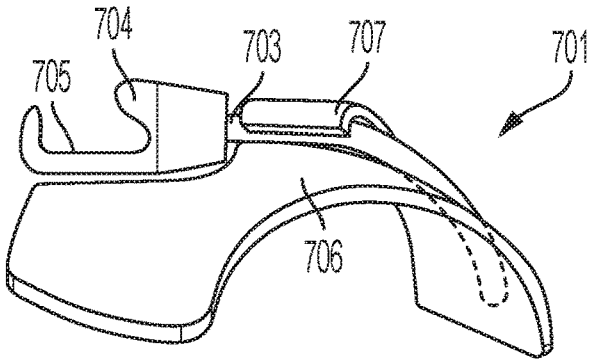
Figure 126:
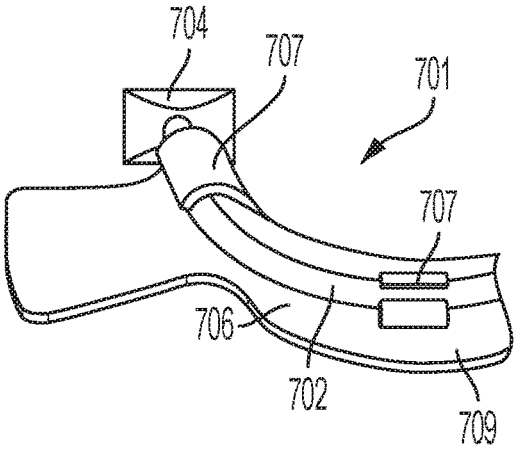

In FIGS. 124-126, slingshot 301 is shown further comprising a support structure 706. Support structure 706 attaches to body 702 and arms 703 of slingshot 701, in the disclosed embodiment, using snap-fit clips 707. Those skilled in the art will appreciate that other attachment means, such as mechanical fasteners, are possible without departing from the scope of the present disclosure.

Support structure 706 may be formed as a single member that generally follows the general contour of body 702 and arms 703. Support structure 706 may be formed as a single member or may be formed as multiple members that attach along body 702 and arms 703. Support structure 706 may be formed of plastic or any other suitable material to provide a sturdy and, preferably, lightweight structure.

As shown in FIGS. 124-126, support structure 706 comprises finger platforms 708 upon which a user of slingshot 301 may rest the user's index finger and thumb when using slingshot 301 (finger platforms 708 are similar in design and function to wings 307 of slingshot 301 shown in FIGS. 50-74). Support structure 706 further comprises web platform 709 upon which the user may rest the web area between the user's index finger and thumb (web platform 709 is similar in design and function to guard area 310 of slingshot 301 shown in FIGS. 50-74).

It is understood that the various features described in the embodiments above may be used together with, or replace other features in the different embodiments described above.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A slingshot, the slingshot comprising:

a handle including a plurality of positioning grooves, the positioning grooves spaced along a length of the handle, each positioning groove having substantially the same size and shape as one another and including a channel section within the groove;

a pair of forward facing arms extending upwardly and forwardly from the handle, each arm having a band attachment device;

a pair of wings positioned at the top of the handle and extending laterally outward and forward from the handle, each wing configured to support a portion of a user's hand on an upper surface of the wing; and a palm plate removably secured to the handle at one positioning groove of the plurality of positioning grooves, wherein the palm plate is configured to be removed from the positioning groove of the plurality of positioning grooves and secured to another positioning groove of the plurality of positioning grooves to adjust a position of the palm plate along a length of the handle, the palm plate having a body and an enlarged tongue configured to engage the channel section to secure the palm plate within the positioning groove.

2. The slingshot of claim 1, wherein the palm plate includes a body, an intermediate lip and an enlarged tongue, the enlarged tongue having a thickness greater than a thickness of the body and the intermediate lip.

3. The slingshot of claim 2, wherein the enlarged tongue is engaged in the positioning groove and the body is positioned outwardly from the positioning groove.

4. The slingshot of claim 1, wherein the positioning groove includes an enlarged channel section, the enlarged channel section having a height greater than a height of a remainder of the positioning groove.

5. The slingshot of claim 4, wherein the palm plate includes a body, an intermediate lip and an enlarged tongue, and the enlarged tongue is configured to engage the enlarged channel section of the positioning groove, the enlarged tongue having a thickness greater than a thickness of the body and the intermediate lip.

6. The slingshot of claim 1, wherein the wings extend in generally opposite directions relative to the handle.

7. The slingshot of claim 1, wherein the wings have a common center sections positioned at the handle, and the wings extend outwardly from the center section.

8. The slingshot of claim 7, wherein the wings extend at a downward angle relative to the center section.

9. The slingshot of claim 1, further comprising an arm brace secured to the handle and a retaining clip for securing the arm brace to the handle.

10. The slingshot of claim 1, the handle further comprising a top having an elongated recess formed with a substantially constant thickness and depth, configured to receive a portion of a retaining clip.

11. A handleless slingshot comprising:

a body having a lower portion, a pair of wings connected to one another by the lower portion, a pair of integrated arms, each arm formed integrally with a respective wing, and respective upper portions connected to each arm, each upper portion configured for attachment of a slingshot band thereto, wherein the body is formed as a single, continuous piece of wire or wire-like material, and wherein each wing extends in a respective length direction and forms an elongated surface extending in the respective length direction generally parallel to, and extending along a length of, a thumb and an index finger, respectively, of a user when the user operates the slingshot, and wherein each wing includes an open end and a closed end opposite to the open end in the length direction, and each upper portion is disposed above a respective wing and between the open end and the closed end relative to the length direction when the user operates the slingshot.

12. The handleless slingshot claim 11, wherein each wing is formed as an open loop from the wire or wire-like material.

13. The handleless slingshot of claim 12, wherein each open loop is elongated.

14. The handleless slingshot of claim 11, wherein each wing extends forward and outwardly relative to the lower portion.

15. A handleless slingshot comprising;

a body, the body formed in a compound-bend U-shape about three axes and having a pair of integrated arms, each arm formed with respective upper portions, each upper portion configured for attachment of a slingshot band thereto, wherein the body is formed as a single, unlooped continuous piece of wire or wire-like material, wherein the body has a closed end and an open end opposite to the closed end, and extends between the respective upper portions, wherein the closed end is disposed rearward and below the open end when a user operates the slingshot, and wherein the body curves continuously along its shape between the respective upper portions wherein the body does not have a handle configured to be grasped by a user's palm and fingers when the user operates the slingshot.

16. The handleless slingshot of claim 15 further comprising a support structure attached to the body, the support structure having a web platform at a rear position extending under the closed end and a pair of finger platforms at a forward position, the finger platforms positioned opposite from one another and extending laterally relative to the respective upper portions of the arms.

17. The handleless slingshot of claim 11, wherein each arm extends from the open end of a respective wing in an upward direction and generally toward the closed end of the respective wing in a side view, and the upper portion is disposed at an end of the arm.

18. The handleless slingshot of claim 16, wherein each finger platform has a leading end and a trailing end disposed rearward of the leading end, and wherein each upper portion is disposed above a respective finger platform and between the leading end and the trailing end of the finger platform.

* * * * *